US011005161B2

(12) United States Patent
Jeong et al.

(10) Patent No.: US 11,005,161 B2
(45) Date of Patent: May 11, 2021

(54) MULTILAYER BOWTIE ANTENNA STRUCTURE

(71) Applicant: QUALCOMM Incorporated, San Diego, CA (US)

(72) Inventors: Seong Heon Jeong, Tuscaloosa, AL (US); Mohammad Ali Tassoudji, San Diego, CA (US); Alireza Mohammadian, San Diego, CA (US); Jorge Fabrega Sanchez, San Diego, CA (US); Taesik Yang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 65 days.

(21) Appl. No.: 16/163,310

(22) Filed: Oct. 17, 2018

(65) Prior Publication Data

US 2019/0123425 A1 Apr. 25, 2019

Related U.S. Application Data

(60) Provisional application No. 62/575,282, filed on Oct. 20, 2017.

(51) Int. Cl.
*H01Q 21/00* (2006.01)
*H01Q 1/24* (2006.01)
(Continued)

(52) U.S. Cl.
CPC ..... *H01Q 1/243* (2013.01); *H01Q 1/38* (2013.01); *H01Q 1/523* (2013.01); *H01Q 9/065* (2013.01);
(Continued)

(58) Field of Classification Search
CPC ..... H01Q 1/243; H01Q 9/285; H01Q 1/38; H01Q 9/065; H01Q 21/29; H01Q 1/523; H01Q 9/28; H01Q 21/062
See application file for complete search history.

(56) References Cited

U.S. PATENT DOCUMENTS 5,420,596 A * 5/1995 Burrell ..... H01Q 1/243 343/700 MS
5,485,167 A * 1/1996 Wong ..... H01Q 21/062 343/753
(Continued)

FOREIGN PATENT DOCUMENTS

DE 102010019904 A1 11/2011
WO WO-2013066451 A1 5/2013
WO WO-2016138267 A1 9/2016

OTHER PUBLICATIONS

International Search Report and Written Opinion—PCT/US2018/056444—ISA/EPO—dated Jan. 16, 2019.

*Primary Examiner* — Dieu Hien T Duong
(74) *Attorney, Agent, or Firm* — QUALCOMM Incorporated

(57) ABSTRACT

Methods, systems, and devices for wireless communications are described. An antenna structure for wideband coverage may include a first bowtie antenna disposed in a first plane. The first bowtie antenna may be, for example, an elliptical bowtie antenna or a triangular bowtie antenna. The antenna structure may also include a plurality of additional bowtie antennas, each of the plurality of additional bowtie antennas disposed in a different plane parallel to the first plane. The first bowtie antenna and the plurality of additional bowtie antennas may be stacked in a first direction perpendicular to the first plane to form a bowtie antenna stack. The antenna
(Continued)

structure may include a plurality of bowtie antenna stacks. The antenna structure may also include a staggered conductive wall.

50 Claims, 30 Drawing Sheets

(51) Int. Cl.

| | |
|---|---|
| ***H01Q 9/28*** | (2006.01) |
| ***H01Q 1/38*** | (2006.01) |
| ***H01Q 9/06*** | (2006.01) |
| ***H01Q 21/29*** | (2006.01) |
| ***H01Q 1/52*** | (2006.01) |
| ***H01Q 21/06*** | (2006.01) |

(52) U.S. Cl.
CPC ..... *H01Q 9/28* (2013.01); *H01Q 9/285* (2013.01); *H01Q 21/062* (2013.01); *H01Q 21/29* (2013.01)

(56) References Cited

U.S. PATENT DOCUMENTS

| | | | | |
|---|---|---|---|---|
| 6,342,866 | B1 | 1/2002 | Ho et al. | |
| 10,033,100 | B1 * | 7/2018 | Chayat | H01Q 21/08 |
| 2003/0090436 | A1 * | 5/2003 | Schantz | H01Q 13/085 343/908 |
| 2004/0217912 | A1 * | 11/2004 | Mohammadian | H01Q 13/085 343/795 |
| 2011/0285474 | A1 * | 11/2011 | Ali | H01P 5/10 333/33 |
| 2011/0316139 | A1 * | 12/2011 | Zhao | H01L 23/66 257/692 |
| 2012/0293381 | A1 * | 11/2012 | Apostolos | H01Q 3/26 343/713 |
| 2014/0361946 | A1 * | 12/2014 | Ganchrow | H01Q 19/30 343/795 |
| 2015/0194736 | A1 * | 7/2015 | Diukman | H01Q 21/0006 343/818 |
| 2017/0110801 | A1 | 4/2017 | Jan et al. | |

* cited by examiner

700

900

MULTILAYER BOWTIE ANTENNA STRUCTURE

CROSS REFERENCES

The present Application for Patent claims the benefit of U.S. Provisional Patent Application No. 62/575,282 by JEONG, et al., entitled "MULTILAYER BOWTIE ANTENNA STRUCTURE," filed Oct. 20, 2017, assigned to the assignee hereof, and expressly incorporated herein by reference in its entirety.

BACKGROUND

The following relates generally to wireless communication, and more specifically to multilayer bowtie antenna structures.

Wireless communications systems are widely deployed to provide various types of communication content such as voice, video, packet data, messaging, broadcast, and so on. A wireless multiple-access communications system may include a number of base stations or network access nodes, each simultaneously supporting communication for multiple communication devices, which may be otherwise known as user equipment (UE).

Base stations, UEs, and other wireless communications devices may use antennas to transmit and receive signals on a wireless medium. The design of the antenna in a particular device may impact whether and how well the device may transmit and receive signals having a certain frequency. Different types of systems may operate at different frequencies, and therefore the antennas for different types of systems may be designed based on the operating parameters required for those systems. For example, fifth generation (5G) networks in the United States operate in the 28 GHz band, and accordingly antennas for 5G devices in the United States may be designed to operate at that frequency.

SUMMARY

The described techniques relate to improved methods, systems, devices, or apparatuses that support multilayer bowtie antenna structures. Generally, the described devices include a first elliptical bowtie and a plurality of additional bowtie antennas. The first elliptical bowtie antenna may include a pair of electrically conductive ellipses disposed in a first plane. Each of the plurality of additional bowtie antennas may include a corresponding pair of electrically conductive ellipses disposed in a different plane parallel to the first plane. The first elliptical bowtie antenna and the plurality of additional elliptical bowtie antennas may be stacked in a first direction perpendicular to the first plane.

In one embodiment, a device or system may include a first elliptical bowtie antenna including a pair of electrically conductive ellipses disposed in a first plane and electrically coupled to a conductive connection configured to provide a signal to each electrically conductive ellipse, and a plurality of additional elliptical bowtie antennas. Each of the plurality of additional elliptical bowtie antennas may include a corresponding pair of electrically conductive ellipses disposed in a different plane parallel to the first plane. The first elliptical bowtie antenna and the plurality of additional elliptical bowtie antennas may form a stack of elliptical bowtie antennas stacked in a first direction perpendicular to the first plane.

In some examples of the device or system described above, the device or system may include a conductive wall extending in a second direction perpendicular to the first direction.

In some examples of the device or system described above, the conductive wall extends at least as high or higher in the first direction than the stack of elliptical bowtie antennas.

In some examples of the device or system described above, the conductive wall extends in the first direction into a plane formed by the stack of elliptical bowtie antennas.

In some examples of the device or system described above, the conductive wall may include a plurality of staggered electrical connections coupled to a grounding element.

In some examples of the device or system described above, the plurality of staggered electrical connections may include a plurality of staggered vias.

In some examples of the device or system described above, a distance between the conductive wall and the stack of elliptical bowtie antennas may be about a quarter wavelength of a target frequency of the apparatus.

In some examples, each elliptical bowtie antenna of the stack of elliptical bowtie antennas is spaced apart from an adjacent elliptical bowtie antenna of the stack of elliptical bowtie antennas in the first direction.

In some examples of the device or system described above, the device or system may include a plurality of connections coupling the first elliptical bowtie antenna and the plurality of additional elliptical bowtie antennas.

In some examples of the device or system described above, the first plane may be a horizontal plane. In some examples of the device or system described above, the first direction may be a vertical direction.

In some examples of the device or system described above, a patch antenna may be coupled to the first elliptical bowtie antenna.

In some examples of the device or system described above, a length of an electrically conductive ellipse of the first elliptical bowtie antenna may be five times a width of the electrically conductive ellipse.

In some examples of the device or system described above, one or more additional elliptical bowtie antennas have electrically conductive ellipses that have a length shorter than a length of an electrically conductive ellipse of the first elliptical bowtie antenna. In some examples, an additional elliptical bowtie antenna of the plurality of additional elliptical bowtie antennas comprises a tab. In some examples, one or more additional elliptical bowtie antennas of the stack of elliptical bowtie antennas are floating relative to the first elliptical bowtie antenna. In some examples, one or more additional elliptical bowtie antennas of the plurality of additional elliptical antennas are capacitively coupled to an adjacent elliptical bowtie antenna of the stack of elliptical bowtie antennas.

Some examples of the device or system described above may also include one or more additional elliptical bowtie antennas disposed in the first plane.

Some examples of the device or system described above may also include one or more stacks of elliptical bowtie antennas positioned adjacent to the stack of elliptical bowtie antennas in a second direction perpendicular to the first direction, where electrically conductive ellipses in each stack extend in the second direction.

Some examples of the device or system described above may also include one or more additional stacks of elliptical bowtie antennas stacked in the first direction.

In some examples of the device or system described above, the device or system may include a printed circuit board, where the stack of elliptical bowtie antennas may be mounted on the printed circuit board. In some examples of the device or system described above, the device or system may include a printed circuit board, where the stack of elliptical bowtie antennas and the conductive connection are electrically coupled to the printed circuit board.

In some examples of the device or system described above, the first elliptical bowtie antenna and the plurality of additional elliptical bowtie antennas may be configured to send and receive wireless signals in a frequency range including about 24 GHz to 43 GHz.

In one embodiment, a device or system may a first bowtie antenna including a pair of electrically conductive elements disposed in a first plane and electrically coupled to a conductive connection configured to provide a signal to each electrically conductive element, a plurality of additional bowtie antennas, and a conductive wall extending in a second direction perpendicular to a first direction. Each of the plurality of additional bowtie antennas may include a corresponding pair of electrically conductive elements disposed in a different plane parallel to the first plane, and the first bowtie antenna and the plurality of additional bowtie antennas may form a stack of bowtie antennas stacked in the first direction perpendicular to the first plane.

In some examples of the device or system described above, the conductive wall may extend at least as high or higher in the first direction than the stack of bowtie antennas. In some examples of the device or system described above, the conductive wall may extend in the first direction into a plane formed by the stack of bowtie antennas. In some examples of the device or system described above, the conductive wall may include a plurality of staggered electrical connections coupled to a grounding element. In some examples of the device or system described above, the plurality of staggered electrical connections may include a plurality of staggered vias. In some examples of the device or system described above, a distance between the conductive wall and the stack of bowtie antennas is about a quarter wavelength of a target frequency of the device or system. In some examples, each bowtie antenna of the stack is spaced apart from an adjacent bowtie antenna of the stack in the first direction. In some examples of the device or system described above, the stack of bowtie antennas may further include a plurality of connections coupling the first bowtie antenna and the plurality of additional bowtie antennas. In some examples of the device or system described above, the first plane may include a horizontal plane, the first direction may include a vertical direction, and the second direction may include a direction parallel to a vertical axis of the horizontal plane. In some examples of the device or system described above, an additional bowtie antenna of the plurality of additional bowtie antennas may include a tab. In some examples of the device or system described above, one or more additional bowtie antennas of the stack of bowtie antennas may be floating relative to the first bowtie antenna. In some examples of the device or system described above, one or more additional bowtie antennas of the plurality of additional antennas may be capacitively coupled to an adjacent bowtie antenna of the stack of bowtie antennas.

In some examples of the device or system described above, the stack of bowtie antennas may further include a patch antenna coupled to the first bowtie antenna. In some examples of the device or system described above, a length of one electrically conductive element is five times a width of the one electrically conductive element. In some examples of the device or system described above, the device or system may be a user equipment and may further include a transceiver connected to the first bowtie antenna and the plurality of additional bowtie antennas. In some examples of the device or system described above, the transceiver may be configured to use the first bowtie antenna and the plurality of additional bowtie antennas to send and receive wireless signals in a frequency range including about 26 GHz to 43 GHz.

In one embodiment, a device or system may include an array of multilayer elliptical bowtie antennas. Each of the multilayer elliptical bowtie antennas may include a first elliptical bowtie antenna including a pair of electrically conductive ellipses disposed in a first plane, and a plurality of additional elliptical bowtie antennas. Each of the plurality of additional elliptical bowtie antennas may include a corresponding pair of electrically conductive ellipses disposed in a different plane parallel to the first plane, and the first elliptical bowtie antenna and the plurality of additional elliptical bowtie antennas may be stacked in a first direction perpendicular to the first plane.

In some examples of the device or system described above, the device or system may include a conductive wall extending in a second direction perpendicular to the first direction.

In some examples of the device or system described above, the conductive wall may extend higher in the first direction than each of the multilayer bowtie antennas.

In some examples of the device or system described above, the conductive wall may include a plurality of staggered electrical connections coupled to a grounding element.

In some examples of the device or system described above, the plurality of staggered electrical connections may include a plurality of staggered vias.

In some examples of the device or system described above, a distance between the conductive wall and a closest one of the multilayer bowtie antennas may be about a quarter wavelength of a target frequency.

In some examples of the device or system described above, the device or system may include a plurality of electrical connections coupling the first elliptical bowtie antenna and the plurality of additional elliptical bowtie antennas.

In some examples of the device or system described above, the first plane may be a horizontal plane. In some examples of the device or system described above, the first direction may be a vertical direction.

In some examples of the device or system described above, the device or system may include a patch antenna coupled to the first elliptical bowtie antenna.

In some examples of the device or system described above, a length of one of the pair of electrically conductive ellipses may be five times a width of the one of the pair of electrically conductive ellipses.

In some examples of the device or system described above, the first bowtie antenna and the plurality of additional bowtie antennas may be configured to send and receive wireless signals in a frequency range including about 26 GHz to 43 GHz.

A method of wireless communication is described. The method may include mounting an antenna system on a printed circuit board, the antenna system including: a first elliptical bowtie antenna including a pair of electrically conductive ellipses disposed in a first plane and a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane.

A method of wireless communication is described. The method may include providing a signal to a multilayer bowtie antenna structure for excitation, radiating at a first frequency via a first bowtie antenna of the multilayer bowtie antenna structure, radiating at a second frequency via an additional bowtie antenna of the multilayer bowtie antenna structure, where the first bowtie antenna and the additional bowtie antenna form a stack of bowtie antenna in a first direction, and reflecting, via a conductive element, radiations of the stack of bowtie antennas.

In some examples of the method described herein, the stack of bowtie antennas form an array with one or more additional stacks of bowtie antennas to increase directivity of the multilayer bowtie antenna structure. In some examples of the method as described herein, each bowtie antenna of the stack of bowtie antennas are spaced apart from an adjacent bowtie antenna of the stack of bowtie antennas in the first direction. In some examples of the method as described herein, each bowtie antenna of the stack of bowtie antennas is coupled to an adjacent bowtie antenna of the stack of bowtie antennas via a plurality of connections. In some examples of the method described herein, the conductive element may include at least one of a conductive wall or a conductive bar extending in a second direction perpendicular to the first direction. In some examples of the method described herein, the conductive wall may include a plurality of staggered vias.

An apparatus for wireless communication is described. The apparatus may include means for mounting an antenna system on a printed circuit board, the antenna system including: a first elliptical bowtie antenna including a pair of electrically conductive ellipses disposed in a first plane and a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane.

Another apparatus for wireless communication is described. The apparatus may include means for radiating at different frequencies, the means for radiating including a stack of bowtie antennas, and means for reflecting radiations of the stack of bowtie antennas to increase symmetry of radiation pattern at least one of the different frequencies. In some examples of the apparatus for wireless communication described above, the apparatus may further include means for increasing directivity of the apparatus via one or more additional stacks of bowtie antennas forming an array with the stack of bowtie antennas. In some examples of the apparatus for wireless communication described above, each bowtie antenna of the stack of bowtie antennas are spaced apart from an adjacent bowtie antenna in the first direction. Some examples of the apparatus for wireless communication described above may further include means for coupling each bowtie antenna of the stack of bowtie antennas to an adjacent bowtie antenna of the stack of bowtie antennas. In some examples of the apparatus for wireless communication described above, the means for reflecting radiations may include at least one of a conductive wall or a conductive strip extending in a second direction perpendicular to the first direction. In some examples of the apparatus for wireless communication described above, the conductive wall may include a plurality of staggered conductive elements. In some examples of the apparatus for wireless communication described above, the plurality of staggered conductive elements may include a plurality of vias.

Another apparatus for wireless communication is described. The apparatus may include means for providing a signal to a first bowtie antenna for excitation, the first bowtie antenna radiating at a first frequency, means for replicating the excitation of the first bowtie antenna by a plurality of additional bowtie antennas forming a stack of bowtie antennas with the first bowtie antenna, where the additional bowtie antennas radiate at different frequencies, and means for reflecting radiations of the stack of bowtie antennas towards a desired direction. In some examples of the apparatus for wireless communication described above, the apparatus may further include means for additionally reflecting the radiations towards the desired direction.

Another apparatus for wireless communication is described. The apparatus may include a processor, memory in electronic communication with the processor, and instructions stored in the memory. The instructions may be operable to cause the processor to mount an antenna system on a printed circuit board, the antenna system including: a first elliptical bowtie antenna including a pair of electrically conductive ellipses disposed in a first plane and a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane.

Some examples of the method, apparatus, and non-transitory computer-readable medium described above may further include processes, features, means, or instructions for coupling a power source to the first elliptical bowtie antenna.

Some examples of the method, apparatus, and non-transitory computer-readable medium described above may further include processes, features, means, or instructions for positioning a conductive wall relative to the stack of elliptical bowtie antennas based at least in part on a distance corresponding to a quarter wavelength of a target frequency.

In some examples of the method, apparatus, and non-transitory computer-readable medium described above, the conductive wall may include a plurality of staggered electrical connections coupled to a grounding element.

Some examples of the method, apparatus, and non-transitory computer-readable medium described above may further include processes, features, means, or instructions for coupling the first elliptical bowtie antenna to the plurality of additional elliptical bowtie antennas via a plurality of electrical connections.

Some examples of the method, apparatus, and non-transitory computer-readable medium described above may further include processes, features, means, or instructions for selecting a width of one of the pair of electrically conductive ellipses. Some examples of the method, apparatus, and non-transitory computer-readable medium described above may further include processes, features, means, or instructions for selecting a length of the one of the pair of electrically conductive ellipses that may be five times the width.

A method of wireless communication is described. The method may include coupling a power source to a first elliptical bowtie antenna in an antenna system, the antenna system including: a first elliptical bowtie antenna including a pair of electrically conductive ellipses disposed in a first plane, a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane, and exciting the first elliptical bowtie antenna using the power source.

An apparatus for wireless communication is described. The apparatus may include means for coupling a power source to a first elliptical bowtie antenna in an antenna system, the antenna system including: a first elliptical bowtie antenna including a pair of electrically conductive ellipses disposed in a first plane, a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane, and means for exciting the first elliptical bowtie antenna using the power source.

Another apparatus for wireless communication is described. The apparatus may include a processor, memory in electronic communication with the processor, and instructions stored in the memory. The instructions may be operable to cause the processor to couple a power source to a first elliptical bowtie antenna in an antenna system, the antenna system including: a first elliptical bowtie antenna including a pair of electrically conductive ellipses disposed in a first plane, a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane, and excite the first elliptical bowtie antenna using the power source.

A non-transitory computer-readable medium for wireless communication is described. The non-transitory computer-readable medium may include instructions operable to cause a processor to couple a power source to a first elliptical bowtie antenna in an antenna system, the antenna system including: a first elliptical bowtie antenna including a pair of electrically conductive ellipses disposed in a first plane, a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane, and excite the first elliptical bowtie antenna using the power source.

In some examples of the method, apparatus, and non-transitory computer-readable medium described above, a conductive wall extending in a second direction perpendicular to the first direction.

In some examples of the method, apparatus, and non-transitory computer-readable medium described above, the conductive wall extends higher in the first direction than the stack of elliptical bowtie antennas.

In some examples of the method, apparatus, and non-transitory computer-readable medium described above, the conductive wall may include: a plurality of staggered electrical connections coupled to a grounding element.

In some examples of the method, apparatus, and non-transitory computer-readable medium described above, the plurality of staggered electrical connections may include a plurality of staggered vias.

In some examples of the method, apparatus, and non-transitory computer-readable medium described above, a distance between the conductive wall and the stack of elliptical bowtie antennas may be about a quarter wavelength of a target frequency.

In some examples of the method, apparatus, and non-transitory computer-readable medium described above, a plurality of electrical connections coupling the first elliptical bowtie antenna and the plurality of additional elliptical bowtie antennas.

In some examples of the method, apparatus, and non-transitory computer-readable medium described above, the first plane may include a horizontal plane. In some examples of the method, apparatus, and non-transitory computer-readable medium described above, the first direction may include a vertical direction.

In some examples of the method, apparatus, and non-transitory computer-readable medium described above, a patch antenna coupled to the first elliptical bowtie antenna.

In some examples of the method, apparatus, and non-transitory computer-readable medium described above, a length of one of the pair of electrically conductive ellipses may be five times a width of the one of the pair of electrically conductive ellipses.

In some examples of the method, apparatus, and non-transitory computer-readable medium described above, a printed circuit board, where the stack of elliptical bowtie antennas may be mounted on the printed circuit board.

In some examples of the method, apparatus, and non-transitory computer-readable medium described above, one or more additional elliptical bowtie antennas disposed in the first plane.

In some examples of the method, apparatus, and non-transitory computer-readable medium described above, one or more additional stacks of elliptical bowtie antennas stacked in the first direction.

DETAILED DESCRIPTION

Some 5G devices may operate in both the 28 GHz and 39 GHz frequency bands in the United States. Moreover, other countries may assign additional frequency bands for 5G operation. For example, some areas may allow 5G communications in a frequency range from 26 GHz to 42 GHz, and worldwide coverage may include frequency ranges from about 26 GHz to about 43.5 GHz. It would be useful to design an antenna that could be used across a large set of frequency bands, and in some cases in the frequency range from about 26 GHz to about 43.5 GHz for worldwide coverage.

An antenna structure for wideband coverage may include a first bowtie antenna disposed in a first plane. The first bowtie antenna may be, for example, an elliptical bowtie antenna or a triangular bowtie antenna. The first bowtie antenna may be coupled to a power source that may be used to excite the first bowtie antenna. The antenna structure may also include a plurality of additional bowtie antennas, each of the plurality of additional bowtie antennas disposed in a different plane parallel to the first plane. Each of the plurality of additional bowtie antennas may have the same design and dimensions as the first bowtie antenna. The additional bowtie antennas may be coupled to the first bowtie antenna via one or more electrical connectors, e.g., a plurality of vias or micro-vias. The additional bowtie antennas may be parasitic since they are not excited directly by the power source, but rather indirectly excited via the excited first bowtie antenna. The first bowtie antenna and the plurality of additional bowtie antennas may be stacked in a first direction perpendicular to the first plane to form a bowtie antenna stack. In some examples, the antenna structure may include a plurality of bowtie antenna stacks.

In some examples, the antenna structure may further include a conductive wall. The conductive wall may extend in a second direction perpendicular to the first direction. The conductive wall may extend further in the first direction than the bowtie antenna stacks (i.e., may be taller than the bowtie antenna stacks). The conductive wall may be spaced apart from the bowtie antenna stacks in a third direction perpendicular to the first direction and the second direction based on a distance corresponding to a quarter wavelength of a target frequency. The conductive wall may be staggered, i.e., may be composed of a number of electrical connectors displaced with respect to the second direction. The electrical connectors may be, for example, vias or micro-vias.

Aspects of the disclosure are initially described in the context of a wireless communications system. Aspects of the disclosure are further illustrated by and described with reference to apparatus diagrams, system diagrams, and flowcharts that relate to multilayer bowtie antenna structures.

Figure 1:
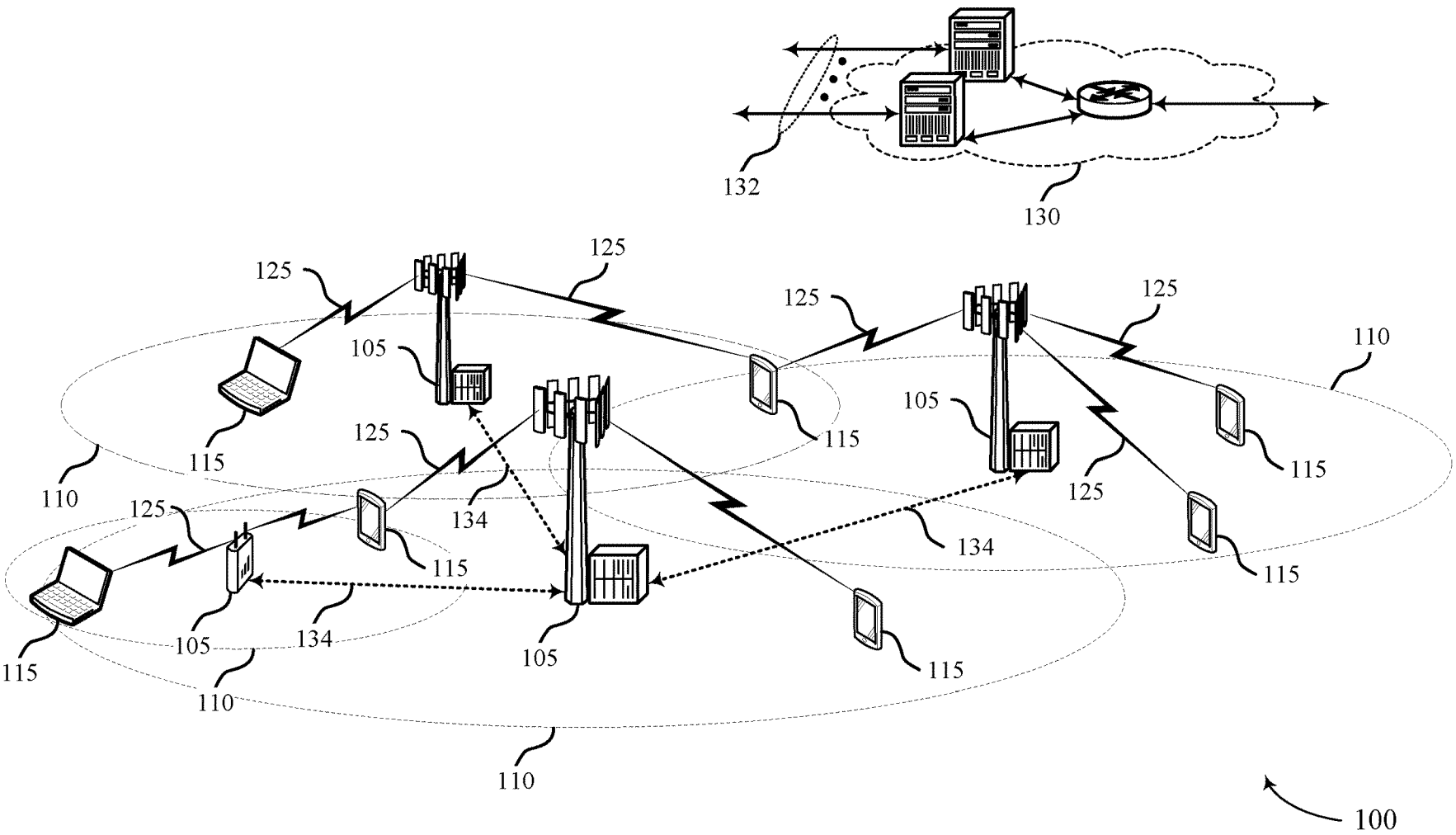
FIG. 1 illustrates an example of a system for wireless communication that supports multilayer bowtie antenna structures in accordance with aspects of the present disclosure.

FIG. 1 illustrates an example of a wireless communications system 100 in accordance with various aspects of the present disclosure. The wireless communications system 100 includes base stations 105, user equipment (UEs) 115, and a core network 130. In some examples, the wireless communications system 100 may be a Long Term Evolution (LTE) network, an LTE-Advanced (LTE-A) network, or a New Radio (NR) network. In some cases, wireless communications system 100 may support enhanced broadband communications, ultra-reliable (e.g., mission critical) communications, low latency communications, or communications with low-cost and low-complexity devices.

Base stations 105 may wirelessly communicate with UEs 115 via one or more base station antennas. Base stations 105 described herein may include or may be referred to by those skilled in the art as a base transceiver station, a radio base station, an access point, a radio transceiver, a NodeB, an eNodeB (eNB), a next-generation Node B or giga-nodeB (either of which may be referred to as a gNB), a Home NodeB, a Home eNodeB, or some other suitable terminology. Wireless communications system 100 may include base stations 105 of different types (e.g., macro or small cell base stations). The UEs 115 described herein may be able to communicate with various types of base stations 105 and network equipment including macro eNBs, small cell eNBs, gNBs, relay base stations, and the like.

Each base station 105 may be associated with a particular geographic coverage area 110 in which communications with various UEs 115 is supported. Each base station 105 may provide communication coverage for a respective geographic coverage area 110 via communication links 125, and communication links 125 between a base station 105 and a UE 115 may utilize one or more carriers. Communication links 125 shown in wireless communications system 100 may include uplink transmissions from a UE 115 to a base station 105, or downlink transmissions, from a base station 105 to a UE 115. Downlink transmissions may also be called forward link transmissions while uplink transmissions may also be called reverse link transmissions.

The geographic coverage area 110 for a base station 105 may be divided into sectors making up only a portion of the geographic coverage area 110, and each sector may be associated with a cell. For example, each base station 105 may provide communication coverage for a macro cell, a small cell, a hot spot, or other types of cells, or various combinations thereof. In some examples, a base station 105 may be movable and therefore provide communication coverage for a moving geographic coverage area 110. In some examples, different geographic coverage areas 110 associated with different technologies may overlap, and overlapping geographic coverage areas 110 associated with different technologies may be supported by the same base station 105 or by different base stations 105. The wireless communications system 100 may include, for example, a heterogeneous LTE/LTE-A or NR network in which different types of base stations 105 provide coverage for various geographic coverage areas 110.

The term "cell" refers to a logical communication entity used for communication with a base station 105 (e.g., over a carrier), and may be associated with an identifier for distinguishing neighboring cells (e.g., a physical cell identifier (PCID), a virtual cell identifier (VCID)) operating via the same or a different carrier. In some examples, a carrier may support multiple cells, and different cells may be configured according to different protocol types (e.g., machine-type communication (MTC), narrowband Internet-of-Things (NB-IoT), enhanced mobile broadband (eMBB), or others) that may provide access for different types of devices. In some cases, the term "cell" may refer to a portion of a geographic coverage area 110 (e.g., a sector) over which the logical entity operates.

UEs 115 may be dispersed throughout the wireless communications system 100, and each UE 115 may be stationary or mobile. A UE 115 may also be referred to as a mobile device, a wireless device, a remote device, a handheld device, or a subscriber device, or some other suitable terminology, where the "device" may also be referred to as a unit, a station, a terminal, or a client. A UE 115 may also be a personal electronic device such as a cellular phone, a personal digital assistant (PDA), a tablet computer, a laptop computer, or a personal computer. In some examples, a UE 115 may also refer to a wireless local loop (WLL) station, an Internet of Things (IoT) device, an Internet of Everything (IoE) device, or an MTC device, or the like, which may be implemented in various articles such as appliances, vehicles, meters, or the like.

Some UEs 115, such as MTC or IoT devices, may be low cost or low complexity devices, and may provide for automated communication between machines (e.g., via Machine-to-Machine (M2M) communication). M2M communication or MTC may refer to data communication technologies that allow devices to communicate with one another or a base station 105 without human intervention. In some examples, M2M communication or MTC may include communications from devices that integrate sensors or meters to measure or capture information and relay that information to a central server or application program that can make use of the information or present the information to humans interacting with the program or application. Some UEs 115 may be designed to collect information or enable automated behavior of machines. Examples of applications for MTC devices include smart metering, inventory monitoring, water level monitoring, equipment monitoring, healthcare monitoring, wildlife monitoring, weather and geological event monitoring, fleet management and tracking, remote security sensing, physical access control, and transaction-based business charging.

Some UEs 115 may be configured to employ operating modes that reduce power consumption, such as half-duplex communications (e.g., a mode that supports one-way communication via transmission or reception, but not transmission and reception simultaneously). In some examples half-duplex communications may be performed at a reduced peak rate. Other power conservation techniques for UEs 115 include entering a power saving "deep sleep" mode when not engaging in active communications, or operating over a limited bandwidth (e.g., according to narrowband communications). In some cases, UEs 115 may be designed to support critical functions (e.g., mission critical functions), and a wireless communications system 100 may be configured to provide ultra-reliable communications for these functions.

In some cases, a UE 115 may also be able to communicate directly with other UEs 115 (e.g., using a peer-to-peer (P2P) or device-to-device (D2D) protocol). One or more of a group of UEs 115 utilizing D2D communications may be within the geographic coverage area 110 of a base station 105. Other UEs 115 in such a group may be outside the geographic coverage area 110 of a base station 105, or be otherwise unable to receive transmissions from a base station 105. In some cases, groups of UEs 115 communicating via D2D communications may utilize a one-to-many (1:M) system in which each UE 115 transmits to every other UE 115 in the group. In some cases, a base station 105 facilitates the scheduling of resources for D2D communications. In other cases, D2D communications are carried out between UEs 115 without the involvement of a base station 105.

Base stations 105 may communicate with the core network 130 and with one another. For example, base stations 105 may interface with the core network 130 through backhaul links 132 (e.g., via an S1 or other interface). Base stations 105 may communicate with one another over backhaul links 134 (e.g., via an X2 or other interface) either directly (e.g., directly between base stations 105) or indirectly (e.g., via core network 130).

The core network 130 may provide user authentication, access authorization, tracking, Internet Protocol (IP) connectivity, and other access, routing, or mobility functions. The core network 130 may be an evolved packet core (EPC), which may include at least one mobility management entity (MME), at least one serving gateway (S-GW), and at least one Packet Data Network (PDN) gateway (P-GW). The MME may manage non-access stratum (e.g., control plane) functions such as mobility, authentication, and bearer management for UEs 115 served by base stations 105 associated with the EPC. User IP packets may be transferred through the S-GW, which itself may be connected to the P-GW. The P-GW may provide IP address allocation as well as other functions. The P-GW may be connected to the network operators IP services. The operators IP services may include access to the Internet, Intranet(s), an IP Multimedia Subsystem (IMS), or a Packet-Switched (PS) Streaming Service.

At least some of the network devices, such as a base station 105, may include subcomponents such as an access network entity, which may be an example of an access node controller (ANC). Each access network entity may communicate with UEs 115 through a number of other access network transmission entities, which may be referred to as a radio head, a smart radio head, or a transmission/reception point (TRP). In some configurations, various functions of each access network entity or base station 105 may be distributed across various network devices (e.g., radio heads and access network controllers) or consolidated into a single network device (e.g., a base station 105).

Wireless communications system 100 may operate using one or more frequency bands, typically in the range of 300 MHz to 300 GHz. Generally, the region from 300 MHz to 3 GHz is known as the ultra-high frequency (UHF) region or decimeter band, since the wavelengths range from approximately one decimeter to one meter in length. UHF waves may be blocked or redirected by buildings and environmental features. However, the waves may penetrate structures sufficiently for a macro cell to provide service to UEs 115 located indoors. Transmission of UHF waves may be associated with smaller antennas and shorter range (e.g., less than 100 km) compared to transmission using the smaller frequencies and longer waves of the high frequency (HF) or very high frequency (VHF) portion of the spectrum below 300 MHz.

Wireless communications system 100 may also operate in a super high frequency (SHF) region using frequency bands from 3 GHz to 30 GHz, also known as the centimeter band. The SHF region includes bands such as the 5 GHz industrial, scientific, and medical (ISM) bands, which may be used opportunistically by devices that can tolerate interference from other users.

Wireless communications system 100 may also operate in an extremely high frequency (EHF) region of the spectrum (e.g., from 30 GHz to 300 GHz), also known as the millimeter band. In some examples, wireless communications system 100 may support millimeter wave (mmW) communications between UEs 115 and base stations 105, and EHF antennas of the respective devices may be even smaller and more closely spaced than UHF antennas. In some cases, this may facilitate use of antenna arrays within a UE 115. However, the propagation of EHF transmissions may be subject to even greater atmospheric attenuation and shorter range than SHF or UHF transmissions. Techniques disclosed herein may be employed across transmissions that use one or more different frequency regions, and designated use of bands across these frequency regions may differ by country or regulating body.

In some cases, wireless communications system 100 may utilize both licensed and unlicensed radio frequency spectrum bands. For example, wireless communications system 100 may employ License Assisted Access (LAA), LTE-Unlicensed (LTE-U) radio access technology, or NR technology in an unlicensed band such as the 5 GHz ISM band. When operating in unlicensed radio frequency spectrum bands, wireless devices such as base stations 105 and UEs 115 may employ listen-before-talk (LBT) procedures to ensure a frequency channel is clear before transmitting data. In some cases, operations in unlicensed bands may be based on a CA configuration in conjunction with CCs operating in a licensed band (e.g., LAA). Operations in unlicensed spectrum may include downlink transmissions, uplink transmissions, peer-to-peer transmissions, or a combination of these. Duplexing in unlicensed spectrum may be based on frequency division duplexing (FDD), time division duplexing (TDD), or a combination of both.

In some embodiments of the wireless communications system 100, the base stations 105 and/or the UEs 115 may include antenna structures designed to operate in a wide range of frequencies, e.g., between 26 GHz and 43 GHz. Various examples of such antenna structures are described further below.

Figure 2A:
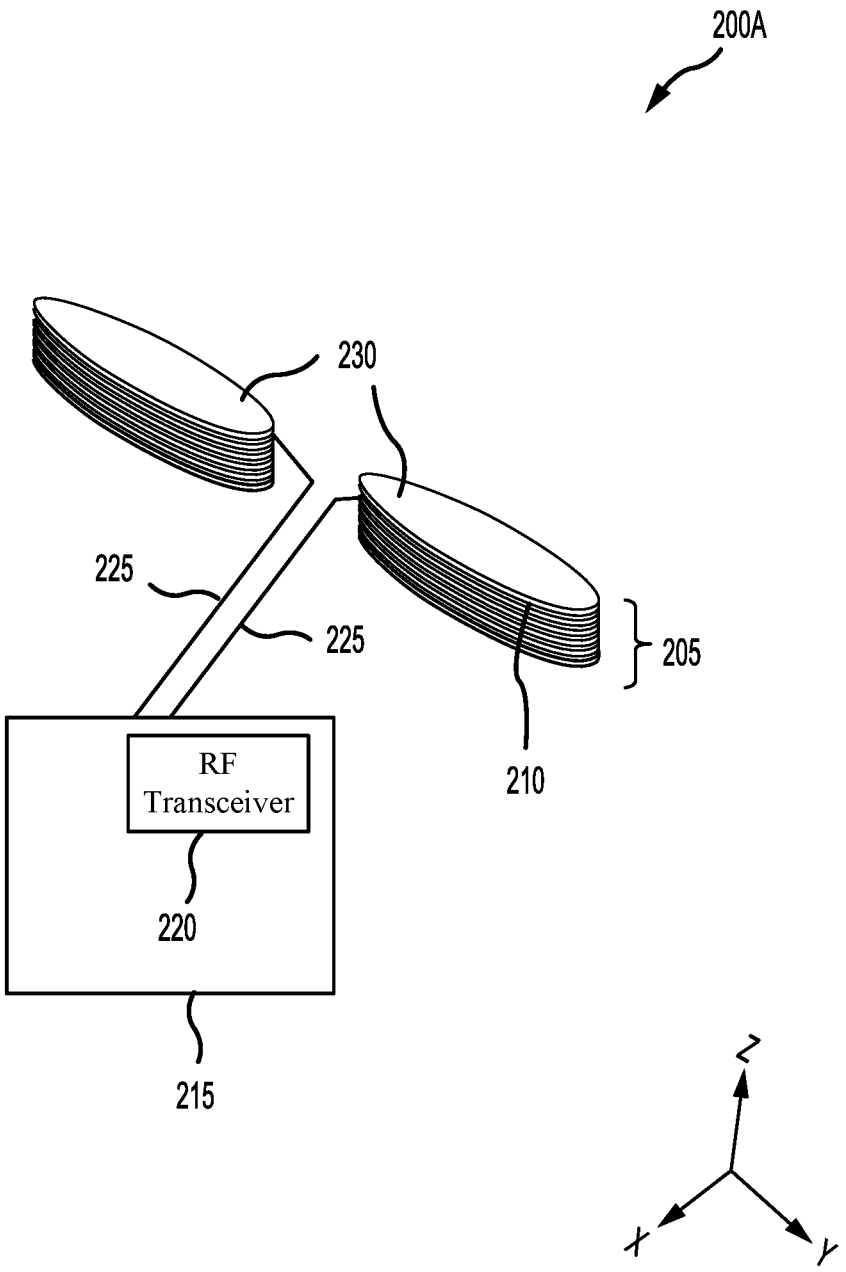
FIG. 2A illustrates a perspective view of an example of a portion of a multilayer bowtie antenna structure in accordance with aspects of the present disclosure.

FIG. 2A illustrates a perspective view of an example of a portion of a multilayer bowtie antenna structure 200A in accordance with various aspects of the present disclosure. In some examples, the multilayer bowtie antenna structure 200A may be implemented in various components of wireless communications system 100, e.g., in base stations 105 and/or UEs 115.

Figure 19:
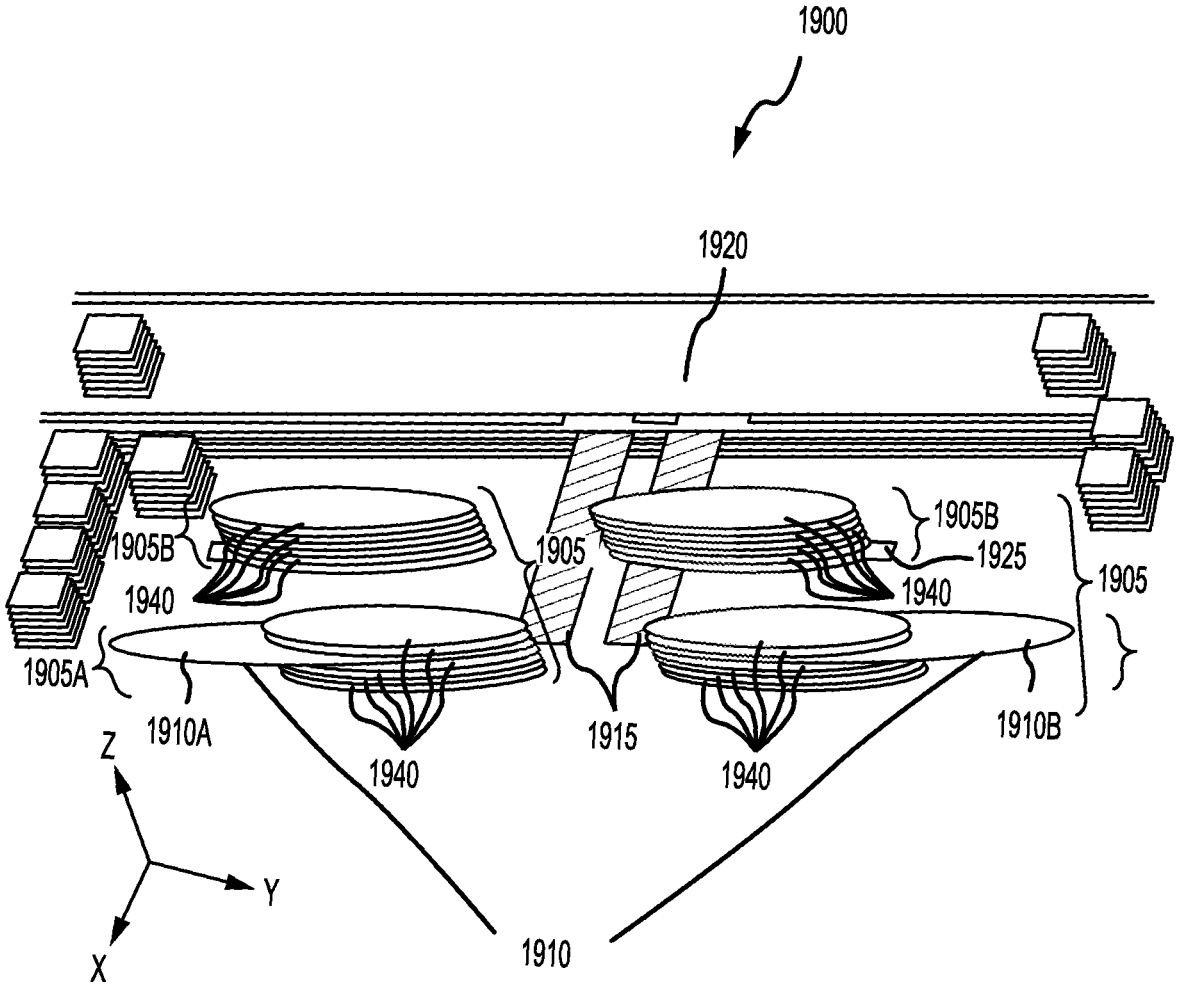
FIG. 19 illustrates a perspective view of an example of a multilayer bowtie antenna structure in accordance with aspects of the present disclosure.

The multilayer bowtie antenna structure 200A may include a stack 205 of bowtie antennas including a first bowtie antenna 210 electrically coupled to a chipset 215 including, an RF transceiver 220 via conductive connections 225 for providing signals (e.g., power) to the first bowtie antenna 210. Conductive connections 225 may be any conductive connections (e.g., transmission lines, feed lines, etc.) used for exciting antenna elements. The first bowtie antenna 210 and the plurality of additional bowtie antennas are spaced apart in a first direction (e.g., a vertical direction or a direction along z-axis) and form the stack 205 of bowtie antennas stacked in the first direction. Each bowtie antenna in the stack 205 may be coupled to one or more adjacent bowtie antennas of the stack 205 via connections (not shown), for example, dielectric connections, vias, or micro vias. In an example, each bowtie antenna in the stack 205 may be configured as dipole antenna. The first bowtie antenna 210 and the plurality of additional bowtie antennas each may include a pair of antenna elements 230 that may be elliptical, non-elliptical (e.g., triangular, etc.) in shape, or in any combination thereof. The first bowtie antenna 210 and each of the plurality of additional bowtie antennas may be of the same shape (e.g., elliptical shape) as shown in FIG. 2A, or of different shapes as shown in FIG. 19 (discussed further in detail later). In some cases, at least some of the plurality of additional bowtie antennas may have different dimensions. For example, each bowtie antenna in each layer may be successively larger or smaller than an adjacent bowtie antenna in the stack 205 of bowtie antennas. The shapes and dimensions of antenna elements 230 may depend on available space within a device (e.g., a cellular phone) in which the multilayer bowtie antenna structure 200A is to be placed. In FIG. 2A, a ratio between the length and the width of the ellipses 230 may be 5:1 for an improved beam performance. However, the ratio between the length and the width of the ellipses 230 may be greater or smaller than 5:1, e.g., 4:1, 3:1, etc., depending on e.g., storage space available for the multilayer bowtie antenna structure 200A within a device (e.g., a cell phone).

The first bowtie antenna 210 is electrically coupled to the conductive connections 225, which are configured to provide a signal (e.g., power, etc.) to the first bowtie antenna 210 for excitation from the chipset 215 including, e.g., RF transceiver 220, power management integrated circuit (PMIC), or processor. The chipset 215 may be electrically coupled to a printed circuit board (not shown). The first bowtie antenna 210 may receive the signal via the conductive connections 225, become excited by the signal, and radiate at a first frequency towards a desired beam direction for example. The exited area of the first bowtie antenna 210 may be replicated or cloned by the plurality of additional bowtie antennas of the stack 205. The additional bowtie antennas may be parasitic since they are not excited directly by the signal via the transmission lines, but rather indirectly excited via the excited first bowtie antenna. Each of the additional bowtie antennas may radiate at a different frequency from each other and the first bowtie antenna 210. Thus, the stack 205 of bowtie antennas may cover a wider high frequency bandwidth (e.g., 28 to 39 GHz) than a frequency bandwidth that the first bowtie antenna 210 alone can cover. For example, a bandwidth in which an antenna operates may be proportional to a physical size of the antenna itself. As such, stacking the plurality of additional bowtie antennas to the first bowtie antenna 210 may increase the physical size (e.g., height) of the multilayer bowtie antenna structure 200A, thereby increasing the bandwidth of the multilayer bowtie antenna structure 200A. In some examples, the plurality of additional bowtie antennas may add additional resonance in the high frequencies (e.g., 39 GHz), thereby covering a higher frequency band in which, e.g., a 5G network operates.

In some cases, an array of stacks 205 of bowtie antennas may be provided to increase a coverage distance or directivity in order to, e.g., connect the device with a base station 105 located at a distance that one stack 205 of bowtie antennas may not be able to reach. Directivity may be an ability of an antenna device (e.g., the multilayer bowtie antenna structure 200A) to direct energy in a particular direction when transmitting or receiving. In some cases, one or more stacks of elliptical bowtie antennas may be positioned adjacent to the stack 205 of bowtie antennas in a second direction perpendicular to the first direction, where electrically conductive ellipses in each stack extend in the second direction. Each stack 205 may be electrically coupled to the chipset 215 via conductive connections 225. These examples are provided for the sake of explanation and are not limiting of scope. Various modifications to the disclosure will be readily apparent to those skilled in the art.

Figure 2B:
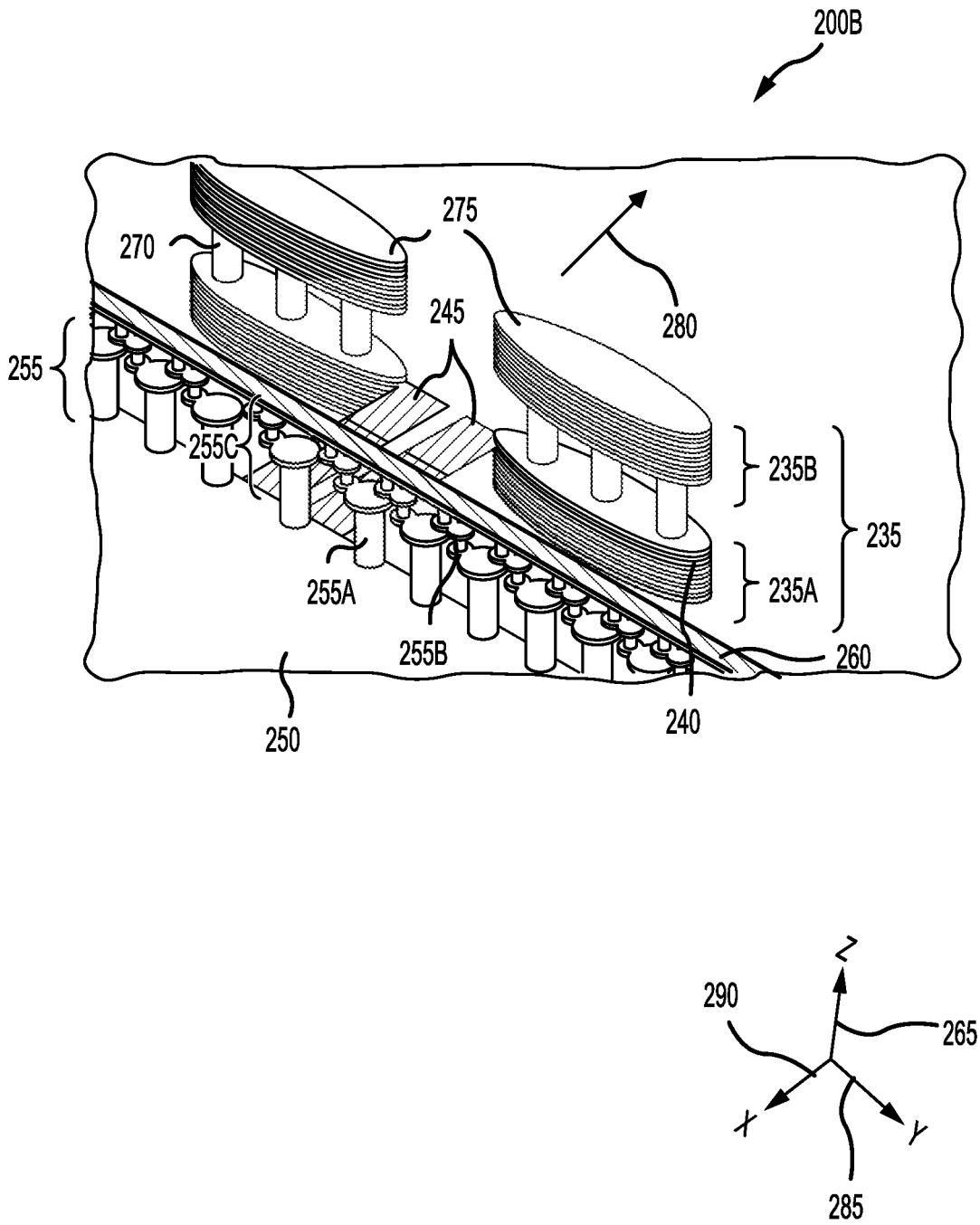
FIG. 2B illustrates a perspective view of an example of a portion of a multilayer bowtie antenna structure in accordance with aspects of the present disclosure.

FIG. 2B illustrates a perspective view of an example of a portion of a multilayer bowtie antenna structure 200B in accordance with various aspects of the present disclosure. In some examples, the multilayer bowtie antenna structure 200B may be implemented in various components of wireless communications system 100, e.g., in base stations 105 and/or UEs 115. In some examples, the multilayer bowtie antenna structure 200B may include a plurality of the multilayer bowtie antenna structure 200A, each stack 205 of the multilayer bowtie antenna structure 200A forming a stack of bowtie antennas as discussed in detail below.

The multilayer bowtie antenna structure 200B may include a stack 235 of bowtie antennas including a first bowtie antenna 240 electrically coupled to transmission lines 245 for excitation, a ground plate 250 (e.g., or ground plate) electrically coupled to the transmission lines 245, a conductive wall 255 electrically coupled to the ground plate 250 for reflecting signals radiated from the stack 235, and a conductive bar 260 for providing additional reflection for the stack 205. It is to be understood that these examples are provided for the sake of explanation and are not limiting in scope. For example, the multilayer bowtie antenna structure 200B may include conductive connections, other than transmission lines 245, for exciting the first bowtie antenna 240. The stack 235 of bowtie antennas may include a first set 235A and a second set 235B of bowtie antennas, each set including a plurality of additional bowtie antennas.

As one illustrative example, in FIG. 2B, the first set 235A includes 5 additional bowtie antennas in addition to the first bowtie antenna 240, and the second set 235B includes 6 additional bowtie antennas. The first bowtie antenna 240 and the plurality of additional antennas are spaced apart in a first direction (e.g., a vertical direction or a direction along z-axis 265) and form the stack 235 of bowtie antennas stacked in the first direction. Each bowtie antenna in the stack 235 may be coupled to one or more adjacent bowtie antennas of the stack 235 via connections 270 (e.g., dielectric connections, vias, or micro vias). In an example, each bowtie antenna in the stack 235 may be configured as dipole antenna. The connections 270 may have differing dimensions (e.g., height, width, etc.), depending on vertical distances between the adjacent bowtie antennas to be coupled. For example, the connections 270 coupling the first set 235A and the second set 235B may be larger than vias (not shown) coupling adjacent bowtie antennas within either the first set 235A or the second set 235B because a space between the first set 235A and the second set 235B is larger than spaces between adjacent bowtie antennas within either the first set 235A or the second set 235B. The first bowtie antenna 240 and the plurality of additional bowtie antennas each may include a pair of antenna elements 275 that may be elliptical, non-elliptical (e.g., triangular, etc.) in shape, or in any combination thereof. The first bowtie antenna 240 and each of the plurality of additional bowtie antennas may be of the same shape (e.g., elliptical shape) as shown in FIG. 2B, or of different shapes as shown in FIG. 19 (discussed further in detail later). In some cases, at least some of the additional bowtie antennas may have different dimensions (e.g., each bowtie antenna at each layer of the stack 235 may be successively larger or smaller than an adjacent bowtie antenna of the stack 235). The shapes and dimensions of antenna elements 275 may depend on available space within a device (e.g., a cellular phone) in which the multilayer bowtie antenna structure 200B is to be placed. In FIG. 2B, a ratio between the length and the width of the ellipses 275 may be a 5:1 for an improved beam performance. However, the ratio between the length and the width of the ellipses 275 may be greater or smaller than 5:1, e.g., 4:1, 3:1, etc., depending on e.g., storage space available for the multilayer bowtie antenna structure 200B within a device (e.g., a cell phone). In some examples, the multilayer bowtie antenna structure 200B may be arranged within a device (e.g., a UE 115 (e.g., a cellular phone, etc.)) so as to accommodate available space within the UE 115 for the multilayer bowtie antenna structure. For example, a UE 115 may include one or more multilayer bowtie antenna structures at one or more edges of the UE 115 (e.g., the UE 115-*a* as shown in FIG. 3B (discussed further in detail later).

The first bowtie antenna 240 is electrically coupled to the transmission lines 245, which are configured to provide a signal (e.g., power, etc.) to the first bowtie antenna 240 for excitation from, e.g., a chipset (not shown) including, e.g., RF transceiver, power management integrated circuit (PMIC), or processor. The chipset may be electrically coupled to the ground plate 250 on the bottom surface of the ground plate 250. The first bowtie antenna 240 may receive the signal via the transmission lines 245, become excited by the signal, and radiate at a first frequency towards a desired beam direction for example. The exited area of the first bowtie antenna 240 may be replicated or cloned by the plurality of additional bowtie antennas of the stack 235. Each of the additional bowtie antennas may radiate at a different frequency from each other and the first bowtie antenna 240. Thus, the stack 235 of bowtie antennas may cover a wider frequency bandwidth (e.g., 24 to 43 GHz) than a frequency bandwidth that the first bowtie antenna 240 alone can cover. In some cases, an array of stacks 235 of bowtie antennas may be provided to increase a coverage distance in order to, e.g., connect the device with a base station 105 located at a distance that one stack 235 of bowtie antennas may not be able to reach. In some cases, one or more stacks of elliptical bowtie antennas may be positioned adjacent to the stack 235 of bowtie antennas in a second direction perpendicular to the first direction, where electrically conductive ellipses in each stack extend in the second direction. Each stack 235 may be electrically coupled to the ground plate 250 via transmission lines 245.

The conductive wall 255 may provide a reflective area, which may be used to reflect radiations from the stack 235 of bowtie antennas towards a desired direction (e.g., a uni-direction 280). The conductive wall 255 may be electrically coupled to the ground plate 250, and may extend in a second direction (e.g., a direction along y-axis 285), thereby forming a vertical plane (e.g., y-z plane) along the conductive wall 255. In some cases, the conductive wall 255 may extend in the first direction into a plane formed by the stack 235 of bowtie antennas. The conductive wall 255 may include a plurality of electrical connections (e.g., vias 255A, micro vias 255B, etc.) having varying dimensions. Each via 255A may be coupled to adjacent micro vias 255B in a staggered fashion. For example, a via 255A may extend vertically in the first direction at a first point on the ground plate 250, and a micro via 255B may extend vertically in the first direction at a second point spaced apart from the first point in the second direction 285. Since the via 255A and micro via 255B extend vertically at different points with respect to the ground plate 250, they form a staggered wall 255C. FIG. 2B shows the conductive wall 255 including a plurality of staggered walls 255C extending in the second direction 285. The conductive wall 255 including a plurality of staggered walls 255C may form a larger reflective area on the y-z plane than a conductive wall including a plurality of straight walls. Further, the conductive wall 255 may include micro vias (not shown) staggered within or under the ground plate 250, and thus, the staggered walls 255C are grounded, providing an even larger reflective area for the stack 235. Also, the height of the staggered wall 255C (including the grounded micro vias) may be equal to or greater than a height of the stack 235 of bowtie antennas. Thus, the conductive wall 255 may provide sufficient height that reflects most of the radiations from the stack 235 towards the uni-direction 280. In addition, the conductive wall 255 may be positioned at a quarter wavelength (based on a target frequency) apart from the stack 235 of bowtie antennas in a third direction (e.g., a direction along x-axis 290) in order to operate at the target frequency. For example, if the target frequency includes 39 GHz, the conductive wall 255 should be positioned at a quarter wavelength based on the 39 GHz so as to effectively operate at that frequency. In some cases, additional reflecting components such as the conductive bar 260 may be added to further increase the reflective area for the stack 235 of bowties antennas. The conductive bar 260 may be connected to the conductive wall 255, and also extend in the second direction 285 parallel to the major-axis of an ellipse 275 of bowtie antennas.

Figure 3A:
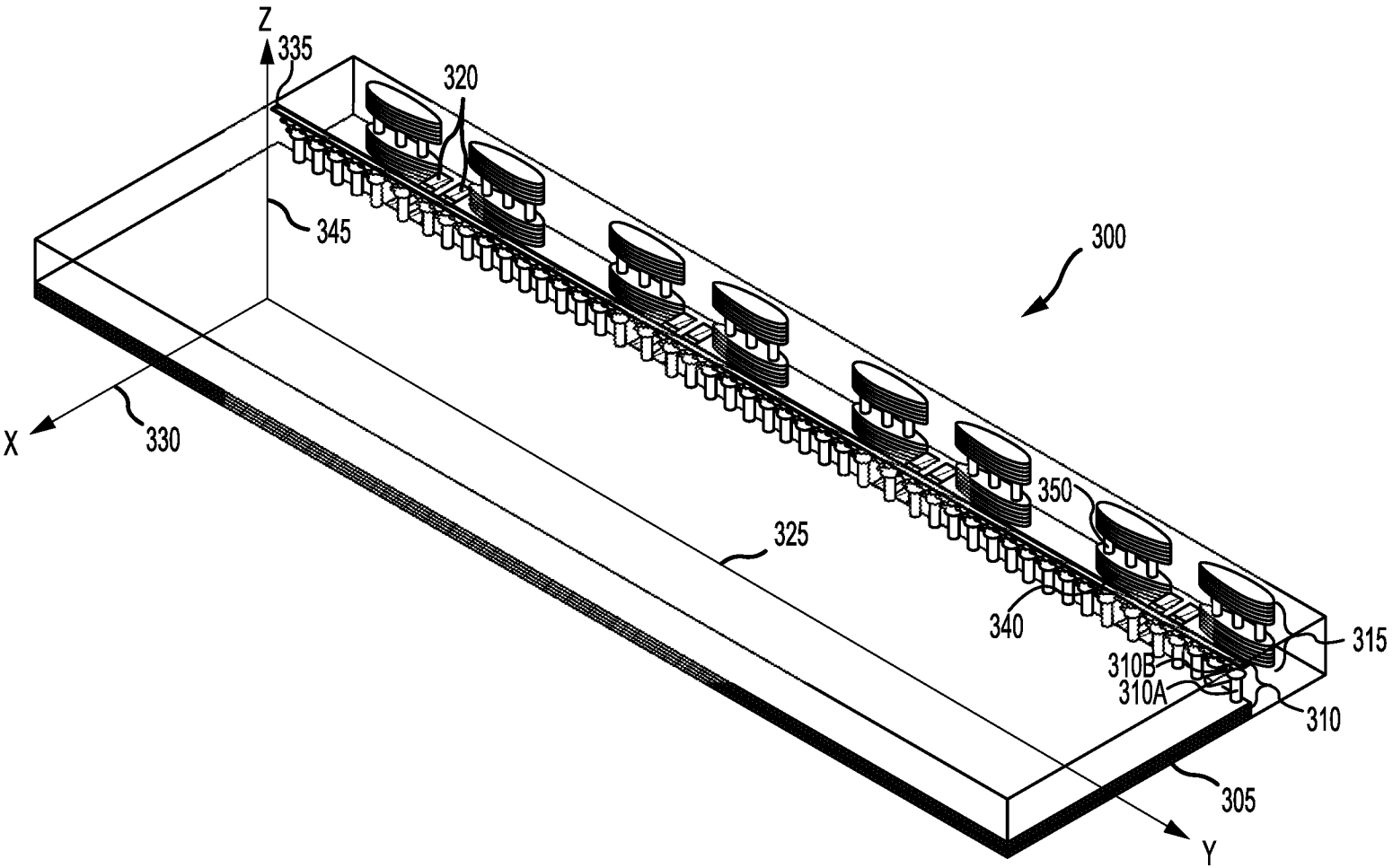
FIG. 3A illustrates a perspective view of an example of a multilayer bowtie antenna structure in accordance with aspects of the present disclosure.
Figure 3B:
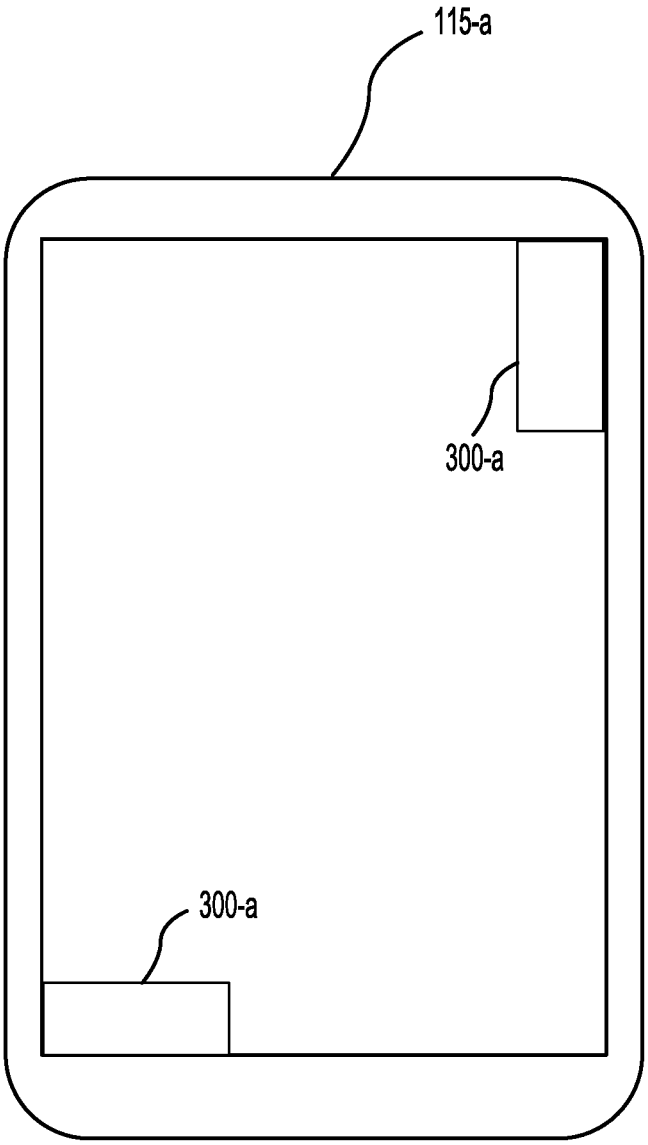
FIG. 3B illustrates an example of an architecture for a wireless device in accordance with aspects of the present disclosure.

FIG. 3A illustrates a perspective view of an example of a multilayer bowtie antenna structure 300 in accordance with various aspects of the present disclosure. In some examples, the multilayer bowtie antenna structure 300 may be implemented in various components of wireless communications system 100, e.g., in base stations 105 and/or UEs 115.

The multilayer bowtie antenna structure 300 includes a ground plate 305, a conductive wall 310, an array of bowtie antenna stacks 315, and transmission lines 320. In some examples, the multilayer bowtie antenna structure 300 may be an example of aspects of the multilayer bowtie antenna structure 200 as described herein with reference to FIG. 2. In some examples, each bowtie antenna in the array of bowtie antenna stacks 315 may be configured as dipole antenna.

The ground plate 305 may be provided to ground components of the multilayer bowtie antenna structure 300 that are not physically coupled to the antenna components, e.g., bowtie antenna stacks 315. For example, the ground plate 305 may be coupled to the conductive wall 310, or the transmission lines 320.

The conductive wall 310 may include a plurality of electrical connectors of varying sizes, e.g., a plurality of vias 310A and/or micro-vias 310B. The conductive wall 310 may extend in a first direction along a first axis (e.g., y-axis) 325. The electrical connectors 310A and 310B may be staggered, i.e., displaced with respect to the first direction. The conductive wall 310 may be located about a quarter of wavelength (based on a target frequency) apart from bowtie antenna stacks 315 in a second direction along the second axis (e.g., x-axis) 325 that is perpendicular to the first direction. The term "about," as used herein, refers to an amount within 10% of the relevant amount. In some examples, a distance between two electrical connectors in the first direction may be less than the wavelength of the frequency of operation (e.g., the wavelength corresponding to the target frequency or the lowest operation frequency). For example, the distance may be less than the wavelength corresponding to about 26 GHz. The conductive wall 310 may be made of copper or another highly conductive metal such as aluminum. In some cases, the multilayer bowtie antenna structure 300 may include additional reflecting component (e.g., a conductive bar 335).

Each bowtie antenna stack 315 may include a first bowtie antenna 340 disposed in a first plane. In some examples, the first plane may be defined by the first axis 325 and a second axis 330. The first plane may also include a plurality of other first bowtie antennas for the other bowtie antennas stacks in the array. The first bowtie antenna 340 may be, for example, an elliptical bowtie antenna in which a width of each ellipse may be five times the height of the ellipse. In some other examples, the first bowtie antenna 340 may be a triangular bowtie antenna. The bowtie antenna component may be conductive elements, e.g., conductive ellipses or conductive triangles. The first bowtie antenna 340 may be coupled to a power source, e.g., via one or more patch antennas.

Each bowtie antenna stack 315 may also include a plurality of additional bowtie antennas. Each of the plurality of additional bowtie antennas may be disposed on a different plane parallel to the first plane. The plurality of additional bowtie antennas may be disposed in the different planes so as to form a stack in a third direction (e.g., a direction along z-axis 345) perpendicular to the first plane. In some examples, the third direction 345 may be a vertical direction. Each of the additional bowtie antennas may have the same dimensions as the first bowtie antenna, e.g., the additional bowtie antennas may be elliptical bowtie antennas when the first bowtie antenna is an elliptical bowtie antenna. In some cases, at least one of the additional bowtie antennas may have different dimensions. For example, each bowtie antenna in each layer may be successively larger or smaller than an adjacent bowtie antenna in the stack 315 of bowtie antennas.

In some examples, the first bowtie antenna 340 may be coupled to the plurality of additional bowtie antennas through a plurality of connectors 350 such as dielectric connectors, vias or micro-vias. In some examples, the vias or micro-vias may be staggered, e.g., displaced relative to the first direction along the first axis 325. By using such electrical connectors, the additional bowtie antennas may be excited when the power source is used to excite the first bowtie antenna. In some other examples, the first bowtie antenna 340 may not be coupled to the plurality of additional bowtie antennas through connectors 350, and instead the additional bowtie antennas may be capacitively excited when the power source is used to excite the first bowtie antenna (e.g., at least some of the plurality of additional bowtie antennas may be parasitic antennas).

The multilayer bowtie antenna structure 300 may be operable in a wide frequency range, e.g., between about 26 GHz and about 43.5 GHz, between about 28 GHz and about 39 GHz, or between about 26 GHz and about 30 GHz and between about 37 GHz and about 40 GHz. In some examples, an antenna may be considered operable in a particular frequency range when the return loss (reflection coefficient) of the antenna is less than −6 dB throughout the range. In some other examples, the multilayer bowtie antenna structure 300 may have a return loss of less than −10 dB throughout one or more of these ranges.

FIG. 3B illustrates an example of an architecture for a wireless device (e.g., a UE 115-*a*) in accordance with aspects of the present disclosure. A similar architecture may be used in a base station such as base station 105 described with reference to FIG. 1. In FIG. 3B the UE 115-*a* is illustrated as a cellular phone, however, it is to be understood that the UE 115-*a* may have various configurations and may be included or be part of a personal computer (e.g., a laptop computer, netbook computer, tablet computer, etc.), a PDA, a digital video recorder (DVR), an internet appliance, a gaming console, an e-reader, etc. The UE 115-*a* may be an example of various aspects of the UEs 115 described with reference to FIG. 1. The UE 115-*a* may implement at least some of the features and functions described with reference to FIGS. 1, 2A, 2B, 3A, 4A-E, 5, 6, 8, 10A-B, 11, 12, and 19 (discussed further in detail later). The UE 115-*a* may communicate with a base station 105 described with reference to FIG. 1.

As in the example of FIG. 3B, the UE 115-*a* may include one or more multilayer bowtie antenna structure 300-*a* within the UE 115-*a*. In some examples, the multilayer bowtie antenna structure 300-*a* may be an example of aspects of multilayer bowtie antenna structure 300 described herein with reference to FIG. 3A. In FIG. 3B, the UE 115-*a* includes two multilayer bowtie antenna structures 300-*a* arranged at two edges of the UE 115-*a*. However, the configuration shown in FIG. 3B is for illustrative purposes only, and thus, locations and a number of the multilayer bowtie antenna structure 300-*a* that may be included within the UE 115-*a* may vary depending on, e.g., the available space within the UE 115-*a*. For example, the UE 115-*a* may include more than one multilayer bowtie antenna structure 300-*a* on one edge. In another example, the UE 115-*a* may include two multilayer bowtie antenna structures 300-*a* arranged on two edges that form a corner of the UE 115-*a*.

Figure 4A:
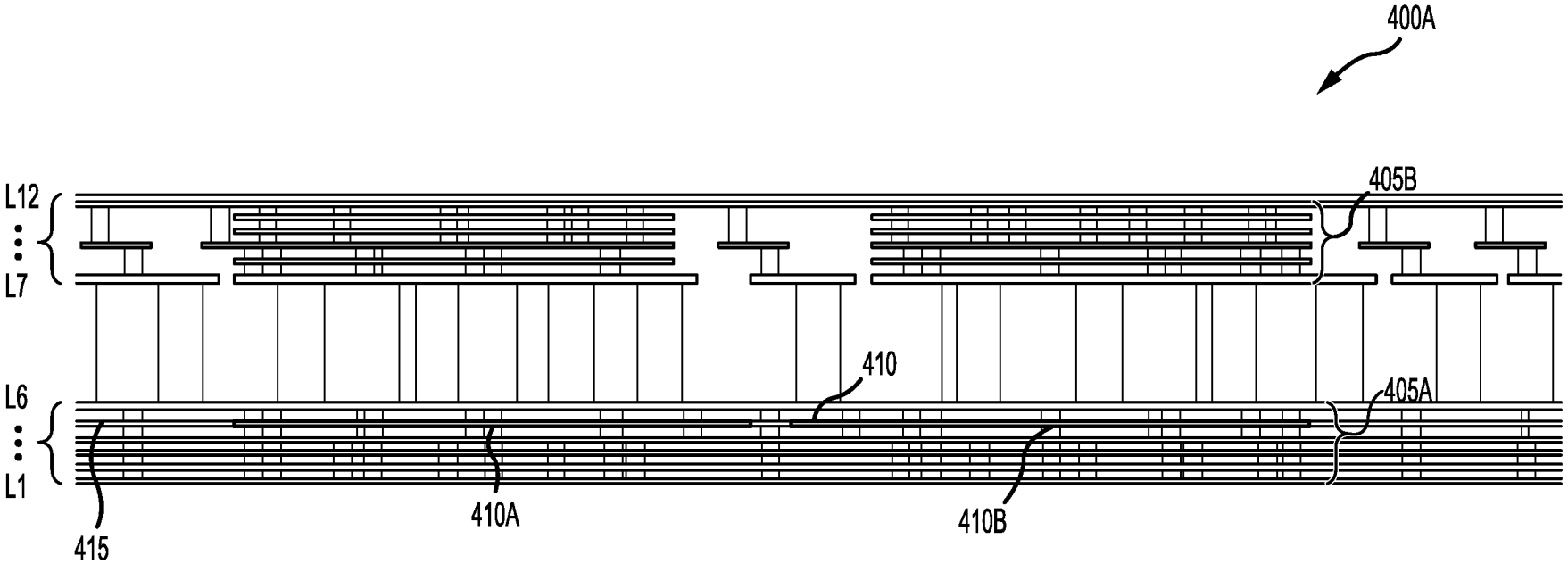
FIG. 4A illustrates a side view of an example of a bowtie antenna stack in accordance with aspects of the present disclosure.

FIG. 4A illustrates a side view of an example of a bowtie antenna stack 400A in accordance with various aspects of the present disclosure. The bowtie antenna stack 400A may be an example of aspects of the stacks 315 of bowtie antenna described with reference to FIG. 3A.

The bowtie antenna stack 400A may include a first set of bowtie antennas 405A and a second set of bowtie antennas 405B. In some examples, the first set of bowtie antennas 405A may include a number of layers, e.g., six layers L1 to L6. In some examples, the second set of bowtie antennas 405B may include a number of layers, e.g., six layers L7 to L12.

The bowtie antenna stack 400A may include a first bowtie antenna 410, which may, for example, an elliptical bowtie antenna or a triangular bowtie antenna. The first bowtie antenna 410 may include a first antenna portion 410A (e.g., a first ellipse or first triangle) and a second antenna portion 410B (e.g., a second ellipse or a second triangle). The first bowtie antenna 410 may be coupled to a power source (not shown). The power source may be activated to excite the first bowtie antenna 410 via, e.g., transmission lines 320 as described herein with reference to FIG. 3A. The first bowtie antenna 410 may be disposed on a first layer, e.g., layer L5 415 in the first set of bowtie antennas. The layer L5 415 may be aligned with a first plane, e.g., a horizontal plane.

Figure 4B:
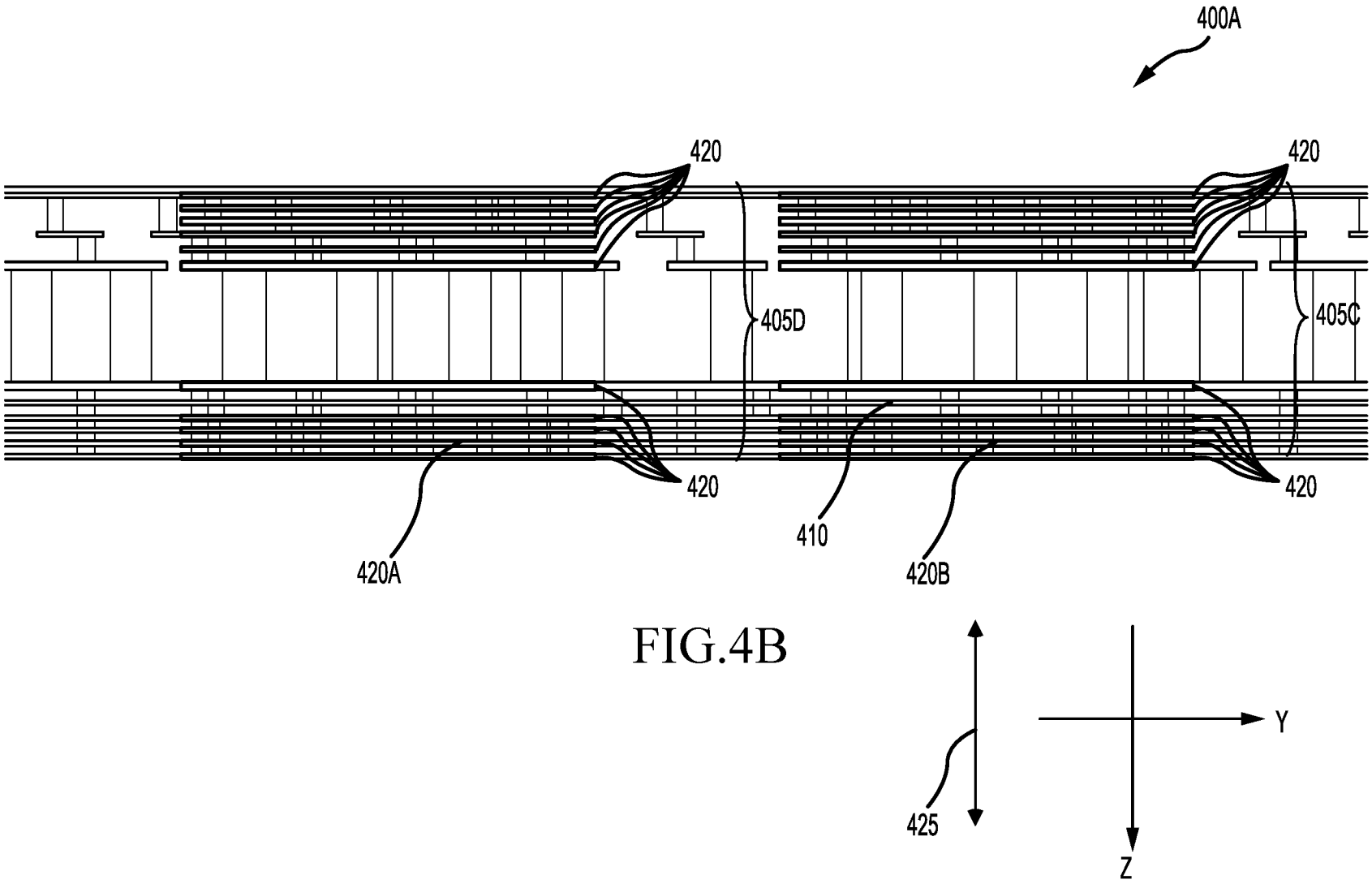
FIG. 4B illustrates a side view of an example of a bowtie antenna stack in accordance with aspects of the present disclosure.

FIG. 4B illustrates a side view of an example of the bowtie antenna stack 400A in accordance with various aspects of the present disclosure. The bowtie antenna stack 400A may be an example of aspects of the stacks 315 of bowtie antenna described with reference to FIG. 3A.

The bowtie antenna stack 400A may include a plurality of additional bowtie antennas 420 in the third set of bowtie antennas 405C and the fourth set of bowtie antennas 405D. Each of the additional bowtie antennas 420 may be, for example, an elliptical bowtie antenna or a triangular bowtie antenna. In some examples, each of the additional bowtie antennas 420 may have the same shape as the first bowtie antenna 410. Each of the additional bowtie antennas 420 may have a first antenna portion 420A (e.g., a first ellipse or a first triangle) and a second antenna portion 420B (e.g., a second ellipse or a second triangle).

The additional bowtie antennas 420 may be disposed on layers other than the layer L5 on which the first bowtie antenna 410 is disposed. For example, each of the additional bowtie antennas 420 may be disposed on different planes parallel to the plane on which the first bowtie antenna 410 is disposed. In some examples, the additional bowtie antennas 420 may be disposed in layers L1 through L4 and layers L6 through L12. The first bowtie antenna 410 and the additional bowtie antennas 420 may be stacked in a first direction (e.g., a direction along z-axis) 425 perpendicular to the first plane to form the bowtie antenna stack 400A. The additional bowtie antennas 420 may not be directly coupled to the power source although, as discussed below, the additional bowtie antennas 420 may be indirectly coupled to the power source through the first bowtie antenna 410.

Figure 4C:
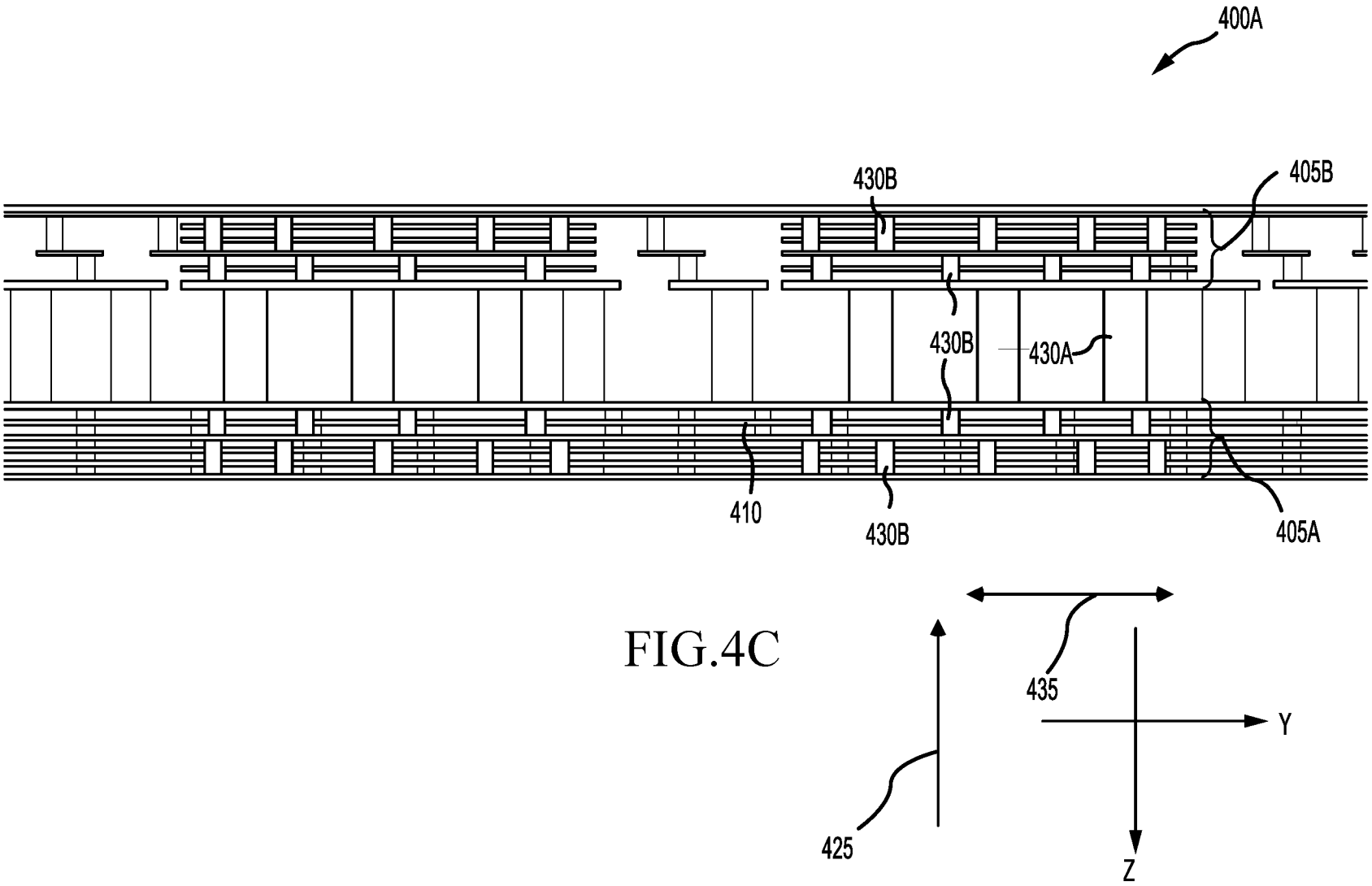
FIG. 4C illustrates a side view of an example of a bowtie antenna stack in accordance with aspects of the present disclosure.

FIG. 4C illustrates a side view of an example of the bowtie antenna stack 400A in accordance with various aspects of the present disclosure. The bowtie antenna stack 400A may be an example of aspects of the stacks 315 of bowtie antenna described with reference to FIG. 3A.

The bowtie antenna stack 400A may include a plurality of connectors 430 including a first plurality of connectors 430A coupling the first set of bowtie antennas (e.g., a bottom set) 405A to the second set of bowtie antennas (e.g., a top set) 405B. The plurality of connectors 430 may include a second plurality of connectors 430B coupling the bowtie antennas within the first set of bowtie antennas 405A and the second set of bowtie antennas 405B. The first plurality of connectors 430A and the second plurality of connectors 430B may include vias or micro-vias. In some examples, the plurality of connectors 430 may be staggered, i.e., at least some of the electrical connectors may be displaced in a second direction (e.g., a direction along y-axis) 435 perpendicular to the first direction 425 (e.g., a horizontal direction) relative to connectors on between different levels. For example, a first set of connectors 430 are displaced in the second direction 435 relative to a second set of connectors 430B.

Figure 4D:
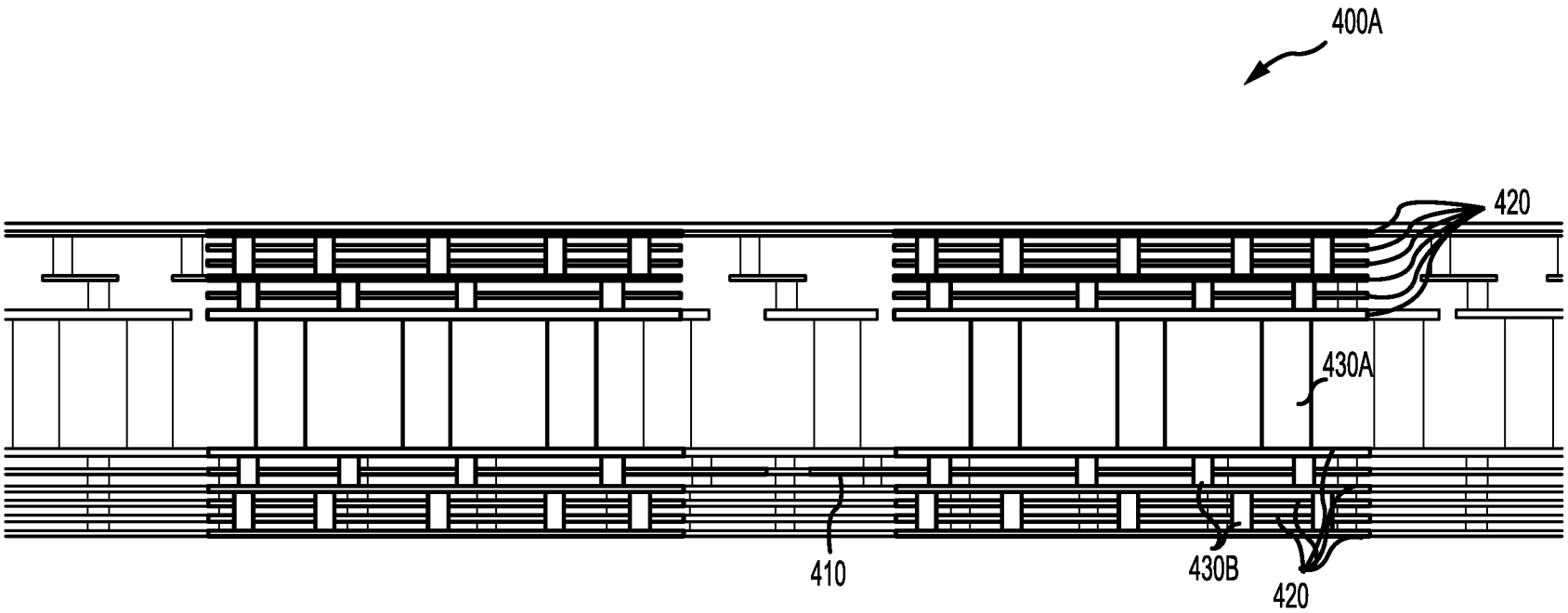
FIG. 4D illustrates a side view of an example of a bowtie antenna stack in accordance with aspects of the present disclosure.
Figure 4E:
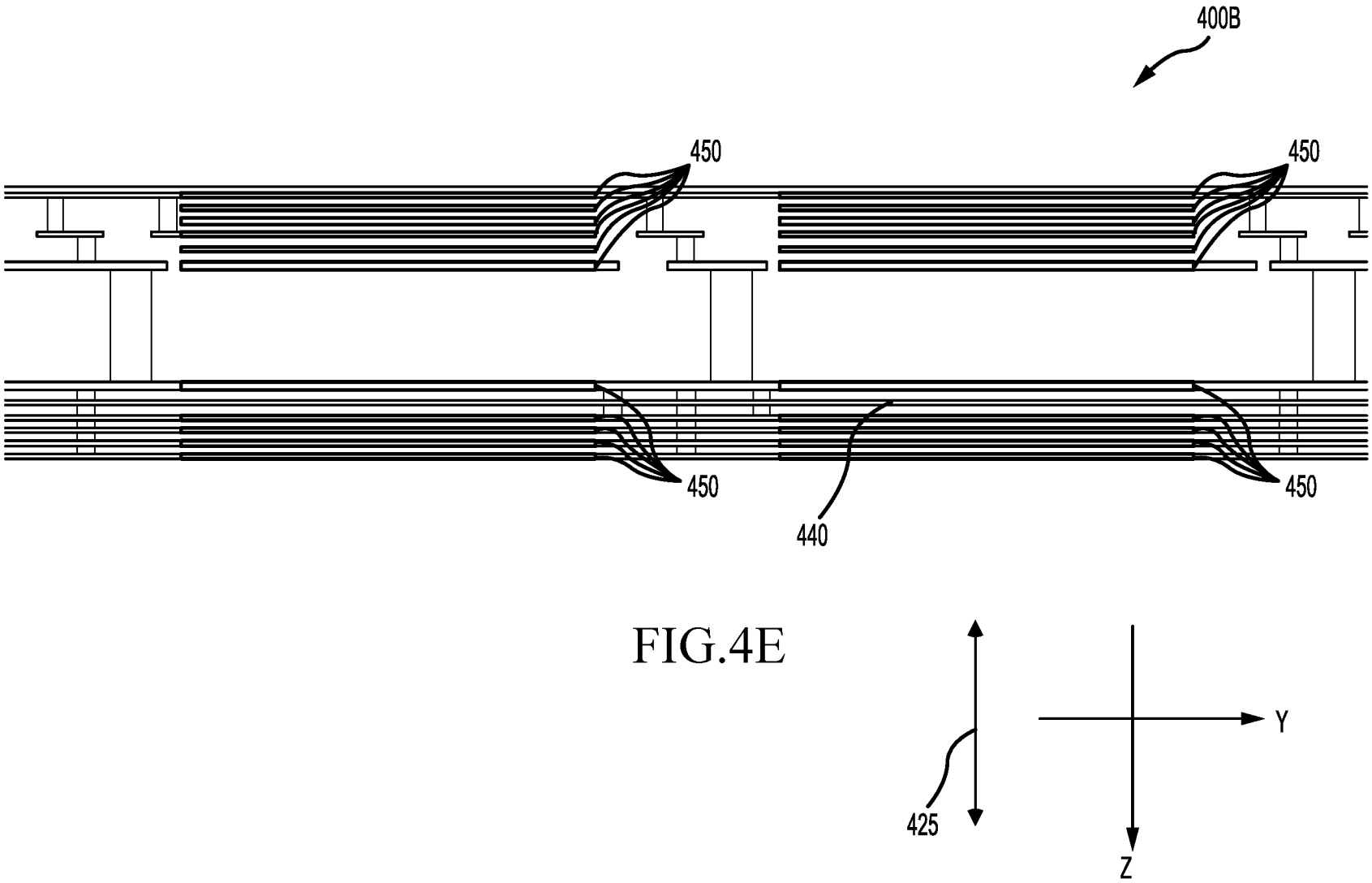
FIG. 4E illustrates a side view of an example of a bowtie antenna stack in accordance with aspects of the present disclosure.

In some examples (e.g., the bowtie antenna stack 400B as described herein with reference to FIG. 4E), the additional bowtie antennas 420 may be capacitively coupled to the first bowtie antenna 410 rather than being connected to the first bowtie antenna 410. In such examples, the first plurality of connectors 430A and the second plurality of connectors 430B may be omitted.

FIG. 4D illustrates a side view of an example of the bowtie antenna stack 400A in accordance with various aspects of the present disclosure. The bowtie antenna stack 400A may be an example of aspects of the stacks 315 of bowtie antennas described with reference to FIG. 3A.

The bowtie antenna stack 400A may include a first bowtie antenna 410 and a plurality of additional bowtie antennas 420. The first bowtie antenna 410 may be electrically connected to the plurality of additional bowtie antennas 420 by the plurality of connectors 430 including the first plurality of connectors 430A and the second plurality of connectors 430B. The first bowtie antenna 410 may be excited by a coupled power source, which in turn may excite the additional bowtie antennas 420.

FIG. 4E illustrates a side view of an example of the bowtie antenna stack 400B in accordance with various aspects of the present disclosure. The bowtie antenna stack 400B may be an example of aspects of the stacks 315 of bowtie antennas described with reference to FIG. 3A.

The bowtie antenna stack 400B may include a first bowtie antenna 440 and a plurality of additional bowtie antennas 450. The first bowtie antenna 440 may be capacitively coupled to the plurality of additional bowtie antennas 450 (e.g., each bowtie antenna is floating relative to an adjacent bowtie antenna of the bowtie antenna stack 400B). The first bowtie antenna 440 may be excited by a coupled power source, and the excited first bowtie antenna 440 may then excite the additional bowtie antennas 450.

Figure 5:
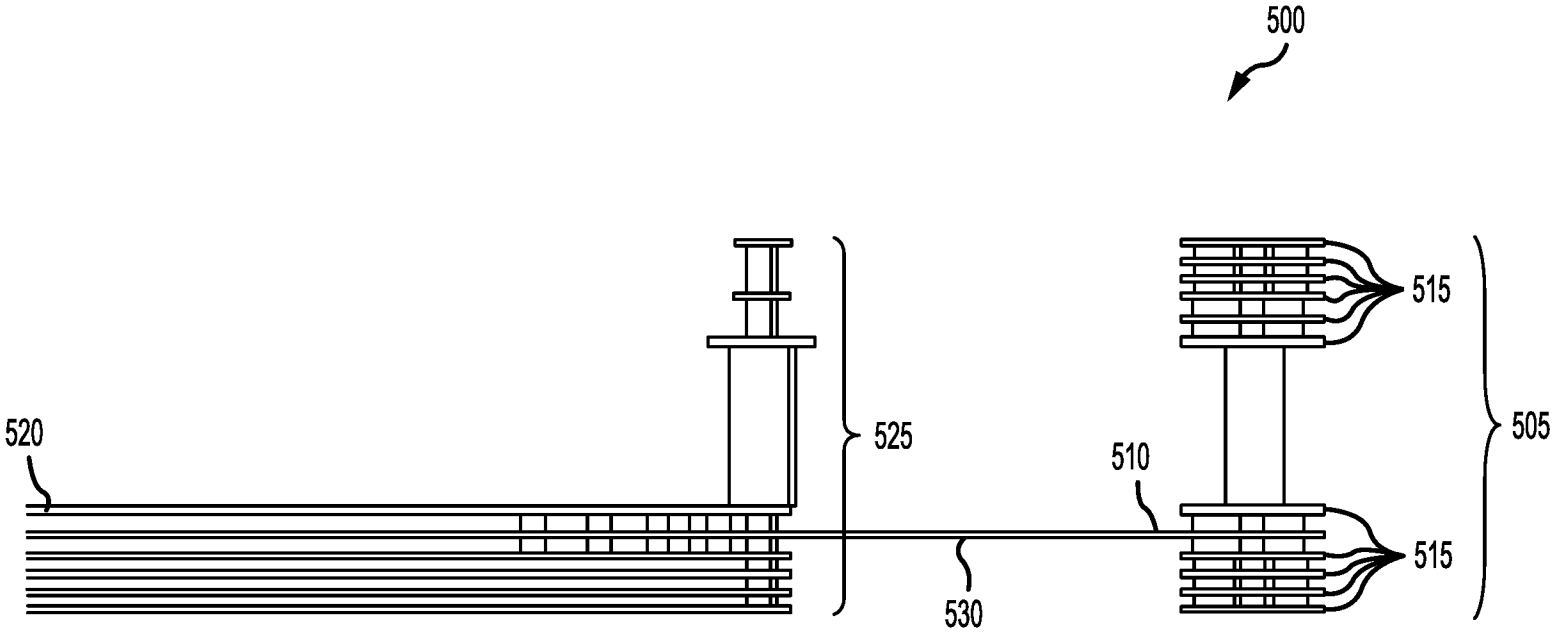
FIG. 5 illustrates a side view of an example of a portion of a multilayer bowtie antenna in accordance with aspects of the present disclosure.

FIG. 5 illustrates a side view of an example of a portion of a multilayer bowtie antenna structure 500 in accordance with various aspects of the present disclosure. The multilayer bowtie antenna structure 500 may be an example of aspects of multilayer bowtie antenna structure 300 described with reference to FIG. 3A.

The portion of the multilayer bowtie antenna structure 500 may include a bowtie antenna stack 505 including a first bowtie antenna 510 and a plurality of additional bowtie antennas 515. The bowtie antenna stack 505 may be an example of aspects of bowtie antenna stack 205, bowtie antenna stack 235, and/or bowtie antenna stack 315 described with reference to FIGS. 2A, 2B, and 3A. The first bowtie antenna 510 and the plurality of additional bowtie antennas 515 may be examples of aspects of first bowtie antenna 410 and the plurality of additional bowtie antennas 420 described with reference to FIGS. 4A-4E.

The portion of the multilayer bowtie antenna structure 500 may also include a ground plate 520 and a conductive wall 525. The ground plate 520 and conductive wall 525 may be an example of aspects of ground plate 305 and conductive wall 310, respectively, as described with reference to FIG. 3A. The portion of the multilayer bowtie antenna structure 500 may further include an electrical connection (e.g., a transmission line, an input/output to bowtie antenna elements, etc.) 530. In some cases, the electrical connection 530 may be, for example, one or more patch antennas coupled to each conductive element (e.g., an ellipse or a triangle) of the first bowtie antenna 510. The electrical connection 530 may couple the first bowtie antenna 510 to a power source.

Figure 6:
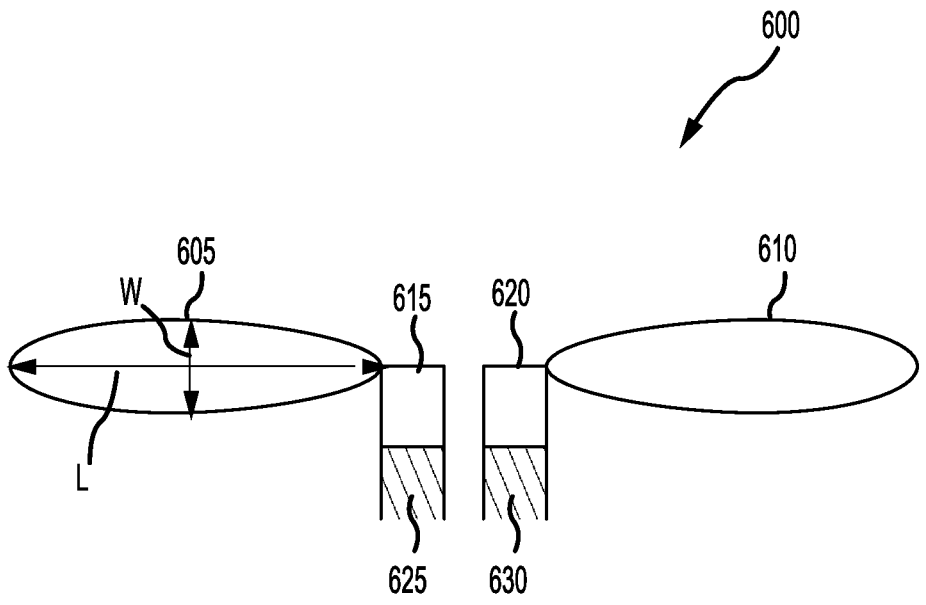
FIG. 6 illustrates a plan view of an example of an elliptical bowtie antenna in accordance with aspects of the present disclosure.

FIG. 6 illustrates a plan view of an example of an elliptical bowtie antenna 600 in accordance with various aspects of the present disclosure. The elliptical bowtie antenna 600 may be an example of aspects of aspects of the first bowtie antenna 410 and/or the plurality of additional bowtie antennas 420 as described with reference to FIGS. 4A-4D, and/or the first bowtie antenna 510 and/or the plurality of additional bowtie antennas 515 described with reference to FIG. 5.

The elliptical bowtie antenna 600 may include a first ellipse 605 and a second ellipse 610. In an aspect, the length L of each of the first ellipse 605 and the second ellipse 610 is greater than the width W of each of the first ellipse 605 and the second ellipse 610. In at some examples, the length L of each of the first ellipse 605 and the second ellipse 610 may be about five times the width W of each of the first ellipse 605 and the second ellipse 610 (however, either greater ratios or smaller ratios such as 4:1 or 3:1 may also be possible).

In some examples, the elliptical bowtie antenna 600 may include an input/output 615 and 620 for coupling the first and second ellipses to transmission lines 625 and 630, which may be electrically coupled to a signal source, e.g., a power source (not shown). In some cases, the elliptical bowtie antenna 600 may further include a first patch antenna (not shown) coupled to the first ellipse 605 and a second patch antenna (not shown) coupled to the second ellipse 610, which may couple the first ellipse 605 and the second ellipse 610 to the power source. In some other examples (e.g., for the non-excitable bowtie antennas in a bowtie antenna stack), the first patch antenna and the second patch antenna may be omitted.

Figure 7:
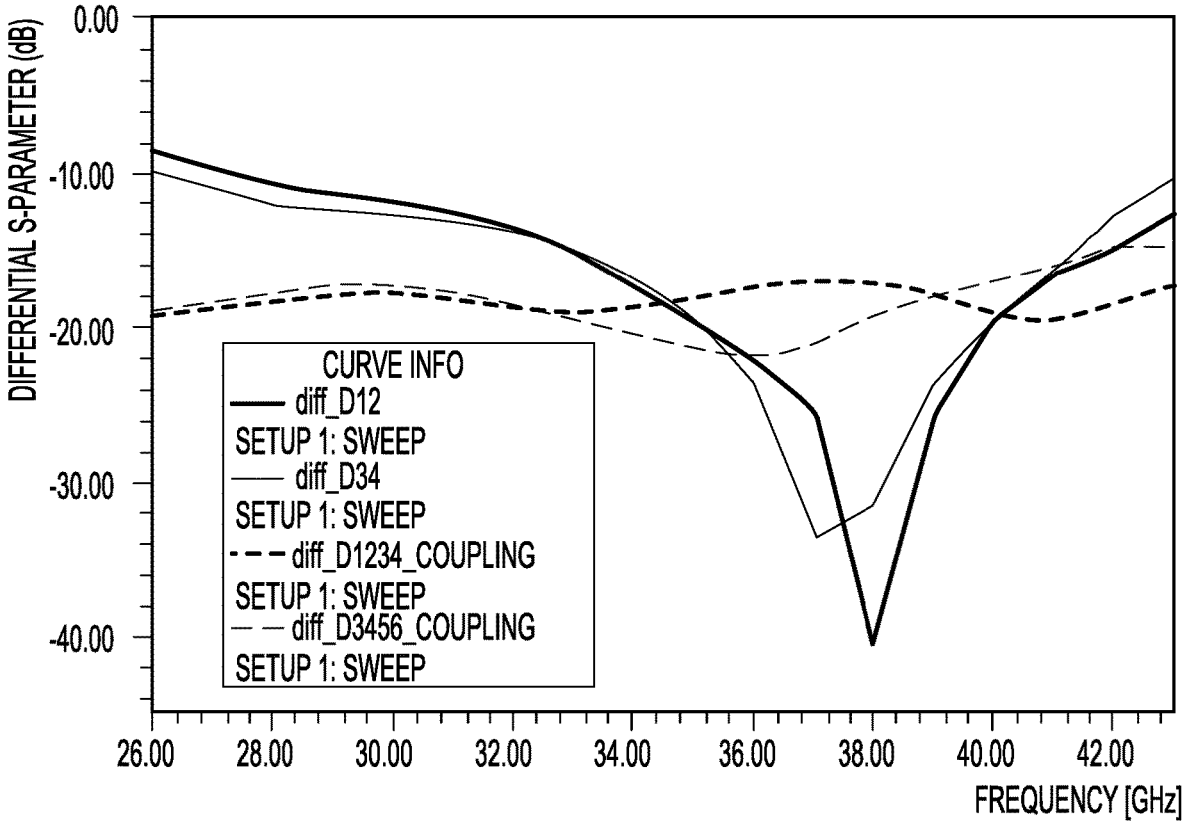
FIG. 7 illustrates an example of a graph of electrical performance for an elliptical bowtie antenna in accordance with aspects of the present disclosure.

FIG. 7 illustrates an example of a graph of electrical performance 700 for a multilayer bowtie antenna structure including elliptical bowtie antennas in accordance with various aspects of the present disclosure. In some examples, the elliptical bowtie antennas may be examples of aspects of elliptical bowtie antenna 600 as described with reference to FIG. 6.

The graph of electrical performance 700 shows various measurements for the differential scattering parameter (S-parameter) for a multilayer bowtie antenna structure including elliptical bowtie antennas. In some examples, the multilayer bowtie antenna structure may include an array of 4 stacks of bowtie antennas as shown in, e.g., FIG. 3A where each line in the graph shows the differential S-parameter of each stack of bowtie antennas within the array. As shown in the graph of electrical performance 700, the measurements show a differential S-parameter of below about −8 dB between 26 GHz and 43.5 GHz, thereby showing a good return loss over the frequency. One measurement shows a differential S-parameter of below about −40 dB at around 38 GHz (i.e., a resonance occurring at 38 GHz). A differential S-parameter may be used, as herein, to indicate electrical properties (e.g., reflection coefficient, return loss, gain, voltage standing wave ratio, etc.) of network components (e.g., a stack of bowtie antennas, etc.).

Figure 8:
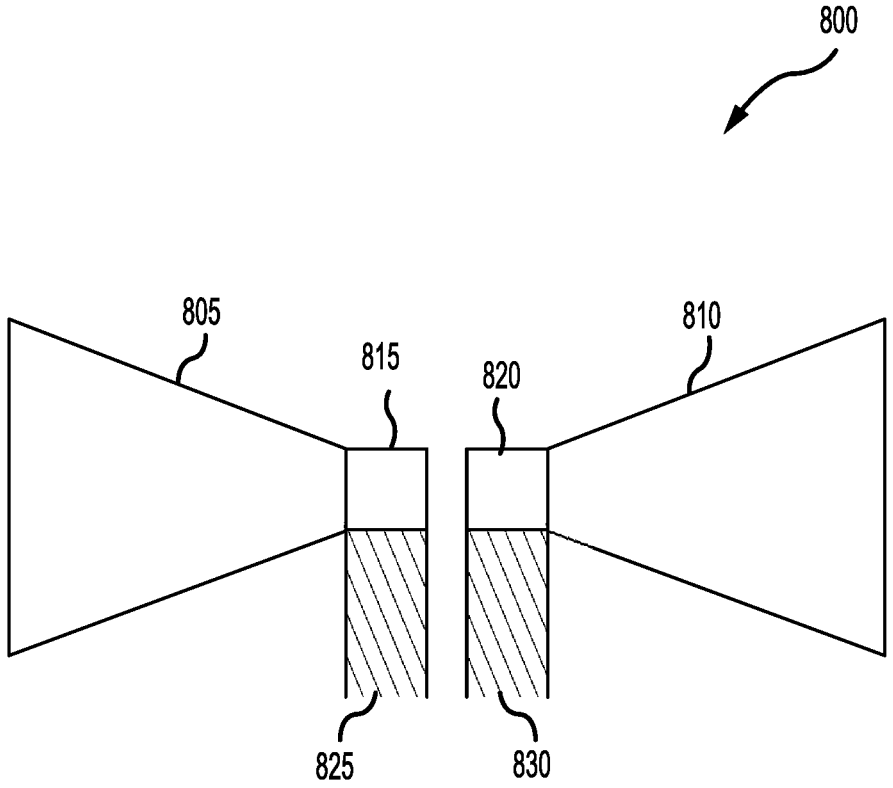
FIG. 8 illustrates a plan view of an example of a triangular bowtie antenna in accordance with aspects of the present disclosure.

FIG. 8 illustrates a plan view of an example of a triangular bowtie antenna 800 in accordance with various aspects of the present disclosure. The triangular bowtie antenna 800 may be an example of aspects of aspects of the first bowtie antenna 410 and/or the plurality of additional bowtie antennas 420 as described with reference to FIGS. 4A-4E, and/or the first bowtie antenna 510 and/or the plurality of additional bowtie antennas 515 described with reference to FIG. 5.

The triangular bowtie antenna 800 may include a first triangle 805 and a second triangle 810. In some examples, the triangular bowtie antenna 800 may further include an input/output 815 and 820 for electrically coupling the first triangle 805 and the second triangle 810 to a power source (not shown) via transmission lines 825 and 830. In some cases, a first patch antenna may be coupled to the first triangle 805 and a second patch antenna may be coupled to the second triangle 810. The first patch antenna and the second patch antenna may couple the first triangle 805 and the second triangle 810 to the power source. In some other examples (e.g., the non-excitable bowtie antennas in the bowtie antenna stack), the first patch antenna and the second patch antenna may be omitted.

Figure 9:
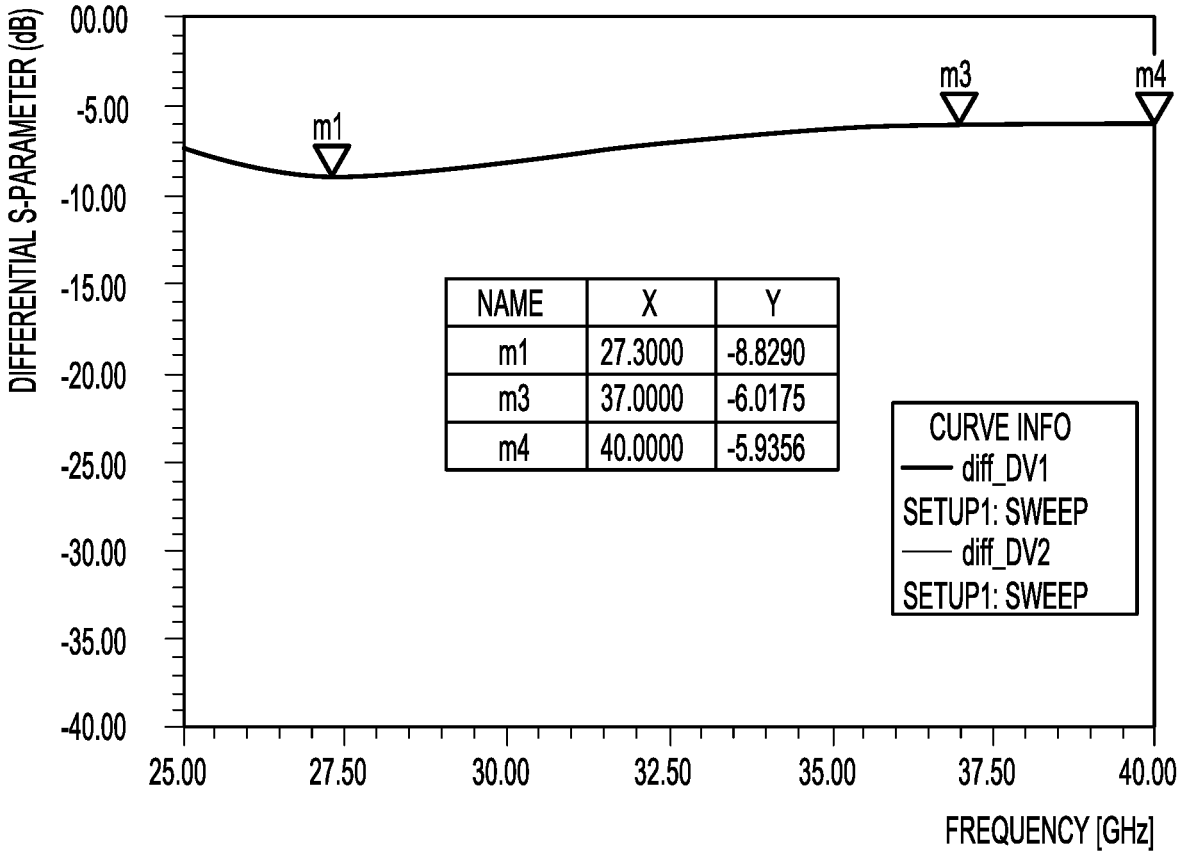
FIG. 9 illustrates an example of a graph of electrical performance for a triangular bowtie antenna in accordance with aspects of the present disclosure.

FIG. 9 illustrates an example of a graph of electrical performance 900 for a multilayer antenna structure including triangular bowtie antennas in accordance with various aspects of the present disclosure. In some examples, the triangular bowtie antennas may be examples of aspects of triangular bowtie antenna 800 described with reference to FIG. 8.

The graph of electrical performance 900 shows various measurements for the differential-S parameter for a multilayer antenna structure including triangular bowtie antennas. As shown in the graph of electrical performance 900, the measurements show a differential S-parameter of below about −5 dB between 25 GHz and 40 GHz, which is higher than the −8 dB for elliptical bowties shown in FIG. 7. As such, in some examples, an elliptical bowtie antenna (e.g., the elliptical bowtie antenna 600 as described herein with reference to FIG. 6) may result in better performance (e.g., lower reflection coefficient, return loss, etc.) than a triangular bowtie antenna (e.g., the triangular bowtie antenna 800 as described herein with reference to FIG. 8).

Figures 10A, 10B:
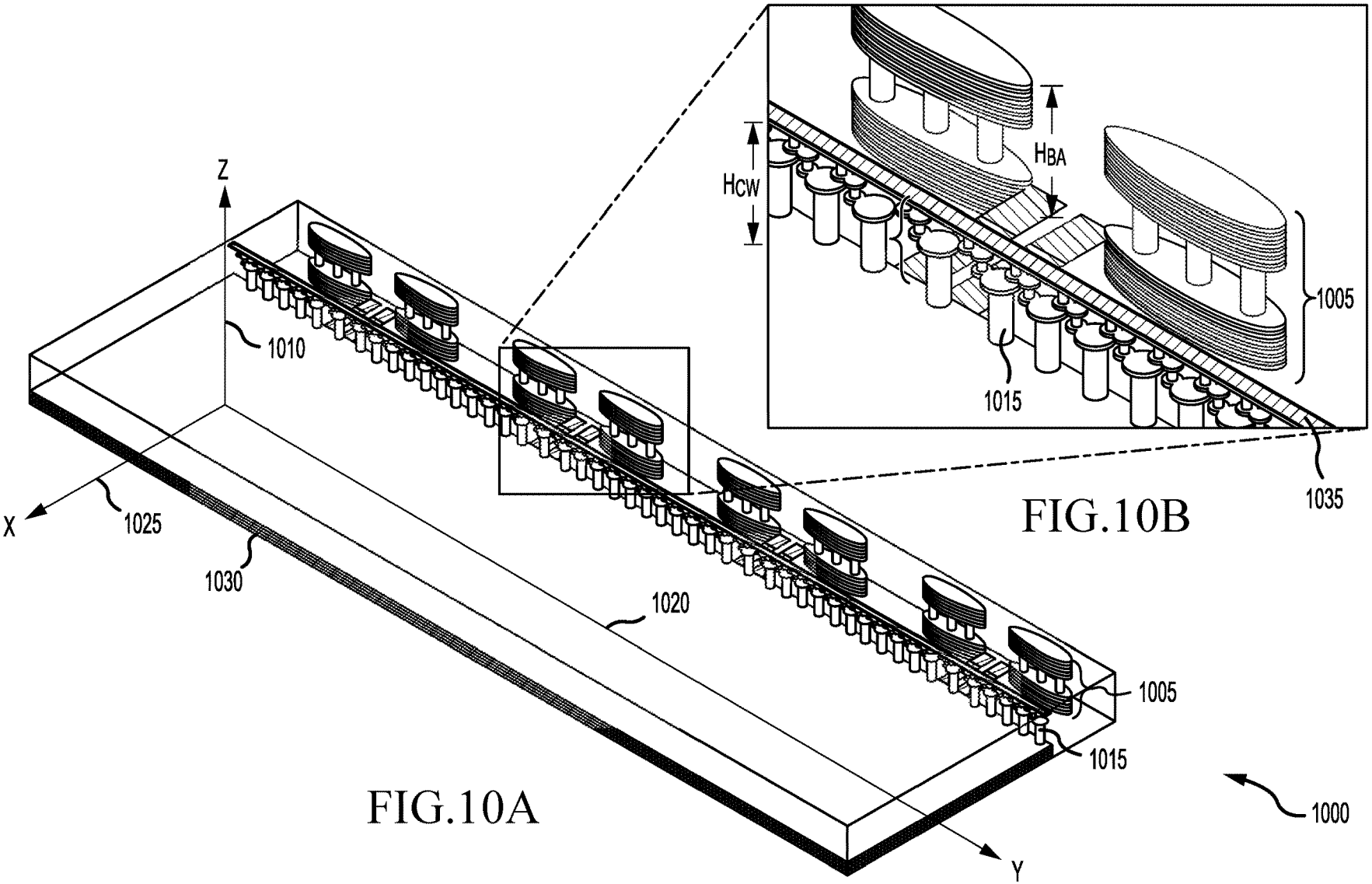
FIGS. 10A and 10B illustrate an example of a multilayer bowtie antenna structure in accordance with aspects of the present disclosure.

FIGS. 10A and 10B illustrate an example of a multilayer bowtie antenna structure 1000 in accordance with various aspects of the present disclosure. FIGS. 10A and 10B show the multilayer bowtie antenna structure including an array of bowtie antenna stack (e.g., the array of bowtie antenna stack 315 as described herein with reference to FIG. 3A) and an enlarged view of a stack of bowtie antennas (e.g., the stack 235 of bowtie antennas as described herein with reference to FIG. 2B) in the array of bowtie antenna stacks. In some examples, the multilayer bowtie antenna structure 1000 may be an example of aspects of multilayer bowtie antenna structure 300 described with reference to FIG. 3A.

The multilayer bowtie antenna structure 1000 may include a plurality of bowtie antenna stacks 1005. The bowtie antenna stacks 1005 may be examples of aspects of bowtie antenna stacks 205, bowtie antenna stacks 235, bowtie antenna stack 315, or bowtie antenna stacks 400A and 400B as described herein with reference to FIGS. 2A, 2B, 3A, and 4A through 4E. The bowtie antennas in the bowtie antenna stacks 1005 may be stacked in a first direction along z-axis 1010.

The multilayer bowtie antenna structure 1000 may also include a conductive wall 1015. The conductive wall 1015 may be an example of aspects of conductive wall 255 described with reference to FIG. 2. The conductive wall 1015 may extend in a second direction 1020 perpendicular to the first direction 1010. The conductive wall 1015 may be spaced apart from the plurality of bowtie antenna stacks 1005 in a third direction 1025 perpendicular to the first direction 1010 and the second direction 1020. The conductive wall 1015 may be coupled to a ground plane 1030. In some examples, the height Hcw (in the first direction 1010) of the conductive wall 1015 may be greater than the height HBA (in the first direction 1010) of the bowtie antenna stacks 1005. In some examples, the multilayer bowtie antenna structure 1000 may include a conductive bar 1035, which may be an example of aspects of conductive bar 260, 335, and/or 1110 as described herein with reference to FIGS. 2B, 3A, and 11.

Figure 11:
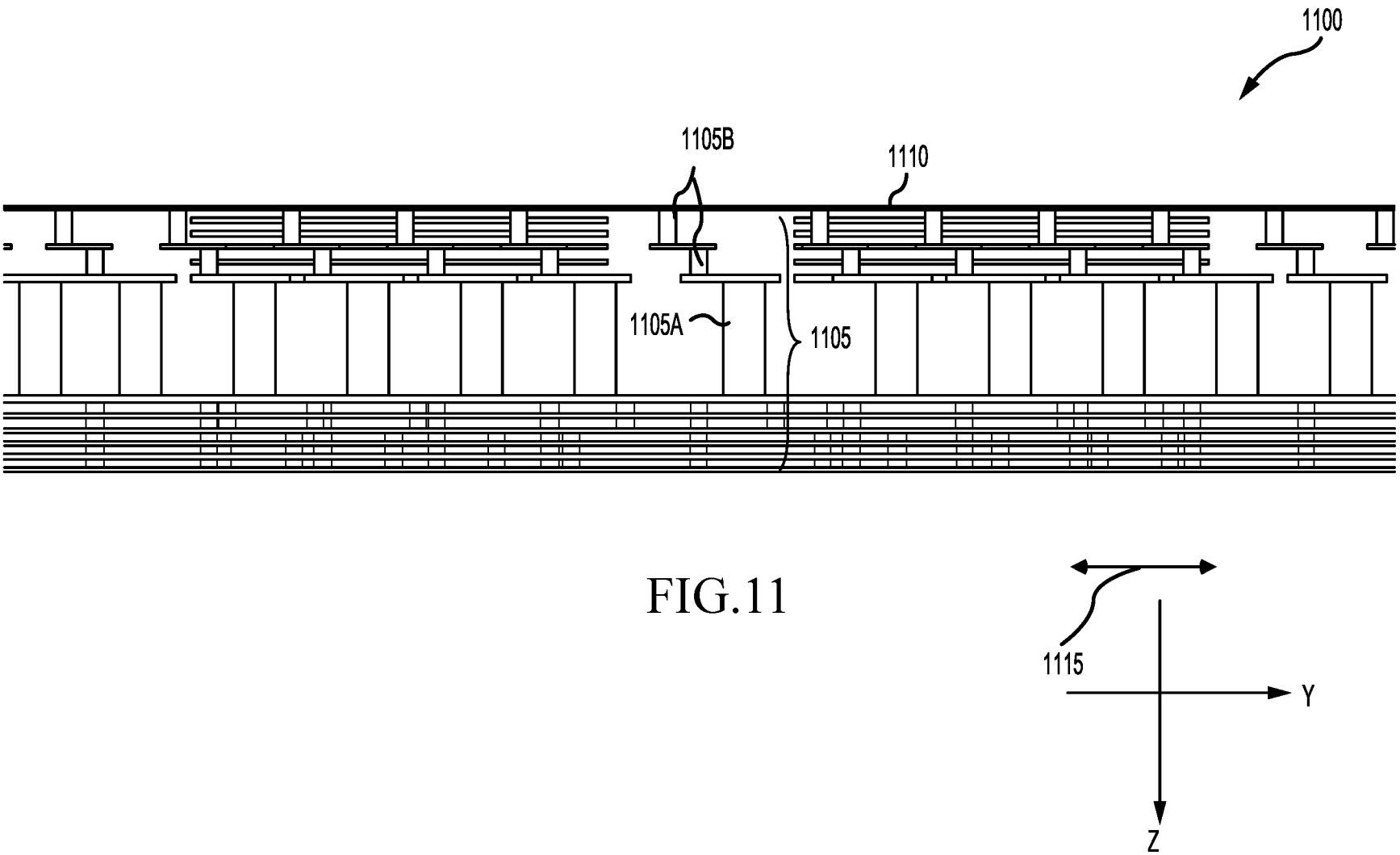
FIG. 11 illustrates a side view of an example of a conductive wall in a multilayer bowtie antenna structure in accordance with aspects of the present disclosure.

FIG. 11 illustrates a side view of an example of a conductive wall 1100 in accordance with various aspects of the present disclosure. In some examples, conductive wall 1100 may be an example of aspects of conductive wall 310 and/or conductive wall 1015 as described with reference to FIGS. 3 and 10.

The conductive wall 1100 may be composed of a number of conductive elements 1105 coupled to a conductive bar 1110. The conductive elements 1105 may be, for example, vias 1105A or micro-vias 1105B. The conductive wall 1100 may be a staggered wall, i.e., a first conductive element (e.g., vias) 1105A may be displaced in a direction (e.g., a direction along y-axis) 1115 with respect to a second conductive element (e.g., micro-vias) 1105B.

Figure 12:
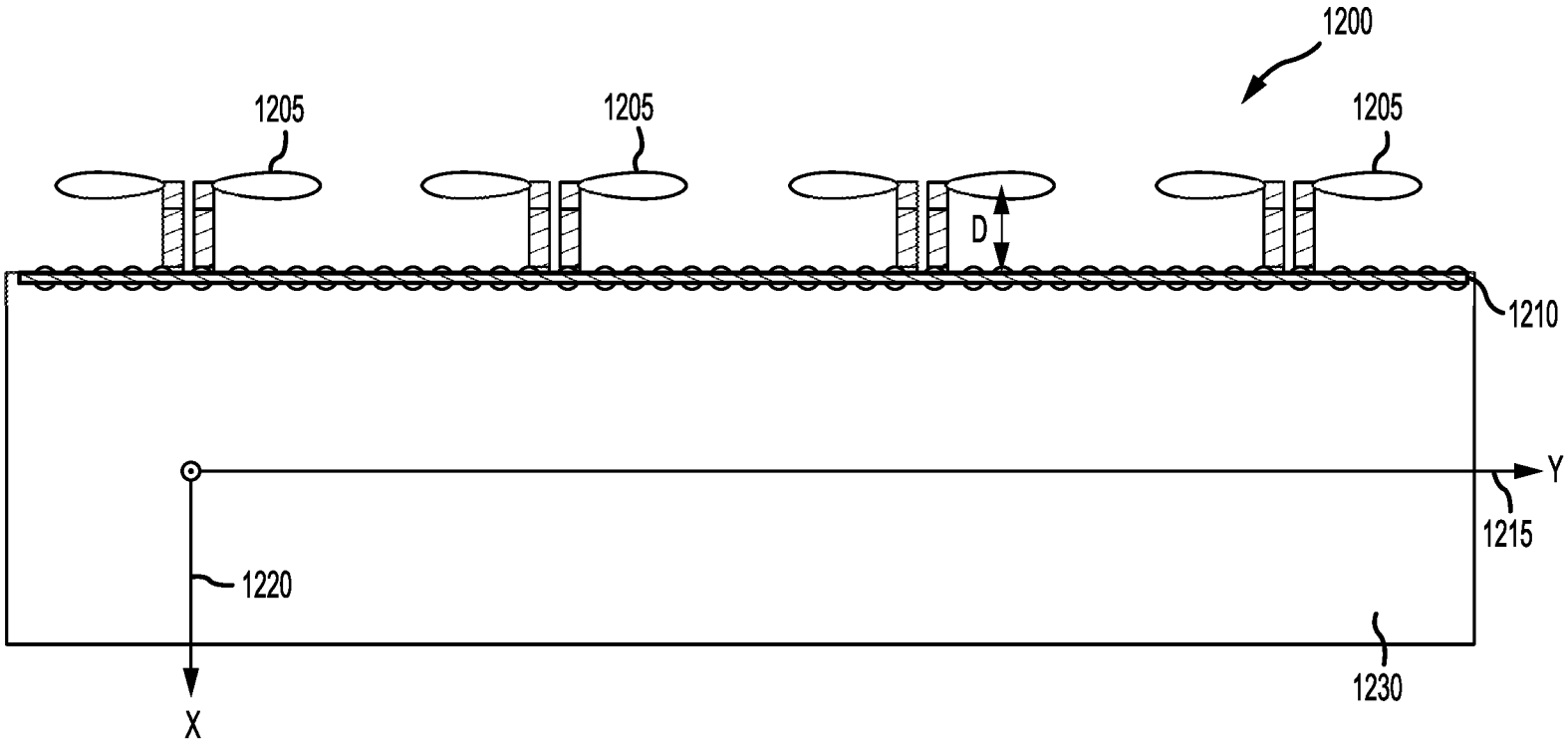
FIG. 12 illustrates a plan view of an example of a multilayer bowtie antenna structure in accordance with aspects of the present disclosure.

FIG. 12 illustrates a plan view of an example of a multilayer bowtie antenna structure 1200 in accordance with various aspects of the present disclosure. In some examples, the multilayer bowtie antenna structure 1200 may be an example of aspects of multilayer bowtie antenna structure 300 and 1000 described with reference to FIGS. 3 and 10.

The multilayer bowtie antenna structure 1200 may include a plurality of bowtie antenna stacks 1205 and a conductive wall 1210. The bowtie antenna stacks 1205 may be an example of aspects of bowtie antenna stacks 205, bowtie antenna stacks 235, bowtie antenna stack 315, bowtie antenna stacks 400A and 400B, bowtie antenna stack 505, and/or bowtie antenna stacks 1005 described with reference to FIGS. 2A, 2B, 3A, 4A, 4B, 4C, 4D, 4E, 5, and 10. The conductive wall 1210 may extend in a first direction (e.g., a direction along with y-axis 1215). The conductive wall 1210 may be an example of aspects of conductive wall 255, conductive wall 1015, and/or conductive wall 1100 described with reference to FIGS. 2, 10, and 11.

The conductive wall 1210 may be spaced apart from the plurality of bowtie antenna stacks 1205 in a second direction (e.g., a direction along x-axis 1220) perpendicular to second direction 1220. In some examples, the distance D between a bowtie antenna stack 1205 and the conductive wall 1210 may be based at least in part on the wavelength of a target operating frequency. For example, the distance D may be based at least in part on a quarter of the wavelength for the target operating frequency. The target operating frequency may be, for example, about 28 GHz, about 38 GHz, or about 38.5 GHz.

Figure 13:
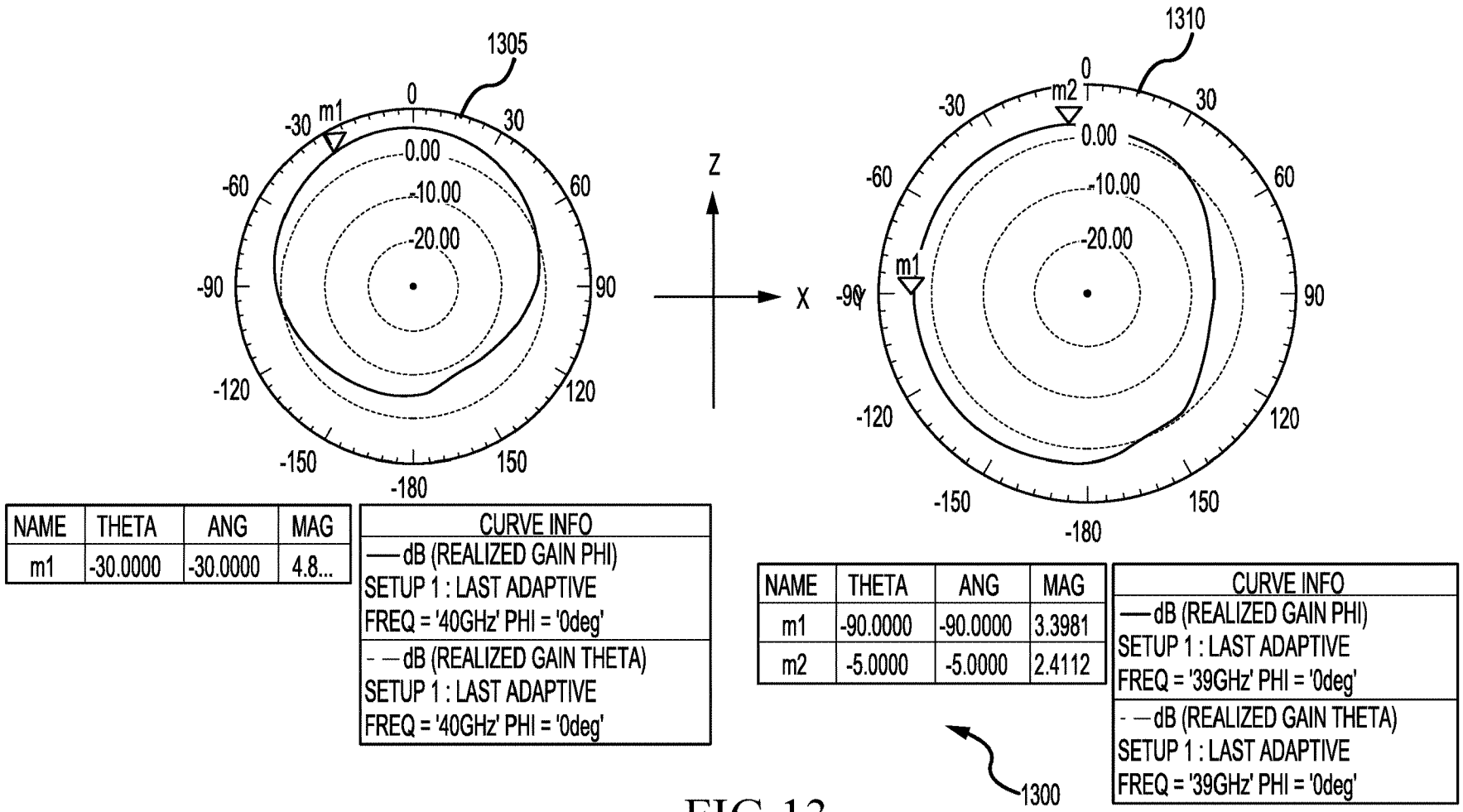
FIG. 13 illustrates examples of polar plots for multilayer bowtie antennas in accordance with aspects of the present disclosure.

FIG. 13 illustrates examples of polar plots 1300 for multilayer bowtie antenna structures in accordance with various aspects of the present disclosure. The multilayer bowtie antenna structures may be examples of aspects of multilayer bowtie antenna structure 300 described with reference to FIG. 3A.

The first polar plot 1305 describes the performance of a multilayer bowtie antenna structure at about 40 GHz on a x-z plane in accordance with various aspects of the present disclosure without a conductive wall. As shown in the first polar plot 1305, the beam may tilt up (in the z-direction) due to dielectric and parasitic elements (e.g., the plurality of additional bowtie antennas 420 as described with reference to FIGS. 4A-4D) in the absence of the conductive wall (e.g., a conductive wall 255 as described with reference to FIG. 2). The plurality of additional bowtie antennas may be considered parasitic since they are not excited directly via the transmission lines, but rather indirectly excited via the excited first bowtie antenna (e.g., a first bowtie antenna 210 as described with reference to FIG. 2). The beam tilts up since there are more layers (e.g., 6 layers) of the additional bowtie antennas in a top set (e.g., a second set 205B of FIG. 2) than in a bottom set (e.g., 5 layers in a first set 205A of FIG. 2).

The second polar plot 1310 describes the performance of a multilayer bowtie antenna at about 39 GHz in accordance with various aspects of the present disclosure with a conductive wall. As shown in the second polar plot 1310, the beam may be more symmetric in the direction of radiation when the conductive wall is present. For example, in FIG. 13 a boresight axis may be along the 90 degree axis of the polar plots, and the beam is transmitted toward the −90 degree direction. In second polar plot 1310, the beam is more symmetrical in the area between −45 degree to −135 degree of the polar plot than the beam of the first polar plot 1305 in the same area. A boresight may be an axis of maximum gain of a directional antenna.

Figure 14A:
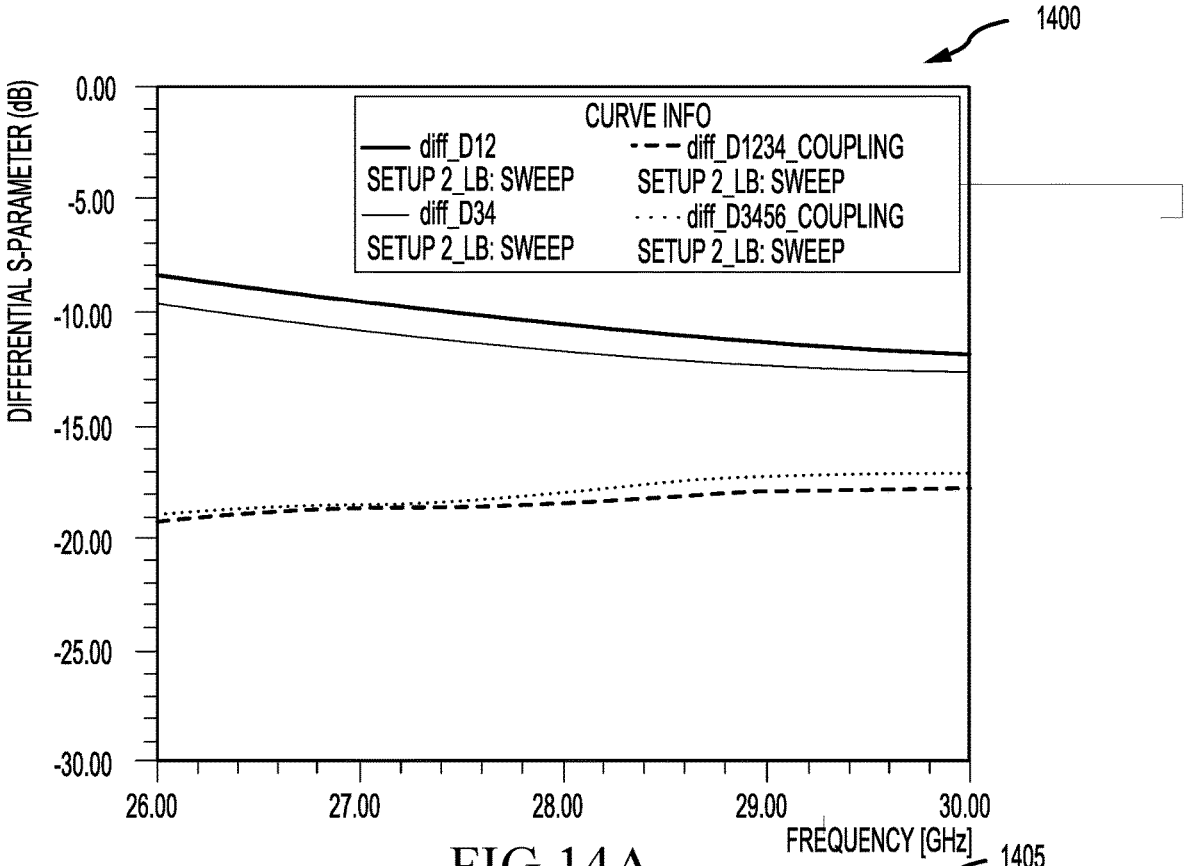
FIG. 14A illustrates an example of a lowband electrical performance graph for a multilayer bowtie antenna structure in accordance with aspects of the present disclosure.

FIG. 14A illustrates an example of a lowband electrical performance graph 1400 for a multilayer bowtie antenna structure in accordance with various aspects of the present disclosure. The multilayer bowtie antenna structure may be an example of aspects of multilayer bowtie antenna structure 300 described with reference to FIG. 3A.

The lowband electrical performance graph 1400 shows measurements of differential S-parameters for the multilayer bowtie antenna structure at a low frequency range between 26 GHz and 30 GHz. The differential S-parameter is below −8 dB at the low frequency range. The differential S-parameter is below −10 dB above about 27.4 GHz, i.e., in most of the lowband range depicted in the lowband electrical performance graph 1400. The lowband electrical performance graph 1400 shows differential S-parameter for mutual coupling between bowtie antennas (e.g., current, crosstalk, noise, etc., induced on one bowtie antenna or stack of bowtie antennas by radiated energy associated with another bowtie antenna or stack of bowtie antennas) is below about −17 dB in the lowband.

Figure 14B:
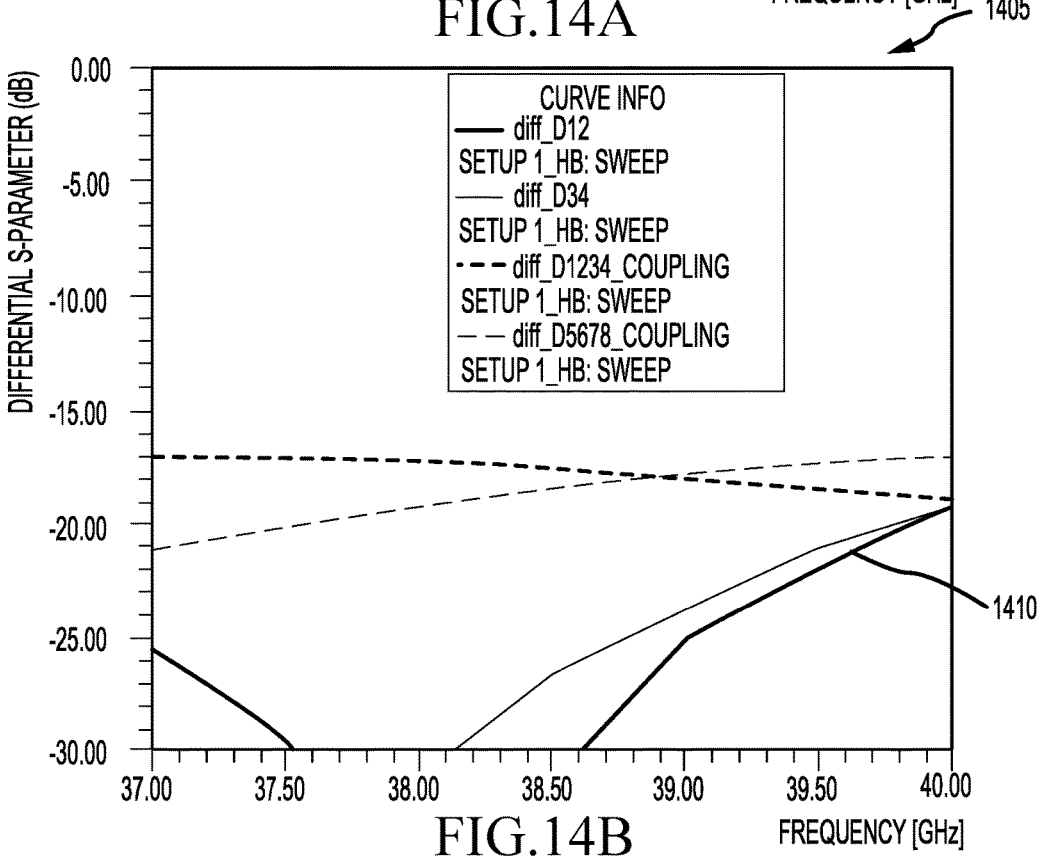
FIG. 14B illustrates an example of a highband electrical performance graph for a multilayer bowtie antenna structure in accordance with aspects of the present disclosure.

FIG. 14B illustrates an example of a highband electrical performance graph 1405 for a multilayer bowtie antenna in accordance with various aspects of the present disclosure. The multilayer bowtie antenna may be an example of aspects of multilayer bowtie antenna structure 300 described with reference to FIG. 3A.

The highband electrical performance graph 1405 shows measurements of differential S-parameters for the multilayer bowtie antenna at the high frequency band ranging between 37 GHz and 40 GHz. The differential S-parameter (e.g., 1410) is below about −19 dB in the highband. The highband electrical performance graph 1405 shows the differential S-parameter for mutual coupling between bowties is below about −17 dB in the highband.

Figure 15A:
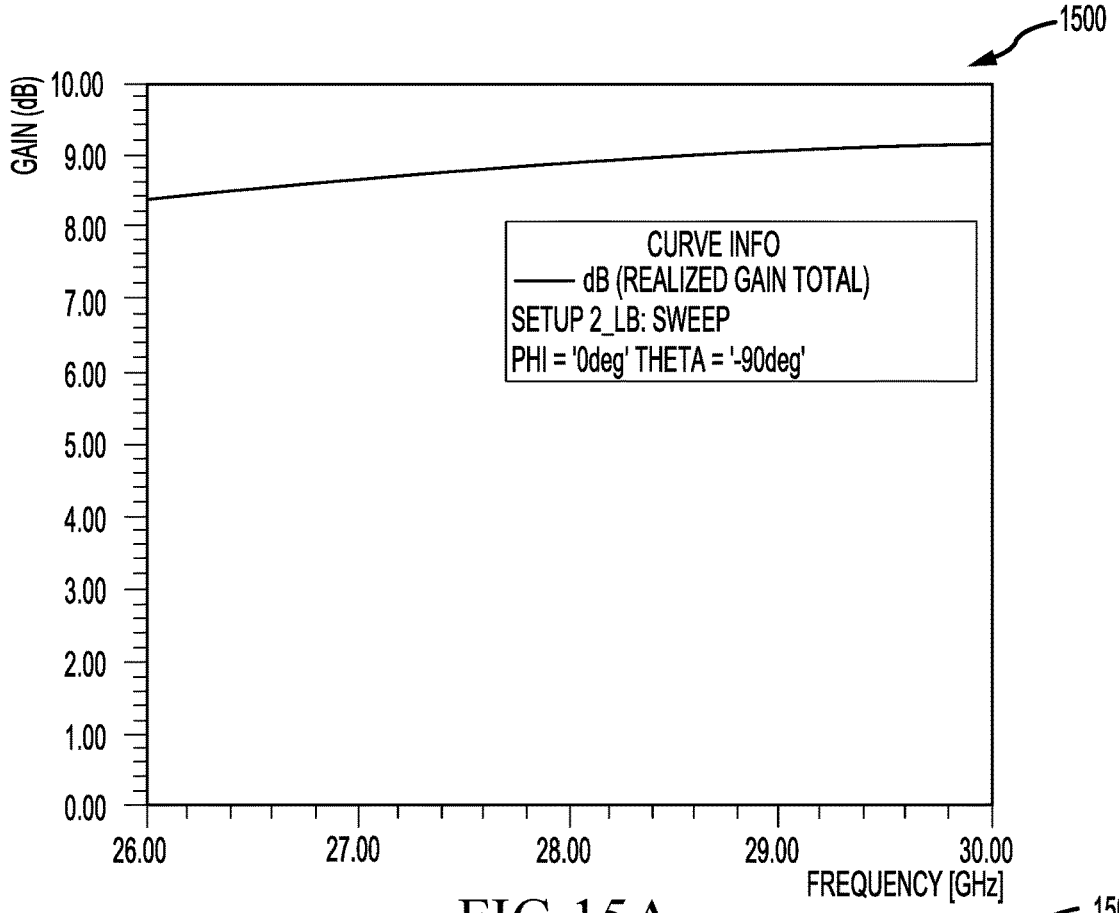
FIG. 15A illustrates an example of a lowband electrical performance graph for a multilayer bowtie antenna structure in accordance with aspects of the present disclosure.

FIG. 15A illustrates an example of a lowband electrical performance graph 1500 for a multilayer bowtie antenna structure in accordance with various aspects of the present disclosure. The multilayer bowtie antenna may be an example of aspects of multilayer bowtie antenna structure 300 described with reference to FIG. 3A.

The lowband electrical performance graph 1500 shows measurements of boresight gain for the multilayer bowtie antenna at a frequency band ranging between 26 GHz and 30 GHz. The boresight gain is greater than about 8.4 dBi throughout the frequency band. As such, the lowband electrical performance graph 1500 shows the boresight gain of a multilayer bowtie antenna structure as described herein is maintained almost flat at about 8.4 dBi over the low frequency band, showing no null (e.g., a minima, a canceled signal, etc.).

Figure 15B:
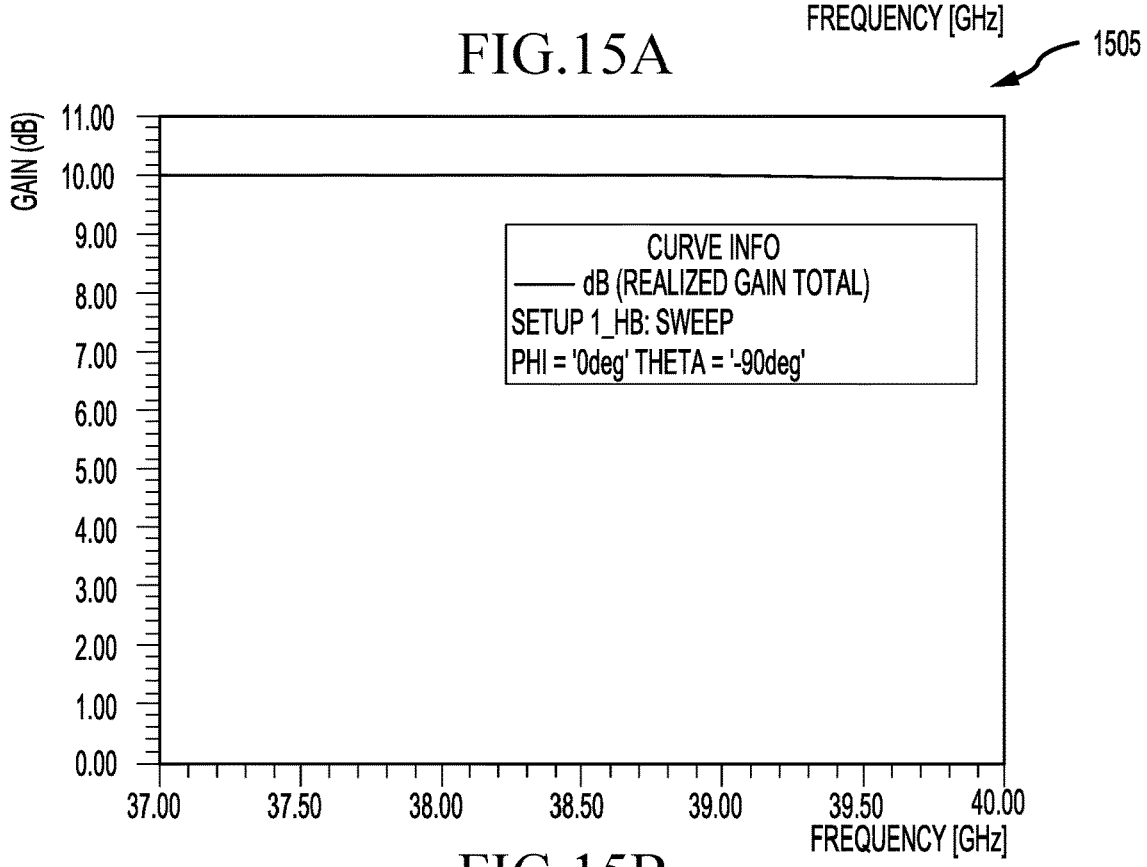
FIG. 15B illustrates an example of a lowband electrical performance graph for a multilayer bowtie antenna structure in accordance with aspects of the present disclosure.

FIG. 15B illustrates an example of a highband electrical performance graph 1505 for a multilayer bowtie antenna structure in accordance with various aspects of the present disclosure. The multilayer bowtie antenna may be an example of aspects of multilayer bowtie antenna structure 300 described with reference to FIG. 3A.

The highband electrical performance graph 1505 shows measurements of boresight gain for the multilayer bowtie antenna structure at a frequency band ranging between 37 GHz and 40 GHz. The boresight gain is greater than or equal to about 10 dBi throughout the frequency band. As such, the highband electrical performance graph 1505 shows the boresight gain of a multilayer bowtie antenna structure as described herein is maintained almost flat at about 10 dBi over the low frequency band, showing no null (e.g., a minima, a canceled signal, etc.).

Figure 16A:
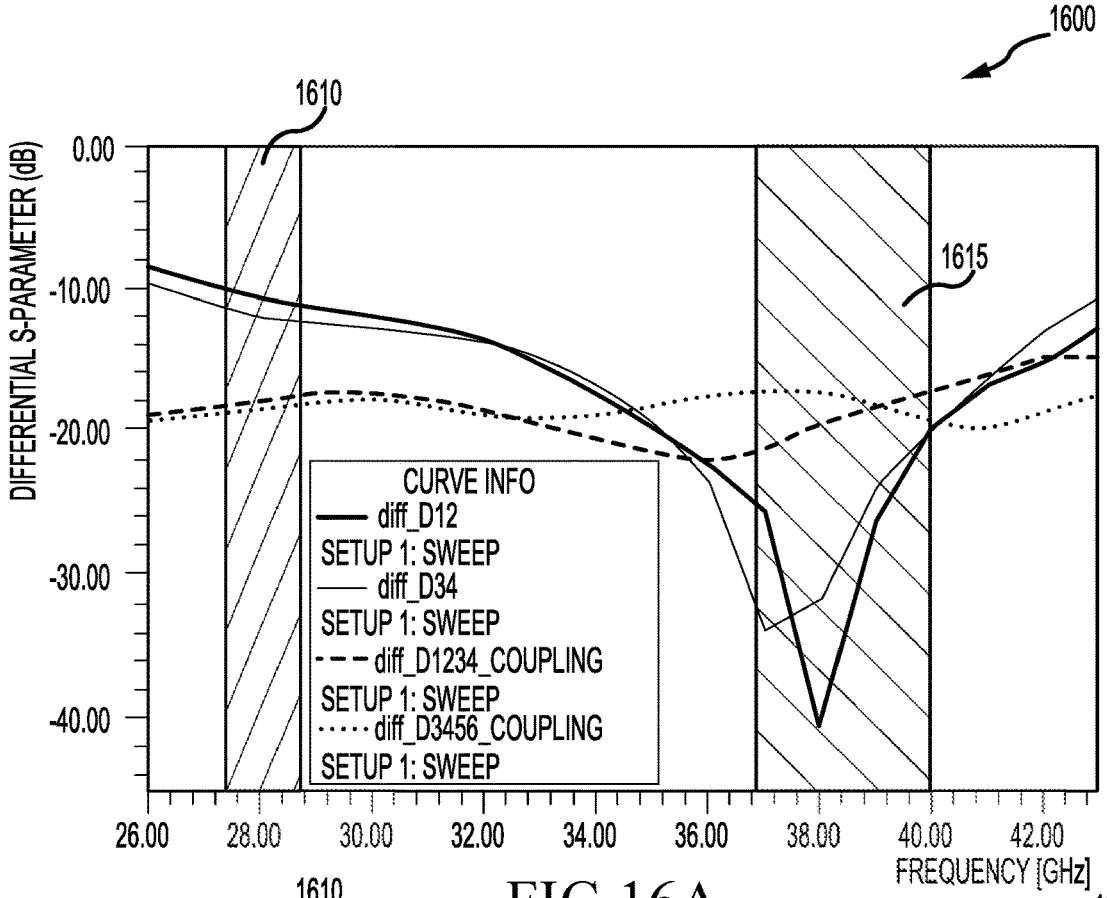
FIG. 16A illustrates an example of an electrical performance graph for a multilayer bowtie antenna structure in accordance with aspects of the present disclosure.

FIG. 16A illustrates an example of an electrical performance graph 1600 for a multilayer bowtie antenna structure in accordance with various aspects of the present disclosure. The multilayer bowtie antenna may be an example of aspects of multilayer bowtie antenna structure 300 described with reference to FIG. 3A.

The electrical performance graph 1600 shows measurements of the differential S-parameter at a frequency range between 26 GHz and 43.5 GHz. The differential S-parameter is below about −8 dB throughout the frequency range. The differential S-parameter is below about −10 dB in a first frequency sub-range (e.g., a lowband) 1610 between 27.5 GHz and 28.3 GHz. The differential S-parameter is below about −40 dB in a second frequency sub-range (e.g., a highband) 1615 between 37 GHz and 40 GHz. The electrical performance graph 1600 shows that mutual coupling between the bowtie antennas or the stacks of bowtie antennas is from −15 dB to −22 dB over the frequency range. As such, the differential S-parameter remains lower than −10 dB throughout the frequency range, thereby covering the frequency range with a good return loss.

Figure 16B:
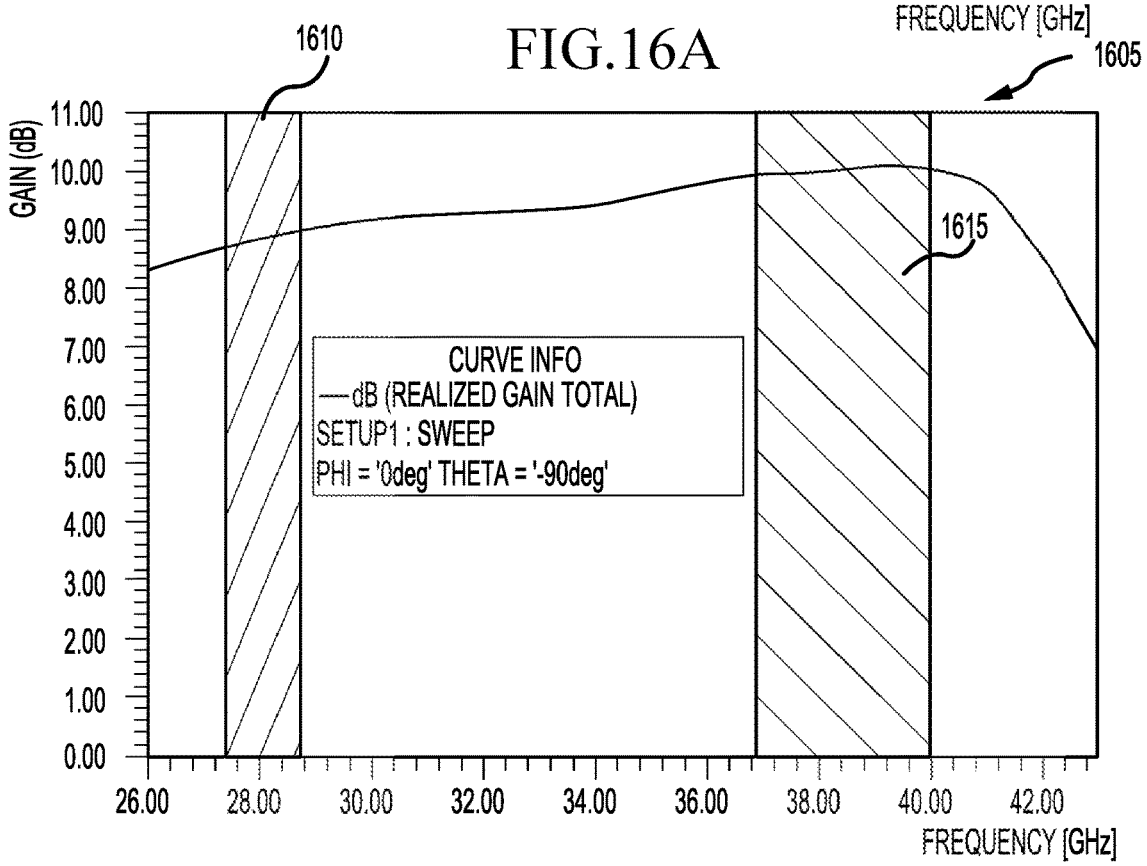
FIG. 16B illustrates an example of an electrical performance graph for a multilayer bowtie antenna structure in accordance with aspects of the present disclosure.

FIG. 16B illustrates an example of an electrical performance graph 1605 for a multilayer bowtie antenna structure in accordance with various aspects of the present disclosure. The multilayer bowtie antenna may be an example of aspects of multilayer bowtie antenna structure 300 described with reference to FIG. 3A.

The electrical performance graph 1605 shows measurements of gain for the multilayer bowtie antenna structure at a frequency range between 26 GHz and 43.5 GHz. A gain of an antenna may be measured with an isotropic antenna (e.g., an antenna transmitting equal amounts of signal (e.g., power) in all directions) as a reference antenna, and indicate an increase in directivity of the antenna. For example, a gain of 6 dBi may indicate doubling a coverage range or directivity of the antenna. In FIG. 16B the gain is above or equal to about 7 dB isotropic (dBi) throughout the frequency range. The gain is above about 8.6 dBi in the first frequency sub-range 1610, and above or equal to about 10 dBi in the second frequency sub-range 1615. As such, the electrical performance graph 1605 shows good gain measurements for a multilayer bowtie antenna structure as described herein in accordance with the present disclosure.

Figure 17:
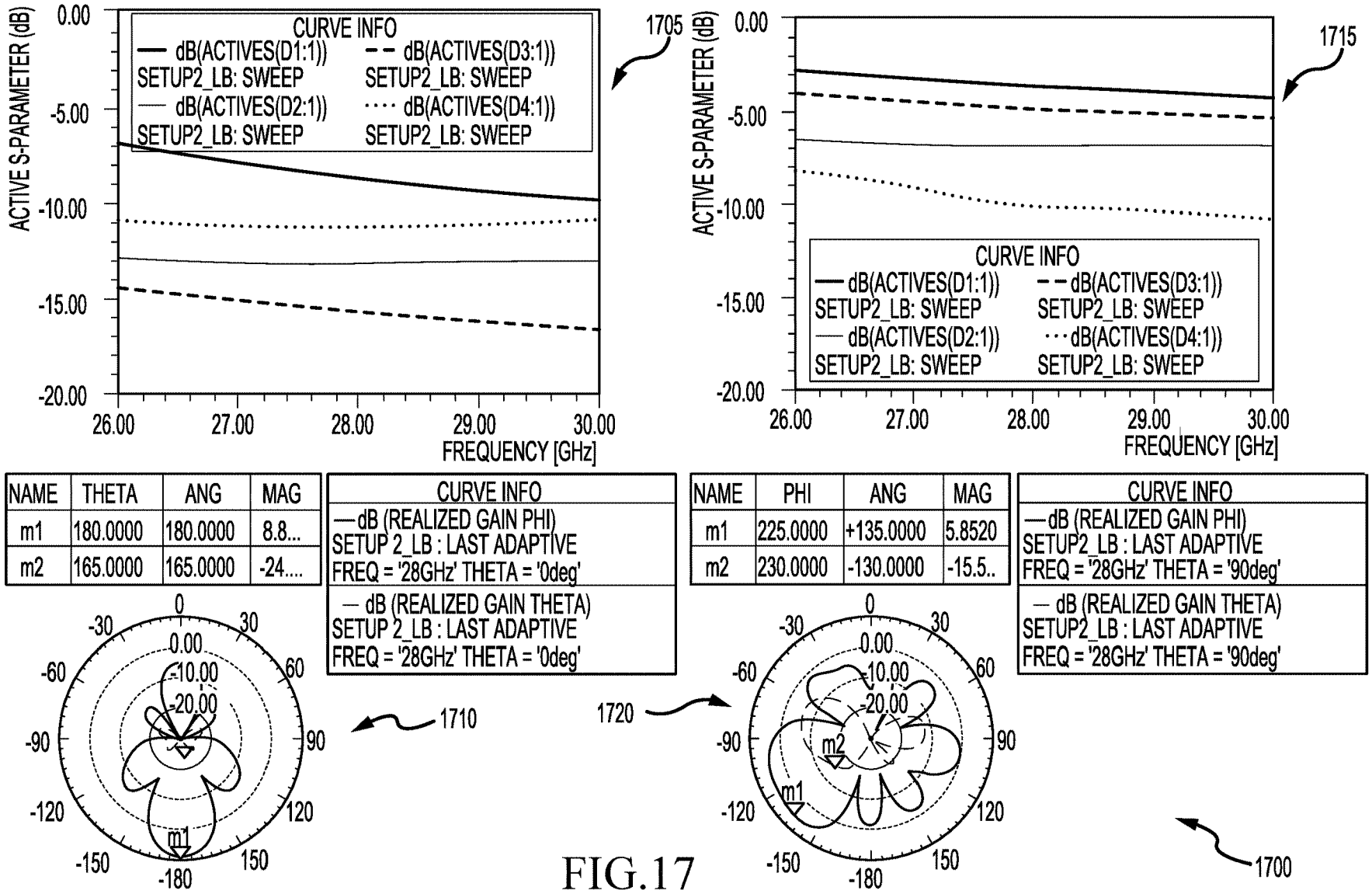
FIG. 17 illustrates an example of electrical performance graphs for a multilayer bowtie antenna structure in accordance with aspects of the present disclosure.

FIG. 17 illustrates an example of electrical performance graphs 1700 for a multilayer bowtie antenna structure in accordance with various aspects of the present disclosure. In some examples, the multilayer bowtie antenna may be an example of aspects of multilayer bowtie antenna structure 300 described with reference to FIG. 3A.

The electrical performance graphs 1700 are based on beam scans around 28 GHz, and include an active S-parameter graph 1705, a boresight gain polar plot 1710, an active S-parameter graph at 45 degrees 1715, and a polar plot for gain at 45 degrees 1720. The active S-parameters may indicate how much energy is reflected from each port of bowtie antennas in a multilayer bowtie antenna structure as described herein. The graph 1705 and the polar plot 1710 show the active S-parameter and the boresight gain are scanned at 28 GHz without beam steering. The graph 1705 shows the active S-parameters below −7 dB over the low-band ranging from 26 GHz to 30 GHz, and the boresight gain polar plot 1710 shows a maximum gain of about 8.8 dBi at 28 GHz. The graph 1715 and the polar plot 1720 show the active S-parameter and the boresight gain when bowtie antennas of the multilayer bowtie antenna structure are beam steered by 45 degrees at 28 GHz. In some cases, a phase angle of 135 degrees may be used to steer the beam by 45 degrees. The graph 1715 shows the active S-parameters below about −3 dB and the polar plot for gain at 45 degrees 1720 shows a maximum gain of about 5.8 dBi at 28 GHz. Thus, FIG. 17 shows only a 3 dBi degradation from the beam steering, thereby indicating a capability of the bowtie antennas of the multilayer bowtie antenna structure to be steered in a desired direction with a low directivity degradation.

Figure 18:
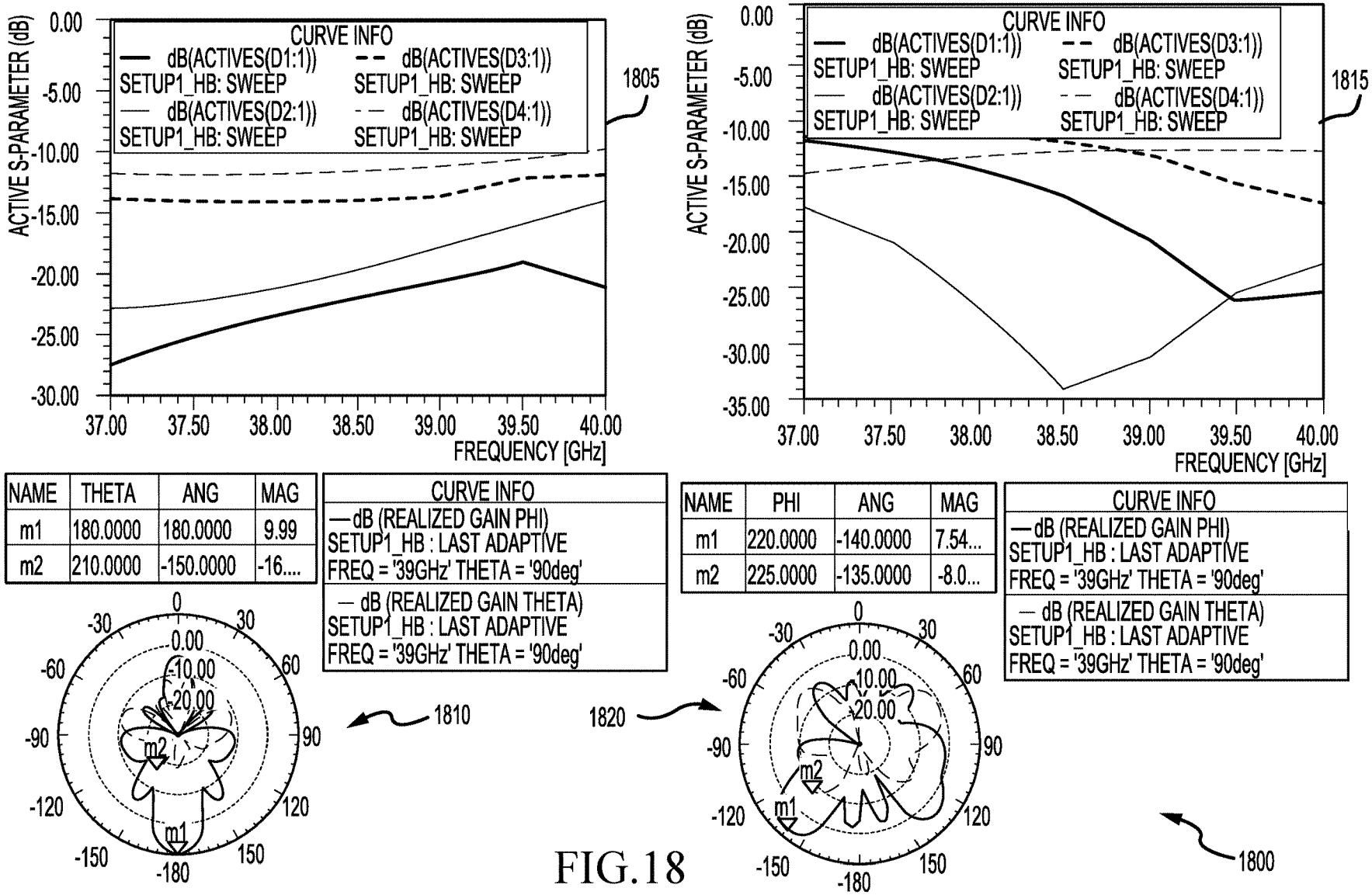
FIG. 18 illustrates an example of electrical performance graphs for a multilayer bowtie antenna structure in accordance with aspects of the present disclosure.

FIG. 18 illustrates an example of electrical performance graphs 1800 for a multilayer bowtie antenna in accordance with various aspects of the present disclosure. In some examples, the multilayer bowtie antenna structure may be an example of aspects of multilayer bowtie antenna structure 300 described with reference to FIG. 3A.

The electrical performance graphs 1800 are based on beam scans around 38.5 GHz and include an active S-parameter graph 1805, a boresight gain polar plot 1810, an active S-parameter graph at 45 degrees 1815, and a polar plot for gain at 45 degrees 1820. The graph 1805 and the polar plot 1810 show the active S-parameter and the boresight gain, when bowtie antennas of the multilayer bowtie antenna structure are beam scanned at 39 GHz without beam steering. The graph 1805 shows the active S-parameter below about −10 dB and the boresight gain polar plot 1810 shows a maximum gain of about 9.9 dBi at 39 GHz. The graph 1815 and the polar plot 1820 show the active S-parameter and the boresight gain, when bowtie antennas of the multilayer bowtie antenna structure are beam steered by 45 degrees at 39 GHz. In some cases, a 157.5 degree phase angle may be used to steer a beam at 39 GHz. In FIG. 18, the polar plot for gain at 45 degrees 1820 shows a maximum gain of about 7.5 dBi at 39 GHz, only 2.4 dBi degradation due to beam steering. The S-parameter graphs 1805 and 1815 show S-parameters of below about −10 dB throughout the frequency range up to 45 degree beam steering. Thus, FIG. 18 may indicate the capability of bowtie antennas of the multilayer bowtie antenna structure to be steered in a desired direction even at a high frequency with a low directivity degradation.

FIG. 19 illustrates a perspective view of an example of a multilayer bowtie antenna structure 1900 in accordance with various aspects of the present disclosure. The multilayer bowtie antenna structure 1900 may be an example of aspects of multilayer bowtie antenna structure 300 described with reference to FIG. 3A.

The multilayer bowtie antenna structure 1900 includes a stack 1905 of bowtie antennas having a first set 1905A and a second set 1905B of bowtie antennas, a first bowtie antenna 1910 included in the first set 1905A and electrically coupled to transmission lines 1915, a ground plate 1920 electrically coupled to the transmission lines 1915 and a chipset (not shown) including, e.g., RF transceiver, PMIC, or processor for operating the multilayer bowtie antenna structure 1900. The features and elements shown in FIG. 19 operate similarly to like-named features and elements of the multilayer bowtie antenna structure 200A, 200B, 300, and 1000 as described herein with reference to FIGS. 2A, 2B, 3A, and 10A-B, and thus, a detailed description of these features and elements are omitted.

The multilayer bowtie antenna structure 1900 differs from the multilayer bowtie antenna structure 200A, 200B, 300, and 1000 in that the first bowtie antenna 1910 and each of a plurality of additional bowtie antennas 1940 may have different shapes and/or dimensions. In FIG. 19, both the first bowtie antenna 1910 and each of the plurality of additional bowtie antennas 1940 include a pair of antenna elements in elliptical shape (e.g., an ellipse); however, the ellipses 1910A and 1910B of the first bowtie antenna 1910 may have larger major-axis and minor-axis than the ellipses included in the plurality of additional bowtie antennas 1940. Further, each bowtie antenna within the stack 1905 is not coupled to adjacent bowtie antennas in the stack 1905 via connections (e.g., dielectric connections or vias 350 as described herein with reference to FIG. 3A). Rather, each bowtie antenna of the stack 1905 is capacitively coupled to adjacent bowtie antennas in the stack 1905 (e.g., each bowtie antenna is floating relative to the bowtie elements). In addition, the second set 1905B includes, at its bottom layer, bowtie antennas including tabs 1925 (e.g., for optimizing antenna frequency responses). Also, in this example, the multilayer bowtie antenna structure 1900 does not include a conductive wall or a conductive bar (e.g., a conductive wall 310 and a conductive bar 335, respectively, as described herein with reference to FIG. 3A). In some cases however, the multilayer bowtie antenna structure 1900 may include a conductive wall to obtain a symmetrical beam. In some cases, the multilayer bowtie antenna structure 1900 may not include a conductive wall, but may include a conductive bar or strip for, e.g., correction of any tilting of the beam. In some cases, even without the conductive wall or the conductive bar the multilayer bowtie antenna structure 1900 may cover frequencies ranging from 24 GHz to 43 GHz, thereby covering even more frequencies than the frequencies the multilayer bowtie antenna structure 300 of FIG. 3A may cover.

Figure 20:
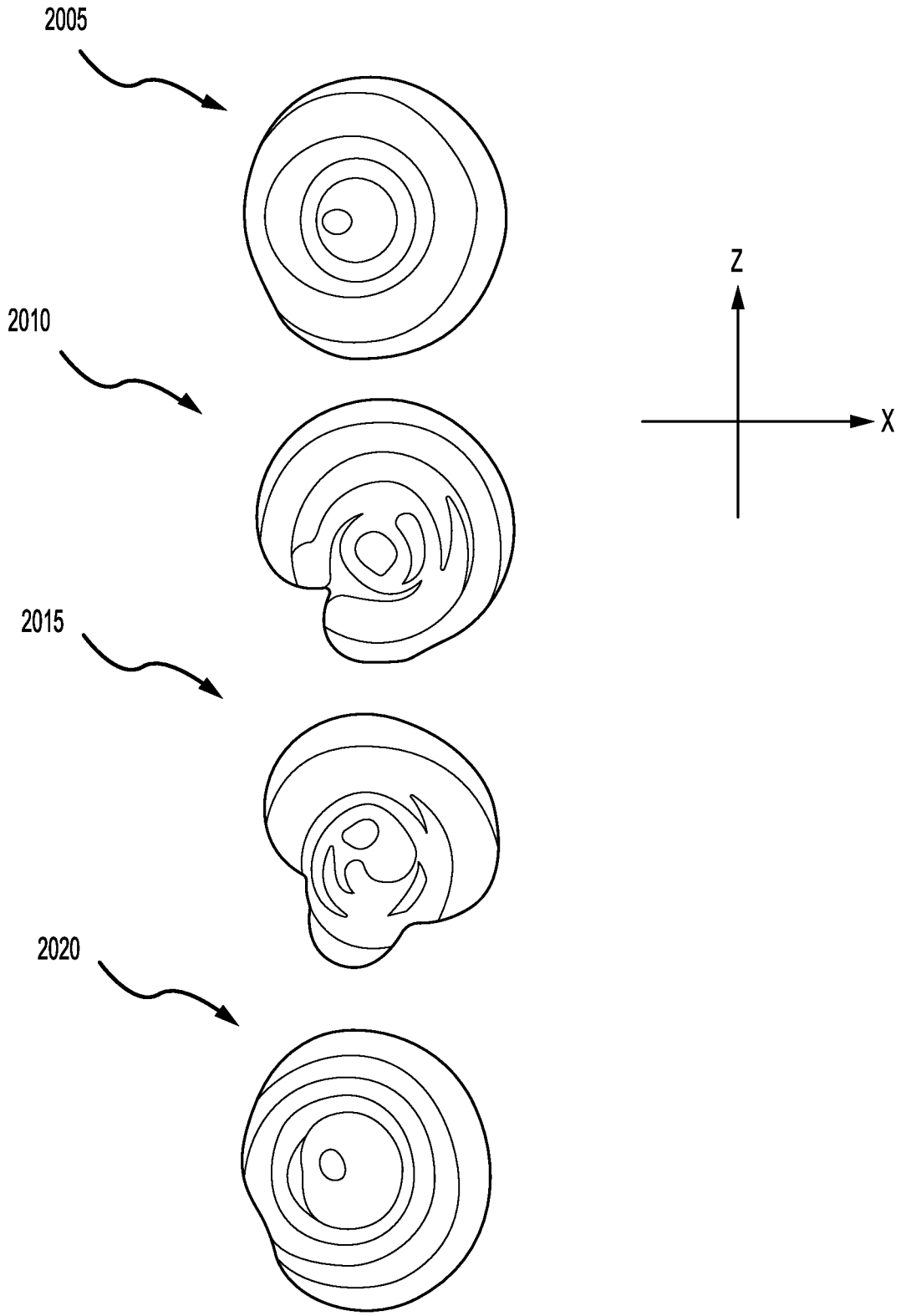
FIG. 20 illustrates radiation patterns of multilayer bowtie antennas structures in accordance with aspects of the present disclosure.

FIG. 20 shows radiation patterns of the multilayer bowtie antenna structures (e.g., radiated at high frequencies ranging, e.g., from 37 GHz to 42 GHz) as described herein. Radiation pattern 2005 shows beam performance of a multilayer bowtie antenna structure including both a conductive wall and a conductive bar (e.g., a conductive wall 310 and a conductive bar 335, respectively, as described herein with reference to FIG. 3A). Radiation pattern 2005 is similar to the beam performance shown in the second polar plot 1310 of FIG. 13, and shows a symmetrical beam performance. Radiation pattern 2010 shows beam performance of a multilayer bowtie antenna structure including the conductive wall, but not the conductive bar. Radiation pattern 2010 shows a beam tilted upwards in z-direction. Radiation pattern 2015 shows beam performance of a multilayer bowtie antenna structure that does not include either the conductive wall or the conductive bar. Radiation pattern 2015 shows a beam tilted upwards. As such, radiation patterns at the high frequencies may tend to tilt upward when there is no conductive wall provided within the multilayer bowtie antenna structure. However, a horizontal metal bar may make the radiation patterns get back to the boresight. For example, a horizontal conductive bar (e.g., a conductive bar 335 as described herein with reference to FIG. 3A) may provide an enough reflective area for the stack of bowtie antennas of the multilayer bowtie antenna structure (e.g., a stack 315 as described herein with reference to FIG. 3A) to reflect the radiated signals of the stack towards a desired direction in a symmetrical manner as shown in radiation pattern 2020.

Figure 21:
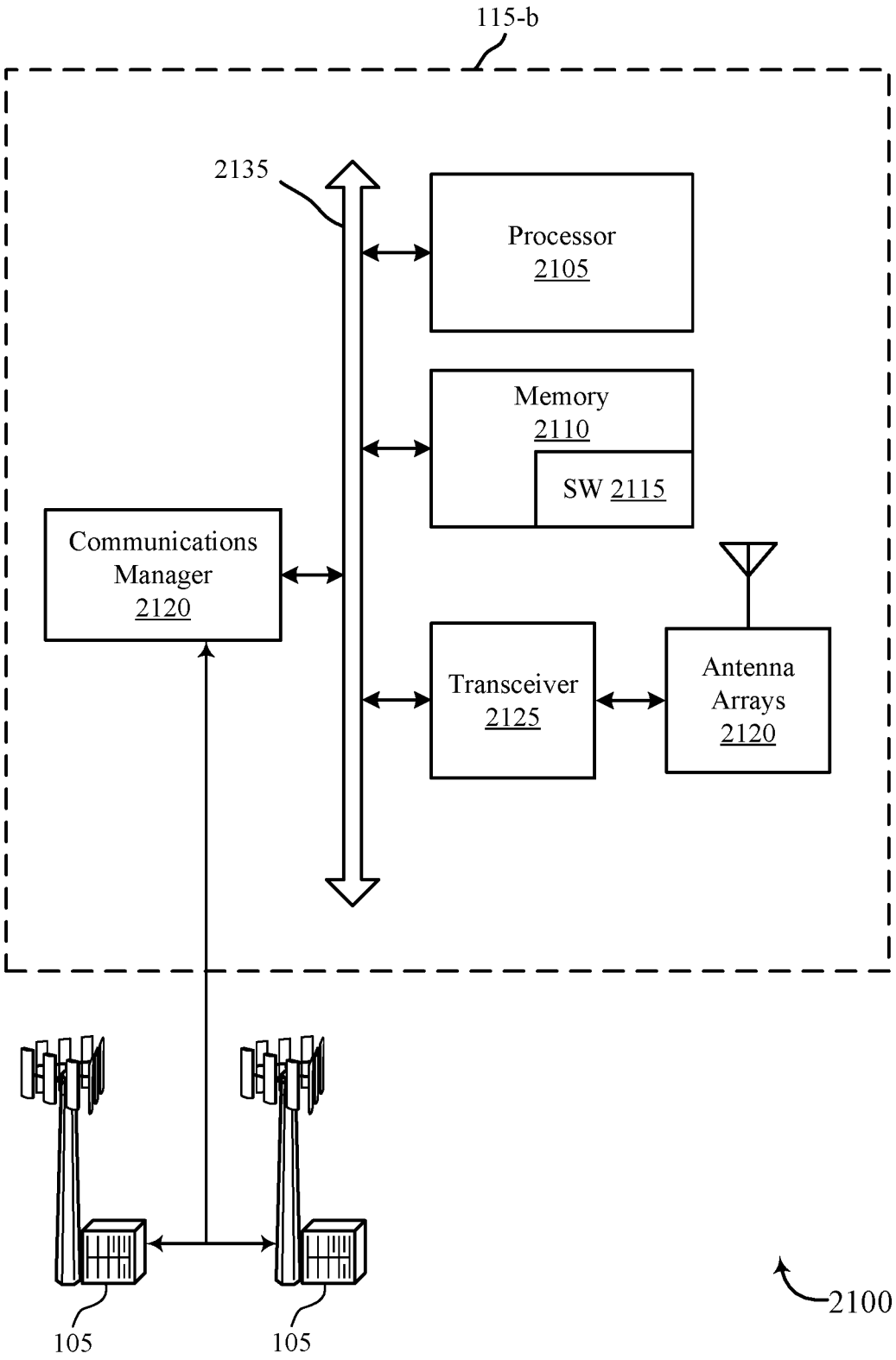
FIG. 21 illustrates an example of a block diagram illustrating an example of an architecture for a wireless device in accordance with aspects of the present disclosure.

FIG. 21 shows a block diagram 2100 illustrating an example of an architecture for a wireless device (e.g., a UE 115-*b*) for wireless communications, in accordance with various aspects of the present disclosure. A similar architecture may be used in a base station such as base station 105 described with reference to FIG. 1. The UE 115-*b* may have various configurations and may be included or be part of a personal computer (e.g., a laptop computer, netbook computer, tablet computer, etc.), a cellular telephone (e.g., a smartphone), a PDA, a digital video recorder (DVR), an internet appliance, a gaming console, an e-reader, etc. The UE 115-*b* may in some cases have an internal power supply (not shown), such as a small battery, to facilitate mobile operation. The UE 115-*b* may be an example of various aspects of the UEs 115 described with reference to FIG. 1. The UE 115-*b* may implement at least some of the features and functions described with reference to FIGS. 1, 2A, 2B, 3A, 4A, 4B, 4C, 4D, 4E, 5, 6, 8, 10A, 10B, 11, 12, and 19. The UE 115-*b* may communicate with a base station 105 described with reference to FIG. 1.

The UE 115-*b* may include a processor 2105, a memory 2110, a communications manager 2120, at least one transceiver 2125, and an antenna structure 2130 including one or more antenna arrays. Each of these components may be in communication with each other, directly or indirectly, over a bus 2135. The UE 115-*b* may also include a power source configured to provide electrical power to the processor 2105, memory 2110, communications manager 2120, and transceiver 2125.

Communications manager 2120 may establish a connection with, e.g., a base station 105, using a directional beam and transmit a signal to the base station 105 via transceiver 2125 and antenna arrays 2130.

The memory 2110 may include random access memory (RAM) and/or read-only memory (ROM). The memory 2110 may store computer-readable, computer-executable software (SW) code 2115 containing instructions, when executed, cause the processor 2105 to perform various functions described herein for wireless communications. Alternatively, the software code 2115 may not be directly executable by the processor 2105 but may cause the UE 115-*b* (e.g., when compiled and executed) to perform various functions described herein.

The processor 2105 may include an intelligent hardware device, e.g., a CPU, a microcontroller, an ASIC, etc. The processor 2105 may process information received through the transceiver(s) 2125 from the antenna arrays 2130 and/or information to be sent to the transceiver(s) 2125 for transmission through the antenna arrays 2130. The processor 2105 may handle, alone or in connection with the communications manager 2120, various aspects of wireless communications for the UE 115-*b*.

The transceiver(s) 2125 may monitor physical control channels for downlink transmissions and receive information, e.g., control information for uplink or downlink transmissions from, e.g., the base station 105. Based on the received information, transceiver 2125 may perform various functions as described herein. For example, transceiver 2125 may provide a signal (e.g., power) to antenna arrays 2130 via transmission lines, and cause antenna arrays 2130 to radiate at a certain frequency (e.g., 29 GHz or 38 GHz) based on the control information. Transceiver 2125 may include a modem to modulate packets and provide the modulated packets to the antenna structure 2130 for transmission, and to demodulate packets received from the antenna structure 2130. The transceiver(s) 2125 may in some cases be implemented as transmitters and separate receivers. The transceiver(s) 2125 may support communications according to multiple RATs (e.g., mmW, LTE, etc.). The transceiver(s) 2125 may communicate bi-directionally, via the antenna structure 2130, with one or more base stations 105 described with reference to FIG. 1.

The antenna arrays 2130 may receive the signal from transceiver 2125, feed the signal to a conductive element, e.g., a first bowtie element as described herein for excitation, and cause other conductive elements, e.g. a plurality of additional bowtie antennas to replicate the excitation by the first bowtie element and radiate at different frequencies. The antenna arrays 2130 may be an example of aspects of multilayer bowtie antenna structure 300 as described with reference to FIG. 3A. In some cases, the antenna arrays 2130 may include a plurality of stacks of bowtie antennas stacked in a first direction perpendicular to a first plane. Each stack may include a first bowtie antenna including a pair of electrically conductive elements disposed in the first plane and electrically coupled to a transmission line configured to provide a signal to each electrically conductive element. In some examples, the transmission line may be electrically coupled to a power source for exciting the first bowtie antenna. Each stack may include a plurality of additional bowtie antennas, each of the plurality of additional bowtie antennas including a corresponding pair of electrically conductive elements disposed in a different plane parallel to the first plane. In some examples, each bowtie antenna in the stack may be coupled to an adjacent bowtie antenna via connections (e.g., dielectric connections, vias, micro vias, etc.). In some examples, each bowtie antenna in the stack may be capacitively coupled to adjacent bowtie antenna in the stack.

In some examples, the antenna arrays 2130 may include a conductive wall extending in a second direction perpendicular to the first direction, the conductive wall extending higher in the first direction than the stack of bowtie antennas. The conductive wall may include a plurality of staggered electrical connections coupled to a grounding element (e.g., a ground plate, printed circuit board, etc.). In some examples, a distance between the conductive wall and the stack of bowtie antennas may be about a quarter wavelength of a target frequency of the UE 115-*b*. In some examples, the first plane may be a horizontal plane (e.g., an x-y plane), the first direction may be a vertical direction (e.g., a direction along z-axis), and the second direction may be a direction parallel to a vertical axis (e.g., y-axis) of the horizontal plane. In some examples, each bowtie antenna of the stack may radiate at a different frequency from an adjacent bowtie antenna in the stack, thereby increasing a frequency range over which the UE 115-*b* may operate. In some examples, the antenna arrays 2130 may cover a wide frequency range (e.g., 24 GHz to 43 GHz), thereby enabling the UE 115-*b* to operate effectively within a 5G network that may operate at e.g., 28 GHz or 39 GHz.

The transceiver(s) 2125, either alone or in conjunction with the communications manager 2120, may control operations of the antenna structure 2130. For example, the transceiver(s) 215, either alone or in conjunction with the communications manager 2120, may cause the power source to excite the first bowtie antenna in each antenna stack.

The communications manager 2120 and/or the transceiver (s) 2125 of the UE 115-*b* may, individually or collectively, be implemented using one or more application-specific integrated circuits (ASICs) adapted to perform some or all of the applicable functions in hardware. Alternatively, the functions may be performed by one or more other processing units (or cores), on one or more integrated circuits. In other examples, other types of integrated circuits may be used (e.g., Structured/Platform ASICs, Field Programmable Gate Arrays (FPGAs), and other Semi-Custom ICs), which may be programmed in any manner known in the art. The functions of each module may also be implemented, in whole or in part, with instructions embodied in a memory, formatted to be executed by one or more general or application-specific processors.

Figure 22:
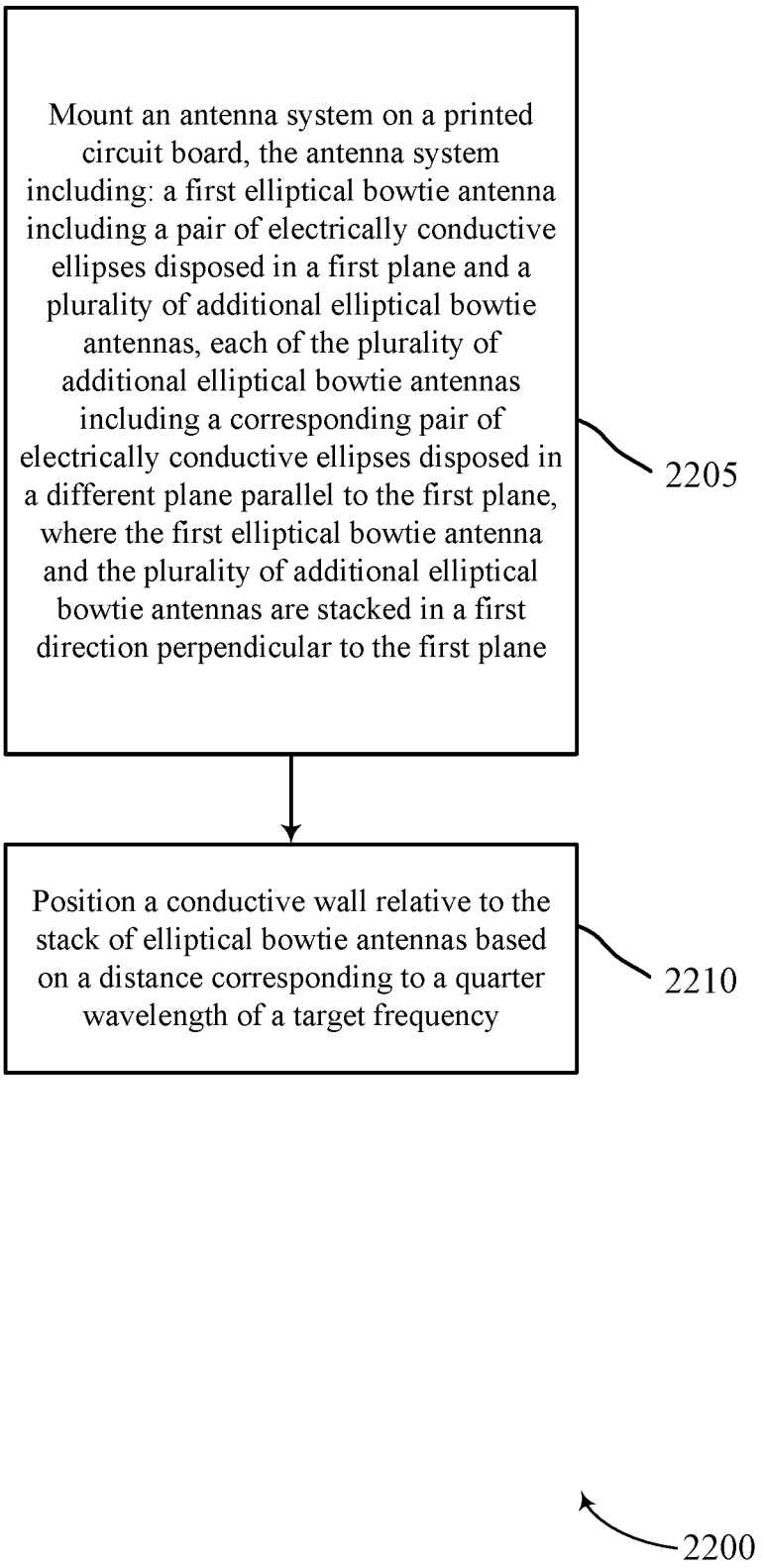
FIG. 22 illustrates an example of a flowchart illustrating a method for manufacturing a multilayer bowtie antenna structure in accordance with aspects of the present disclosure.

FIG. 22 shows a flowchart illustrating a method 2200 for manufacturing a multilayer bowtie antenna in accordance with various aspects of the present disclosure. The method may be used in conjunction with manufacturing antennas for use in a base station 105 or a UE 115 as described with reference to FIG. 1.

At 2205, an antenna system may be mounted on a printed circuit board. The antenna system may include a first elliptical bowtie antenna including a pair of electrically conductive ellipses disposed in a first plane and a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane. The antenna system may include other features discussed herein with reference to, e.g., FIGS. 2A, 2B, 3A, 3B, 4A, 4B, 4C, 4D, 4E, 5, 6, 8, 10A, 10B, 11, 12, and 19.

At 2210, a conductive wall may be positioned relative to the stack of elliptical bowtie antennas based at least in part on a distance corresponding to a quarter wavelength of a target frequency.

Figure 23:
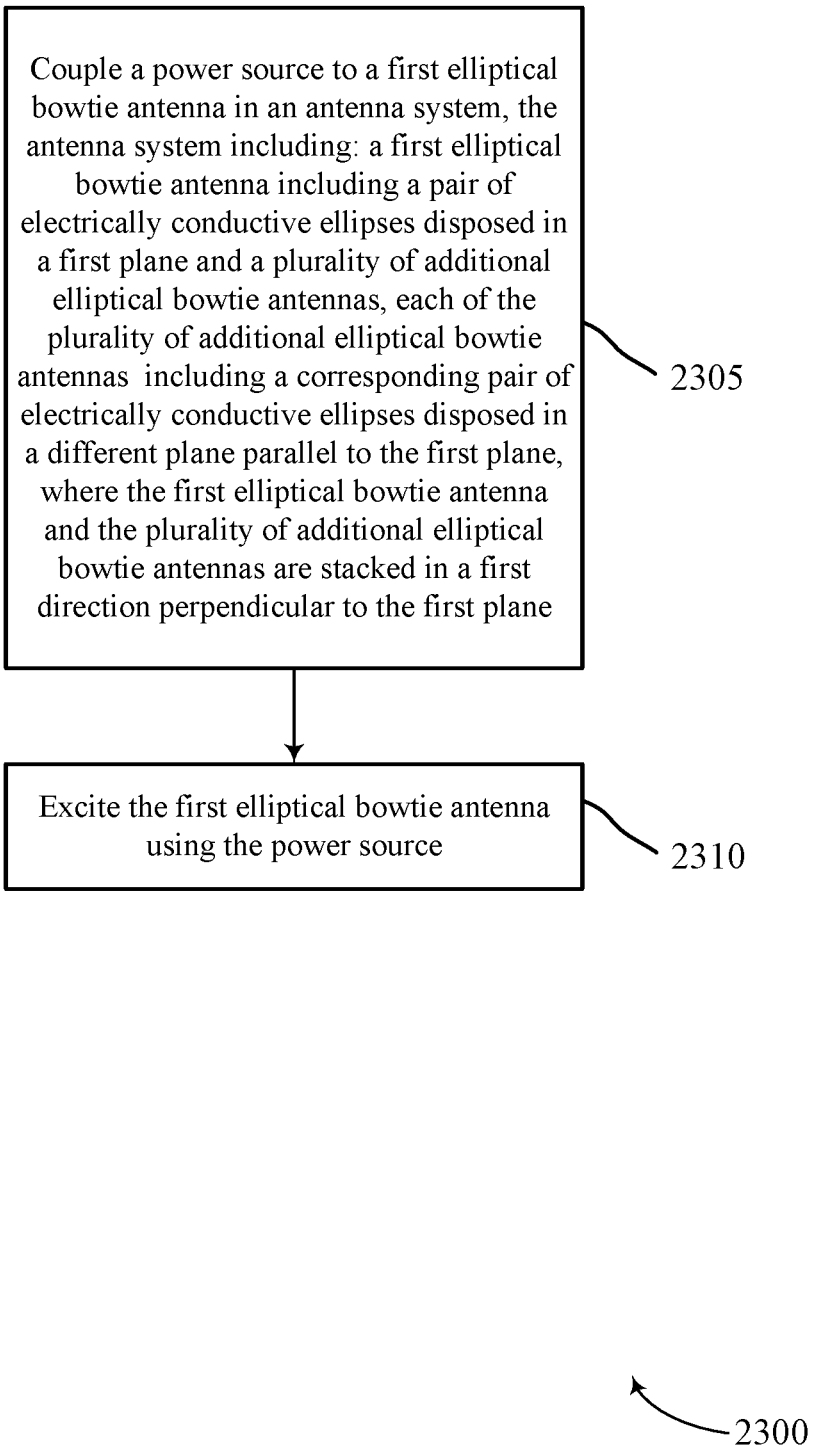
FIG. 23 illustrates an example of a flowchart illustrating a method for utilizing a multilayer bowtie antenna structure in accordance with aspects of the present disclosure.

FIG. 23 shows a flowchart illustrating a method 2300 for utilizing a multilayer bowtie antenna in accordance with aspects of the present disclosure. The operations of method 2300 may be implemented by a base station 105 or its components, or a UE 115 or its components, as described herein.

At 2305, a power source may be coupled to a first elliptical bowtie antenna in an antenna system, the antenna system including: a first elliptical bowtie antenna including a pair of electrically conductive ellipses disposed in a first plane and a plurality of additional elliptical bowtie antennas, each of the plurality of additional elliptical bowtie antennas including a corresponding pair of electrically conductive ellipses disposed in a different plane parallel to the first plane, where the first elliptical bowtie antenna and the plurality of additional elliptical bowtie antennas are stacked in a first direction perpendicular to the first plane. In some cases, the antenna system may include a plurality of additional elliptical bowtie antennas, and each of the plurality of additional elliptical bowtie antennas may include a corresponding pair of electrically conductive ellipses disposed in a different plane parallel to the first plane. In some examples, the first elliptical bowtie antenna and the plurality of additional elliptical bowtie antennas are stacked in a first direction perpendicular to the first plane. The antenna system may include other features discussed herein with reference to, e.g., FIGS. 2A, 2B, 3A, 3B, 4A, 4B, 4C, 4D, 4E, 5, 6, 8, 10A, 10B, 11, 12, and 19.

At 2310, the base station 105 or UE 115 may excite the first elliptical bowtie antenna using the power source. The operations of 2315 may be performed according to the methods described herein. In certain examples, aspects of the operations of 2310 may be performed by a communications manager and/or transceiver(s) as described with reference to FIG. 21.

Figure 24:
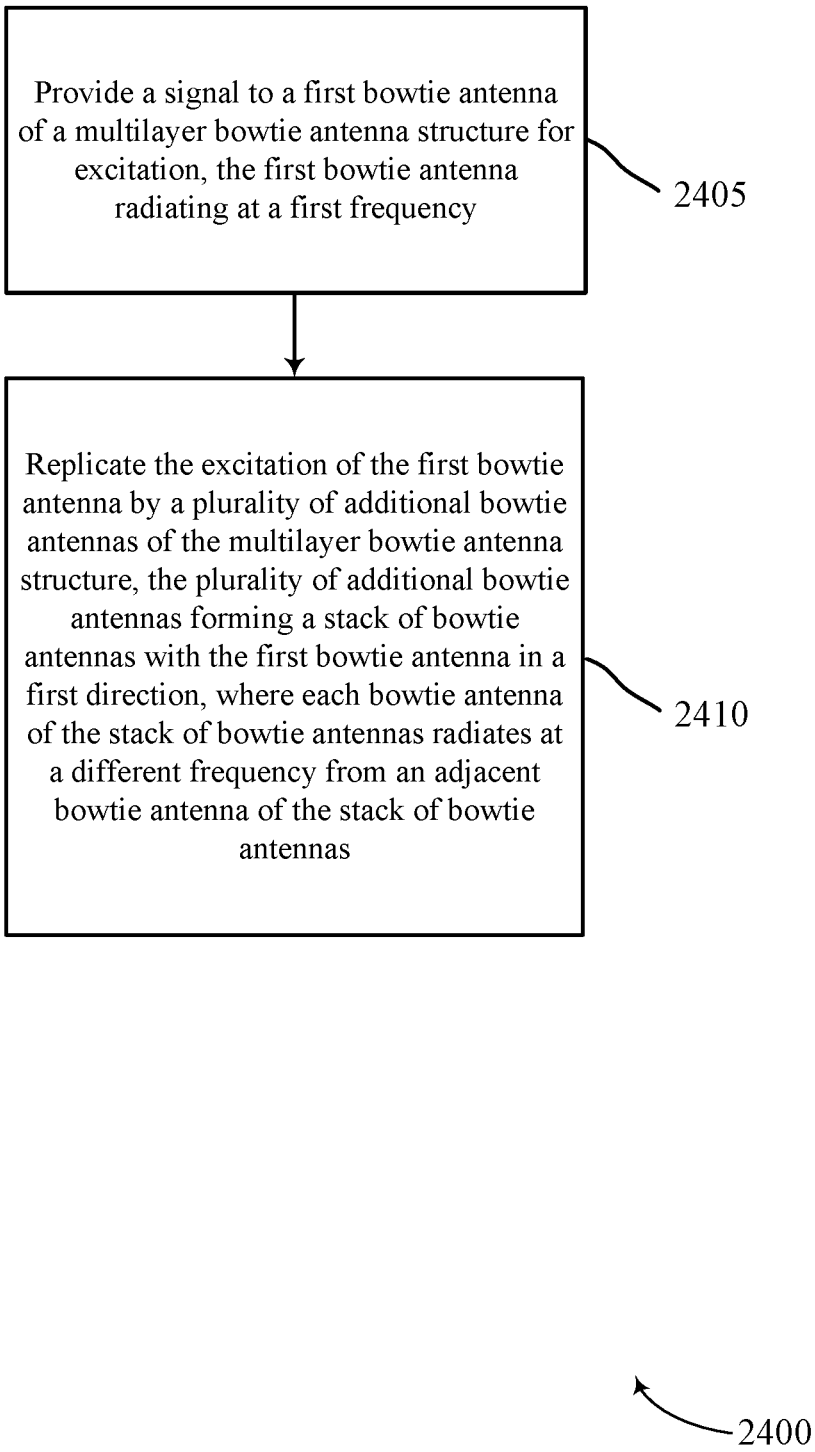
FIG. 24 illustrates an example of flowchart illustrating a method for utilizing a multilayer bowtie antenna structure in accordance with aspects of the present disclosure.

FIG. 24 shows a flowchart illustrating a method 2400 for utilizing a multilayer bowtie antenna in accordance with aspects of the present disclosure. The operations of method 2400 may be implemented by a wireless device, e.g., a base station 105 or its components, or a UE 115 or its components, as described herein.

At 2405, the wireless device may provide a signal (e.g., power) to a multilayer bowtie antenna structure for excitation. The signal may be provided to a first bowtie via a conductive connection (e.g., transmission line) electrically coupled to a power source that may be located internally (e.g., a battery) or externally to the wireless device (e.g., a wireless charge device at a customer premise equipment). The transmission line may be electrically coupled to a ground plate, which may be coupled to a chipset including, e.g., RF transceiver, PMIC, or processor. In some cases, the multilayer bowtie antenna structure may include the first bowtie antenna including a pair of electrically conductive elements disposed in a first plane (e.g., x-y plane) and a plurality of additional bowtie antennas, each of the plurality of additional bowtie antenna including a corresponding pair of electrically conductive elements disposed in a different plane parallel to the first plane. The multilayer bowtie antenna structure may include other features discussed herein with reference to, e.g., FIGS. 2A, 2B, 3A, 3B, 4A, 4B, 4C, 4D, 4E, 5, 6, 8, 10A, 10B, 11, 12, and 19. The operations of 2405 may be performed according to the methods described herein. In certain examples, aspects of the operations of 2405 may be performed by antenna array, communications manager and/or transceiver(s) as described with reference to FIG. 21.

At 2410, the wireless device may radiate at a first frequency via the first bowtie antenna of the multilayer bowtie antenna structure. The operations of 2410 may be performed according to the methods described herein. In certain examples, aspects of the operations of 2410 may be performed by antenna array, communications manager and/or transceiver(s) as described with reference to FIG. 21.

At 2415, the wireless device may radiate at a second frequency via an additional bowtie antenna of the multilayer bowtie antenna structure, where the first bowtie antenna and the additional bowtie antenna form a stack of bowtie antennas in a first direction. In some examples, the wireless device may replicate the excitation of the first bowtie antenna via the one or more additional bowtie antennas of the multilayer bowtie antenna structure, where the one or more additional bowtie antennas form a stack of bowtie antennas with the first bowtie antenna in a first direction (e.g., a direction along z-axis). The operations of 2415 may be performed according to the methods described herein. In certain examples, aspects of the operations of 2410 may be performed by antenna array, communications manager and/or transceiver (s) as described with reference to FIG. 21.

At 2420, the wireless device may reflect, via a conductive element, radiations of the stack of bowtie antennas. The operations of 2415 may be performed according to the methods described herein. In certain examples, aspects of the operations of 2420 may be performed by antenna array, communications manager and/or transceiver(s) as described with reference to FIG. 21.

It should be noted that the methods described above describe possible implementations, and that the operations and the steps may be rearranged or otherwise modified and that other implementations are possible. Further, aspects from two or more of the methods may be combined.

Techniques described herein may be used for various wireless communications systems such as code division multiple access (CDMA), time division multiple access (TDMA), frequency division multiple access (FDMA), orthogonal frequency division multiple access (OFDMA), single carrier frequency division multiple access (SC-FDMA), and other systems. A CDMA system may implement a radio technology such as CDMA2000, Universal Terrestrial Radio Access (UTRA), etc. CDMA2000 covers IS-2000, IS-95, and IS-856 standards. IS-2000 Releases may be commonly referred to as CDMA2000 1×, 1×, etc. IS-856 (TIA-856) is commonly referred to as CDMA2000 1×EV-DO, High Rate Packet Data (HRPD), etc. UTRA includes Wideband CDMA (WCDMA) and other variants of CDMA. A TDMA system may implement a radio technology such as Global System for Mobile Communications (GSM).

An OFDMA system may implement a radio technology such as Ultra Mobile Broadband (UMB), Evolved UTRA (E-UTRA), Institute of Electrical and Electronics Engineers (IEEE) 802.11 (Wi-Fi), IEEE 802.16 (WiMAX), IEEE 802.20, Flash-OFDM, etc. UTRA and E-UTRA are part of Universal Mobile Telecommunications System (UMTS). LTE and LTE-A are releases of UMTS that use E-UTRA. UTRA, E-UTRA, UMTS, LTE, LTE-A, NR, and GSM are described in documents from the organization named "3rd Generation Partnership Project" (3GPP). CDMA2000 and UMB are described in documents from an organization named "3rd Generation Partnership Project 2" (3GPP2). The techniques described herein may be used for the systems and radio technologies mentioned above as well as other systems and radio technologies. While aspects of an LTE or an NR system may be described for purposes of example, and LTE or NR terminology may be used in much of the description, the techniques described herein are applicable beyond LTE or NR applications.

A macro cell generally covers a relatively large geographic area (e.g., several kilometers in radius) and may allow unrestricted access by UEs 115 with service subscriptions with the network provider. A small cell may be associated with a lower-powered base station 105, as compared with a macro cell, and a small cell may operate in the same or different (e.g., licensed, unlicensed, etc.) frequency bands as macro cells. Small cells may include pico cells, femto cells, and micro cells according to various examples. A pico cell, for example, may cover a small geographic area and may allow unrestricted access by UEs 115 with service subscriptions with the network provider. A femto cell may also cover a small geographic area (e.g., a home) and may provide restricted access by UEs 115 having an association with the femto cell (e.g., UEs 115 in a closed subscriber group (CSG), UEs 115 for users in the home, and the like). An eNB for a macro cell may be referred to as a macro eNB. An eNB for a small cell may be referred to as a small cell eNB, a pico eNB, a femto eNB, or a home eNB. An eNB may support one or multiple (e.g., two, three, four, and the like) cells, and may also support communications using one or multiple component carriers.

The wireless communications system 100 or systems described herein may support synchronous or asynchronous operation. For synchronous operation, the base stations 105 may have similar frame timing, and transmissions from different base stations 105 may be approximately aligned in time. For asynchronous operation, the base stations 105 may have different frame timing, and transmissions from different base stations 105 may not be aligned in time. The techniques described herein may be used for either synchronous or asynchronous operations.

Information and signals described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and modules described in connection with the disclosure herein may be implemented or performed with a general-purpose processor, a digital signal processor (DSP), an application-specific integrated circuit (ASIC), a field-programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices (e.g., a combination of a DSP and a microprocessor, multiple microprocessors, one or more microprocessors in conjunction with a DSP core, or any other such configuration).

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

Computer-readable media includes both non-transitory computer storage media and communication media including any medium that facilitates transfer of a computer program from one place to another. A non-transitory storage medium may be any available medium that can be accessed by a general purpose or special purpose computer. By way of example, and not limitation, non-transitory computer-readable media may include random-access memory (RAM), read-only memory (ROM), electrically erasable programmable read only memory (EEPROM), flash memory, compact disk (CD) ROM or other optical disk storage, magnetic disk storage or other magnetic storage devices, or any other non-transitory medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include CD, laser disc, optical disc, digital versatile disc (DVD), floppy disk and Blu-ray disc where disks usually reproduce data magnetically, while discs reproduce data optically with lasers. Combinations of the above are also included within the scope of computer-readable media.

As used herein, including in the claims, "or" as used in a list of items (e.g., a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label, or other subsequent reference label.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. An apparatus for wireless communication, comprising:

a first elliptical bowtie antenna comprising a pair of electrically conductive ellipses disposed in a first plane and electrically coupled to a conductive connection configured to provide a signal to each of the electrically conductive ellipses;

a plurality of additional elliptical bowtie antennas, each of the plurality of additional elliptical bowtie antennas comprising a corresponding pair of electrically conductive ellipses disposed in a different plane parallel to the first plane;

wherein the first elliptical bowtie antenna and the plurality of additional elliptical bowtie antennas form a stack of elliptical bowtie antennas stacked in a first direction perpendicular to the first plane, wherein the stack of elliptical bowtie antennas comprises a first set of elliptical bowtie antennas and a second set of elliptical bowtie antennas, wherein a first distance between the first set of elliptical bowtie antennas and the second set of elliptical bowtie antennas is larger than distances between adjacent bowtie antennas within either the first set of elliptical bowtie antennas or the second set of elliptical bowtie antennas.

2. The apparatus of claim 1, further comprising:

a conductive wall extending in a second direction perpendicular to the first direction.

3. The apparatus of claim 2, wherein the conductive wall extends in the first direction into a plane formed by the stack of elliptical bowtie antennas.

4. The apparatus of claim 2, wherein the conductive wall extends at least as high or higher in the first direction than the stack of elliptical bowtie antennas.

5. The apparatus of claim 2, wherein the conductive wall comprises:

a plurality of staggered electrical connections coupled to a grounding element.

6. The apparatus of claim 5, wherein:

the plurality of staggered electrical connections comprise a plurality of staggered vias.

7. The apparatus of claim 2, wherein a distance between the conductive wall and the stack of elliptical bowtie antennas is about a quarter wavelength of a target frequency of the apparatus.

8. The apparatus of claim 1, wherein each elliptical bowtie antenna of the stack of elliptical bowtie antennas is spaced apart from an adjacent elliptical bowtie antenna of the stack of elliptical bowtie antennas in the first direction.

9. The apparatus of claim 1, further comprising:

a plurality of connections coupling the first elliptical bowtie antenna and the plurality of additional elliptical bowtie antennas.

10. The apparatus of claim 1, wherein:

the first plane comprises a horizontal plane; and the first direction comprises a vertical direction.

11. The apparatus of claim 1, wherein:

a length of an electrically conductive ellipse of the first elliptical bowtie antenna is five times a width of the electrically conductive ellipse.

12. The apparatus of claim 1, wherein one or more additional elliptical bowtie antennas of the plurality of additional elliptical antennas comprise electrically conductive ellipses that are shorter in length than the electrically conductive ellipses of the first elliptical bowtie antenna.

13. The apparatus of claim 1, wherein an additional elliptical bowtie antenna of the plurality of additional elliptical bowtie antennas comprises a tab.

14. The apparatus of claim 1, wherein one or more additional elliptical bowtie antennas of the stack of elliptical bowtie antennas are floating relative to the first elliptical bowtie antenna.

15. The apparatus of claim 1, wherein one or more additional elliptical bowtie antennas of the plurality of additional elliptical antennas are capacitively coupled to an adjacent elliptical bowtie antenna of the stack of elliptical bowtie antennas.

16. The apparatus of claim 1, further comprising:

one or more second elliptical bowtie antennas disposed in the first plane.

17. The apparatus of claim 1, further comprising:

one or more stacks of elliptical bowtie antennas positioned adjacent to the stack of elliptical bowtie antennas in a second direction perpendicular to the first direction.

18. The apparatus of claim 1, further comprising:

one or more additional stacks of elliptical bowtie antennas stacked in the first direction.

19. The apparatus of claim 1, further comprising:

a printed circuit board, wherein the stack of elliptical bowtie antennas and the conductive connection are electrically coupled to the printed circuit board.

20. The apparatus of claim 1, wherein the first elliptical bowtie antenna and the plurality of additional elliptical bowtie antennas are configured to send and receive wireless signals in a frequency range including about 24 GHz to 43 GHz.

21. The apparatus of claim 1, further comprising a conductive wall comprising a plurality of first vias extending in the first direction into a plane formed by the stack of elliptical bowtie antennas, the conductive wall further comprising a plurality of second vias each connected to the plurality of first vias, the plurality of second vias extending in the first direction and each spaced apart from each of the plurality of first vias in a second direction different than the first direction.

22. The apparatus of claim 1, further comprising a conductive wall comprising a plurality of first vias extending in the first direction and a plurality of second vias extending in the first direction, wherein each of the plurality of second vias have a different dimension along the first direction than each of the plurality of first vias.

23. The apparatus of claim 1, wherein the stack of elliptical bowtie antennas further comprises a plurality of staggered connections coupling the first elliptical bowtie antenna and the plurality of additional elliptical bowtie antennas.

24. An apparatus for wireless communication, comprising:

a first bowtie antenna comprising a pair of electrically conductive elements disposed in a first plane and electrically coupled to a conductive connection configured to provide a signal to each electrically conductive element;

a plurality of additional bowtie antennas, each of the plurality of additional bowtie antennas comprising a corresponding pair of electrically conductive elements disposed in a different plane parallel to the first plane, wherein the first bowtie antenna and the plurality of additional bowtie antennas form a stack of bowtie antennas stacked in a first direction perpendicular to the first plane, wherein the stack of bowtie antennas further comprises a plurality of staggered connections coupling the first bowtie antenna and the plurality of additional bowtie antennas; and a conductive wall extending in a second direction perpendicular to the first direction.

25. The apparatus of claim 24, wherein the conductive wall extends in the first direction into a plane formed by the stack of bowtie antennas.

26. The apparatus of claim 24, wherein the conductive wall extends at least as high or higher in the first direction than the stack of bowtie antennas.

27. The apparatus of claim 24, wherein the conductive wall comprises:

a plurality of staggered electrical connections coupled to a grounding element.

28. The apparatus of claim 27, wherein:

the plurality of staggered electrical connections comprise a plurality of staggered vias.

29. The apparatus of claim 24, wherein a distance between the conductive wall and the stack of bowtie antennas is about a quarter wavelength of a target frequency of the apparatus.

30. The apparatus of claim 24, wherein the stack of bowtie antennas further comprising:

a plurality of connections coupling the first bowtie antenna and the plurality of additional bowtie antennas.

31. The apparatus of claim 24, wherein:

the first plane comprises a horizontal plane;

the first direction comprises a vertical direction; and the second direction comprises a horizontal direction parallel to a vertical axis of the first plane.

32. The apparatus of claim 24, wherein an additional bowtie antenna of the plurality of additional bowtie antennas comprises a tab.

33. The apparatus of claim 24, wherein one or more additional bowtie antennas of the stack of bowtie antennas are floating relative to the first bowtie antenna.

34. The apparatus of claim 24, wherein one or more additional bowtie antennas of the plurality of additional antennas are capacitively coupled to an adjacent bowtie antenna of the stack of bowtie antennas.

35. The apparatus of claim 24, wherein the apparatus is a user equipment (UE), and the apparatus further comprising:

a transceiver connected to the first bowtie antenna and the plurality of additional bowtie antennas;

wherein the transceiver is configured to use the first bowtie antenna and the plurality of additional bowtie antennas to send and receive wireless signals in a frequency range including about 24 GHz to 43 GHz.

36. The apparatus of claim 24, wherein the stack of bowtie antennas comprises a first set of bowtie antennas and a second set of bowtie antennas, wherein a first distance between the first set of bowtie antennas and the second set of bowtie antennas is larger than distances between adjacent bowtie antennas within either the first set of bowtie antennas or the second set of bowtie antennas.

37. The apparatus of claim 24, wherein the conductive wall comprises a plurality of first vias extending in the first direction into a plane formed by the stack of bowtie antennas, the conductive wall further comprising a plurality of second vias each connected to the plurality of first vias, the plurality of second vias extending in the first direction and each spaced apart from each of the plurality of first vias in a second direction different than the first direction.

38. The apparatus of claim 24, wherein the conductive wall comprises a plurality of first vias extending in the first direction and a plurality of second vias extending in the first direction, wherein each of the plurality of second vias have a different dimension along the first direction than each of the plurality of first vias.

39. An apparatus for wireless communication, comprising:

means for radiating at different frequencies, the means for radiating comprising a stack of bowtie antennas including a first bowtie antenna and a plurality of additional bowtie antennas, the stack of bowtie antennas including a plurality of staggered connections coupling the first bowtie antenna and the plurality of additional bowtie antennas; and means for reflecting radiations of the stack of bowtie antennas to increase symmetry of radiation pattern at at least one of the different frequencies.

40. The apparatus of claim 39, further comprising:

means for increasing directivity of the apparatus via one or more additional stacks of bowtie antennas forming an array with the stack of bowtie antennas.

41. The apparatus of claim 39, wherein each bowtie antenna of the stack of bowtie antennas are spaced apart from an adjacent bowtie antenna in a first direction.

42. The apparatus of claim 41, wherein means for reflecting radiations comprises at least one of a conductive wall or a conductive strip extending in a second direction perpendicular to the first direction.

43. The apparatus of claim 42, wherein the conductive wall comprises a plurality of staggered conductive elements.

44. The apparatus of claim 43, wherein the plurality of staggered conductive elements comprise a plurality of vias.

45. A method for wireless communication, comprising:

providing a signal to a multilayer bowtie antenna structure for excitation, the multilayer bowtie antenna structure including a first bowtie antenna and a plurality of additional bowtie antennas;

radiating at a first frequency via the first bowtie antenna of the multilayer bowtie antenna structure;

radiating at a second frequency via an additional bowtie antenna of the plurality of additional bowtie antennas of the multilayer bowtie antenna structure, wherein the first bowtie antenna and the plurality of additional bowtie antennas form a stack of bowtie antennas in a first direction, the stack of bowtie antennas including a plurality of staggered connections coupling the first bowtie antenna and the plurality of additional bowtie antennas; and reflecting, via a conductive element, radiations of the stack of bowtie antennas.

46. The method of claim 45, wherein the stack of bowtie antennas form an array with one or more additional stacks of bowtie antennas to increase directivity of the multilayer bowtie antenna structure.

47. The method of claim 45, wherein each bowtie antenna of the stack of bowtie antennas are spaced apart from an adjacent bowtie antenna of the stack of bowtie antennas in the first direction.

48. The method of claim 47, wherein each bowtie antenna of the stack of bowtie antennas is coupled to an adjacent bowtie antenna of the stack of bowtie antennas via a plurality of connections.

49. The method of claim 45, wherein the conductive element comprises at least one of a conductive wall or a conductive bar extending in a second direction perpendicular to the first direction.

50. The method of claim 49, wherein the conductive wall comprises a plurality of staggered vias.

* * * * *